US005920955A

United States Patent [19]

Berfield

[11] Patent Number: 5,920,955

[45] Date of Patent: Jul. 13, 1999

[54] SELF-EVACUATING VACUUM CLEANER

[75] Inventor: Robert C. Berfield, Jersey Shore, Pa.

[73] Assignee: Shop Vac Corporation, Williamsport, Pa.

[21] Appl. No.: 08/802,333

[22] Filed: Feb. 11, 1997

Related U.S. Application Data

[63] Continuation-in-part of application No. 08/784,248, Jan. 15, 1997, abandoned, which is a continuation-in-part of application No. 08/756,165, Nov. 25, 1996, which is a continuation-in-part of application No. 08/727,318, Oct. 8, 1996, which is a continuation-in-part of application No. 08/678,997, Jul. 12, 1996, Pat. No. 5,850,668.

[51] Int. Cl.[6] ..... A47L 7/00

[52] U.S. Cl. ..... 15/352; 15/321; 15/353

[58] Field of Search ..... 15/320, 321, 353, 15/352

[56] References Cited

U.S. PATENT DOCUMENTS

| | | | |
|---|---|---|---|
| D. 344,822 | 3/1994 | Miller et al. . | |
| D. 354,380 | 1/1995 | Stephens . | |
| D. 355,109 | 2/1995 | Moine et al. . | |
| D. 357,336 | 4/1995 | Moine et al. . | |
| D. 357,773 | 4/1995 | Wareham et al. . | |
| D. 361,179 | 8/1995 | Moine et al. . | |
| D. 372,567 | 8/1996 | Moine et al. . | |
| D. 373,862 | 9/1996 | Stephens et al. . | |
| 961,816 | 6/1910 | Squier . | |
| 1,661,480 | 3/1928 | Keefer . | |
| 1,691,164 | 11/1928 | Monk | 15/321 |
| 1,840,257 | 1/1932 | Saxe et al. . | |
| 1,849,093 | 3/1932 | Janette . | |
| 1,982,345 | 11/1934 | Kirby . | |
| 1,993,267 | 3/1935 | Ferguson . | |
| 2,034,623 | 4/1936 | Christensen . | |
| 2,049,603 | 8/1936 | Dietenberger . | |
| 2,292,425 | 8/1942 | Crites | 15/321 |
| 2,292,435 | 8/1942 | Crites | 15/321 |
| 2,424,657 | 7/1947 | Goodman . | |
| 2,470,066 | 5/1949 | Calabrese . | |
| 2,499,876 | 3/1950 | Platek . | |
| 2,643,732 | 6/1953 | Keen . | |
| 2,657,416 | 11/1953 | Smith . | |
| 2,718,656 | 9/1955 | Kirk . | |
| 2,757,406 | 8/1956 | Decker . | |
| 2,791,964 | 5/1957 | Reeve . | |
| 2,909,800 | 10/1959 | Grindle et al. . | |
| 2,932,844 | 4/1960 | O'Connor | 15/321 |
| 2,972,769 | 2/1961 | Keating et al. . | |
| 3,029,461 | 4/1962 | Osborn . | |
| 3,048,875 | 8/1962 | Bottinelli et al. . | |
| 3,173,164 | 3/1965 | Congdon | 15/314 |

(List continued on next page.)

FOREIGN PATENT DOCUMENTS

| | | |
|---|---|---|
| 0 012 337 | 6/1980 | European Pat. Off. . |
| 0 017 519 | 10/1980 | European Pat. Off. . |
| 2 484 558 | 12/1981 | France . |
| 40 17 366 | 12/1991 | Germany . |
| 2246284 | 1/1992 | United Kingdom . |

OTHER PUBLICATIONS

PCT International Search Report for International application No. PCT/US 97/12067, filed Jul. 11, 1997 (4 pages).
PCT International Search Report for International application No. PCT/US 97/18134, filed Oct. 6, 1997 (4 pages).
PCT International Search Report for International application No. PCT/US 98/00597, filed Jan. 14, 1998 (4 pages).

*Primary Examiner*—Chris K. Moore
*Attorney, Agent, or Firm*—Marshall, O'Toole, Gerstein, Murray & Borun

[57] ABSTRACT

A vacuum cleaner has an electric motor driving an air impeller for creating suction and a pump which draws liquid material through an inlet tube from the bottom of the tank and expels it from the tank. A priming apparatus is disposed in the tank chamber in fluid communication with the pump and a valve is selectively actuable to establish a pressure differential across liquid in the priming apparatus to thereby prime the pump.

10 Claims, 42 Drawing Sheets

U.S. PATENT DOCUMENTS 3,303,785 2/1967 Pearce .
3,327,144 6/1967 Double .
3,345,488 10/1967 Siegal .
3,355,762 12/1967 Cavell et al. .
3,398,250 8/1968 Bowers .
3,471,663 10/1969 Farrell et al. .
3,496,592 2/1970 Jones .
3,502,825 3/1970 Bailey et al. .
3,552,100 1/1971 Ekenberg .
3,605,786 9/1971 Machin, Jr. .
3,614,797 10/1971 Jones .
3,616,482 11/1971 Brycki .
3,720,977 3/1973 Brycki .
3,774,260 11/1973 Emus, Jr. .
3,818,537 6/1974 Evans .
3,828,390 8/1974 Cater .
3,909,197 9/1975 Cremers .
3,914,592 10/1975 Maxey .
3,939,527 2/1976 Jones .
3,942,217 3/1976 Bates .
3,977,797 8/1976 Paterson .
4,021,144 5/1977 Matsusaka .
4,080,104 3/1978 Brown, Jr. .
4,087,706 5/1978 Koester, Jr. .
4,087,881 5/1978 Bates .
4,114,229 9/1978 Jones et al. .
4,123,818 11/1978 Hurwitz .
4,138,761 2/1979 Nauta .
4,153,968 5/1979 Perkins ..... 15/321
4,171,208 10/1979 Lowder .
4,179,768 12/1979 Sawyer .
4,185,354 1/1980 Brazier .
4,194,262 3/1980 Finley et al. .
4,207,649 6/1980 Bates .
4,216,563 8/1980 Cyphert .
4,218,805 8/1980 Brazier .
4,226,000 10/1980 Tribolet .
4,244,079 1/1981 Bane .
4,246,676 1/1981 Hallsworth et al. ..... 15/353
4,267,617 5/1981 Brown et al. .
4,287,636 9/1981 Brazier .
4,314,385 2/1982 Wimsatt et al. .
4,318,202 3/1982 Holman .
4,321,219 3/1982 Barker .
4,329,756 5/1982 Chicoine et al. .
4,348,783 9/1982 Swanson et al. .
4,353,145 10/1982 Woodford .
4,397,057 8/1983 Harbeck .
4,458,377 7/1984 Frohbieter .
4,654,926 4/1987 McCambridge .
4,667,364 5/1987 Meili .
4,675,935 6/1987 Kasper et al. .
4,723,337 2/1988 Ellison et al. ..... 15/300 A
4,741,069 5/1988 Helm et al. .
4,776,058 10/1988 Garner et al. .
4,788,738 12/1988 Monson et al. .
4,800,612 1/1989 Valentine .
4,800,613 1/1989 Blase et al. .
4,801,376 1/1989 Kulitz .
4,809,396 3/1989 Houser .
4,827,562 5/1989 Blase et al. .
4,841,595 6/1989 Wiese .
4,845,793 7/1989 Meyer .
4,847,943 7/1989 Blase et al. .
4,864,680 9/1989 Blase et al. .
4,934,017 6/1990 Kent .
4,949,424 8/1990 Shero .
4,956,891 9/1990 Wulff .
4,974,282 12/1990 Stoltz et al. .
4,976,850 12/1990 Kulitz .
4,977,638 12/1990 Best .
5,012,549 5/1991 Williams et al. .
5,048,148 9/1991 Gleadall .
5,086,537 2/1992 McDowell et al. .
5,099,543 3/1992 Wade .
5,120,922 6/1992 Brouillette .
5,125,126 6/1992 Bonnant .
5,134,748 8/1992 Lynn .
5,174,730 12/1992 Nieuwkamp et al. .
5,182,834 2/1993 Wright et al. .
5,184,370 2/1993 Jung ..... 15/321
5,189,755 3/1993 Yonkers et al. .
5,210,902 5/1993 Lee et al. .
5,244,003 9/1993 Boomgaarden .
5,263,225 11/1993 Winters .
5,267,370 12/1993 Worwag .
5,287,587 2/1994 Yonkers et al. .
5,287,590 2/1994 Yonkers et al. .
5,289,611 3/1994 Yonkers et al. .
5,330,699 7/1994 Shetler et al. .
5,334,000 8/1994 Nordlin ..... 417/360
5,349,722 9/1994 Chayer ..... 15/353
5,373,606 12/1994 Bosyj et al. .
5,388,301 2/1995 Bosyj et al. .
5,404,614 4/1995 Stephens .
5,406,673 4/1995 Bradd et al. .
5,430,910 7/1995 Wiley .
5,443,362 8/1995 Crites et al. .
5,455,983 10/1995 Crouser et al. .
5,455,984 10/1995 Blase .
5,465,455 11/1995 Allen .
5,469,598 11/1995 Sales .
5,526,547 6/1996 Williams et al. .
5,535,500 7/1996 Stephens et al. .
5,555,597 9/1996 Berfield ..... 15/321
5,715,568 2/1998 Berfield et al. ..... 15/353

FIG. 21
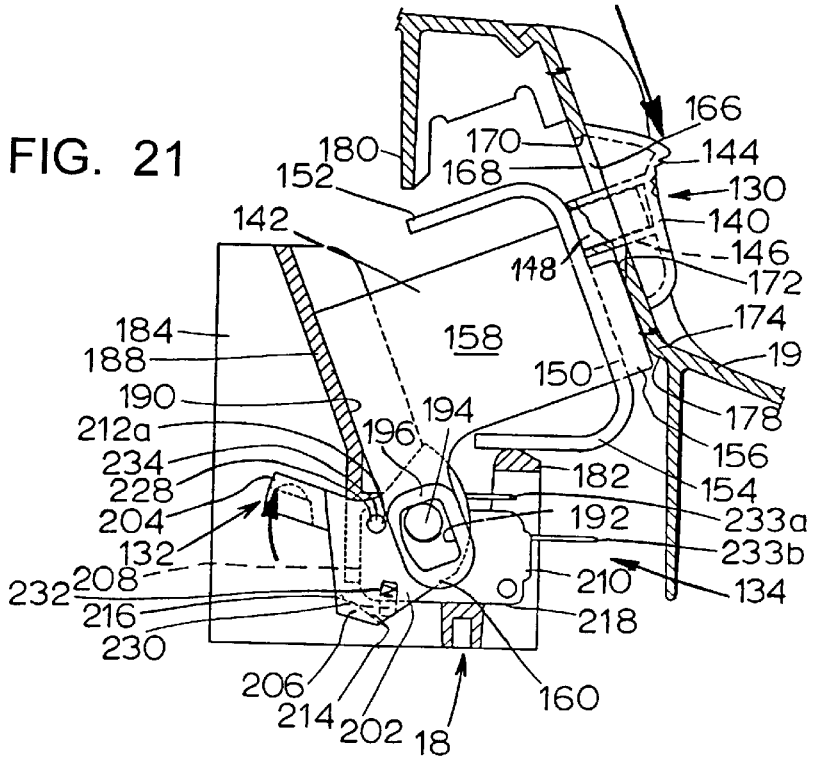
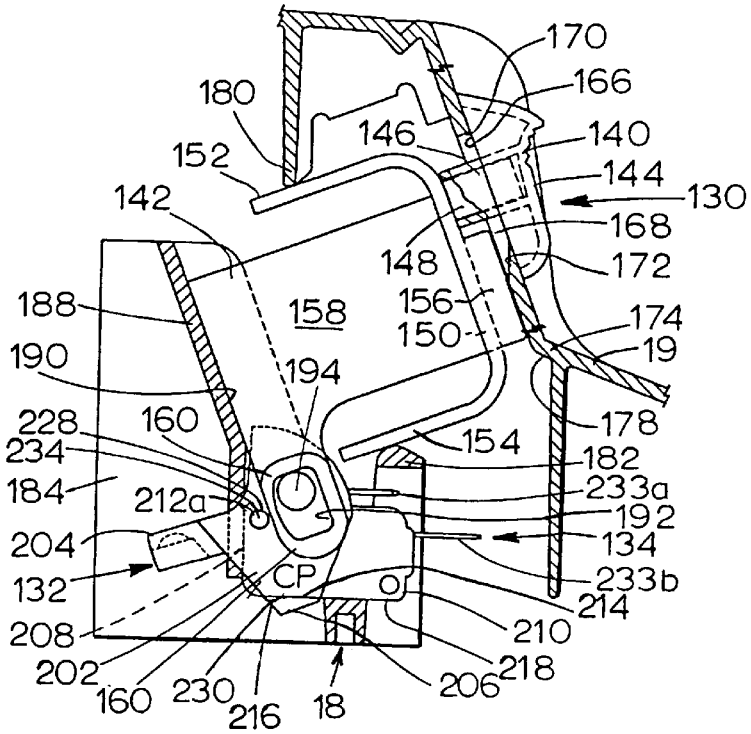
FIG. 20

FIG. 22
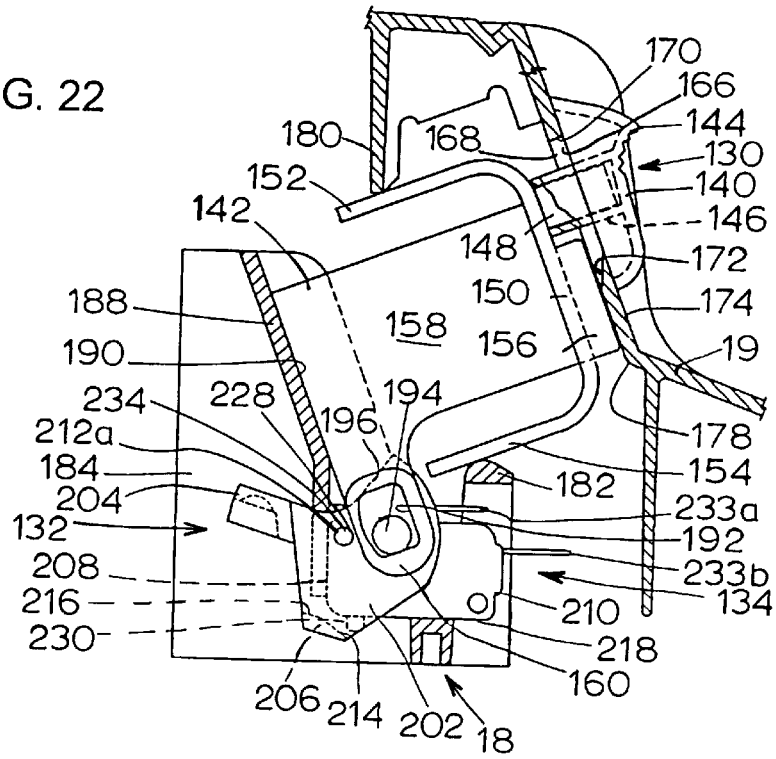
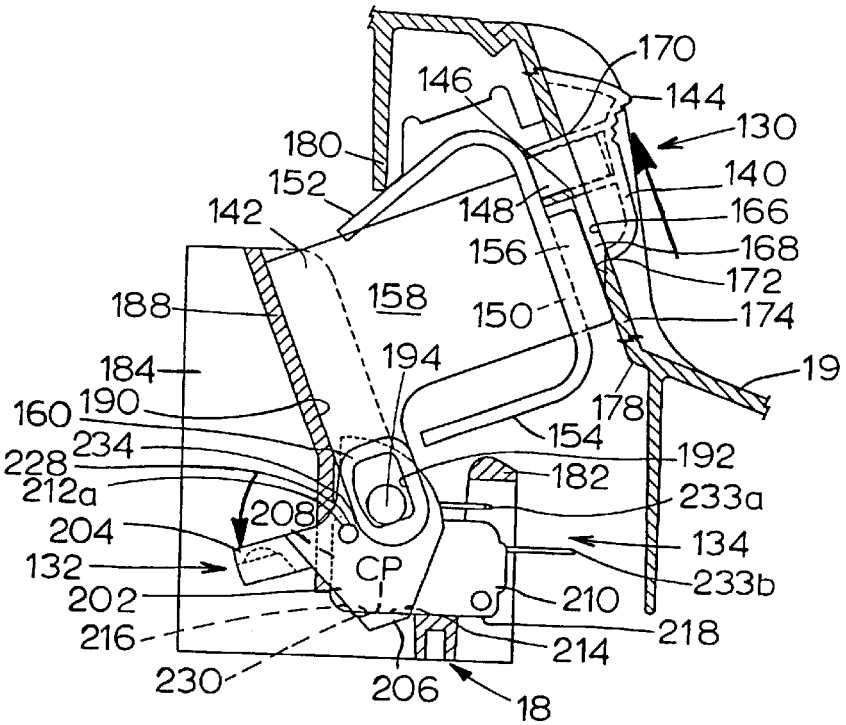
FIG. 23

FIG. 35A
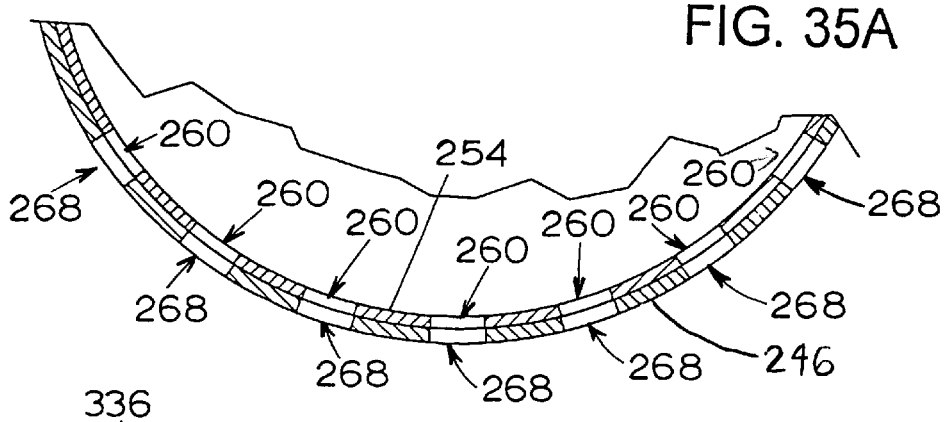
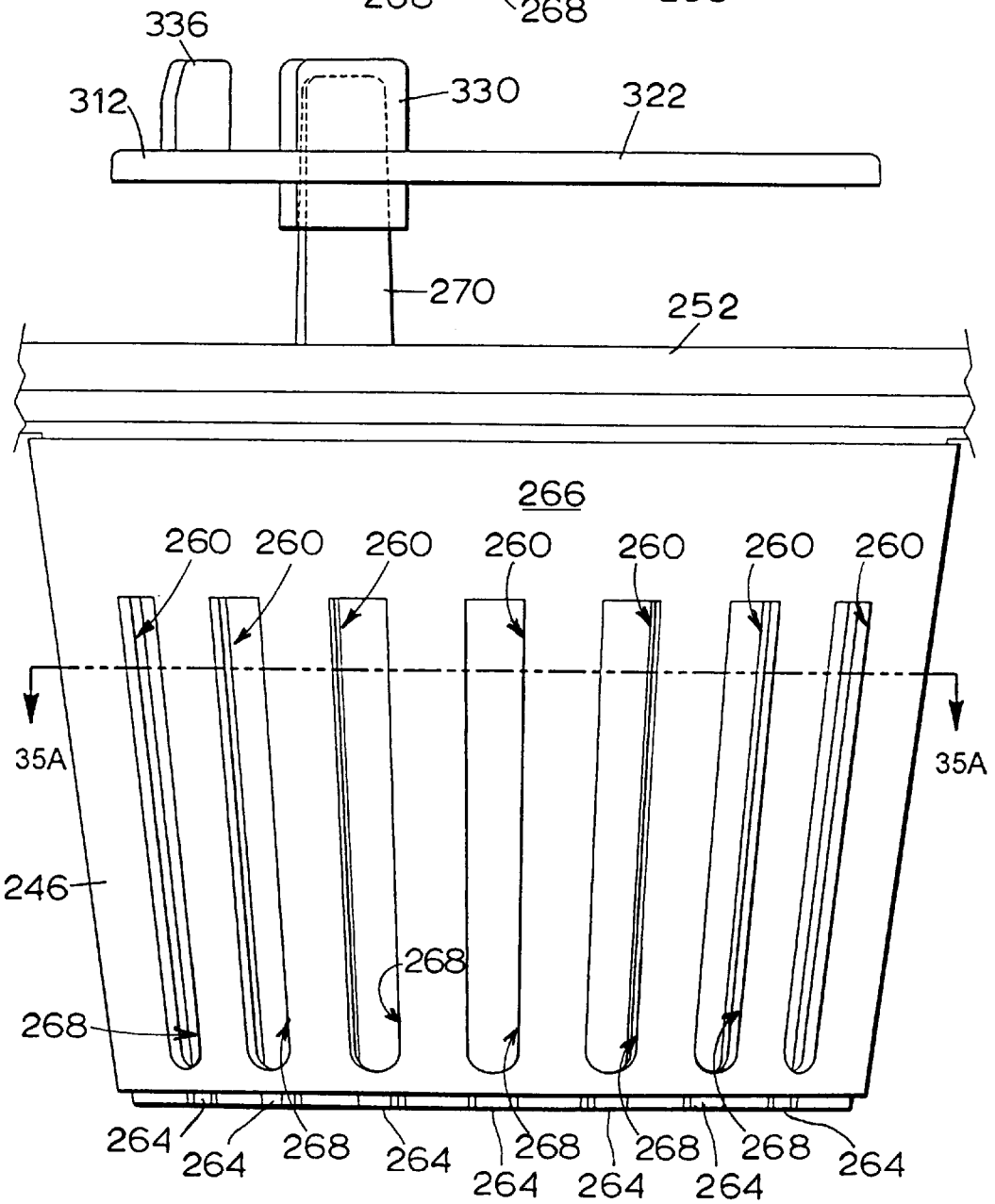
FIG. 35

FIG. 36A
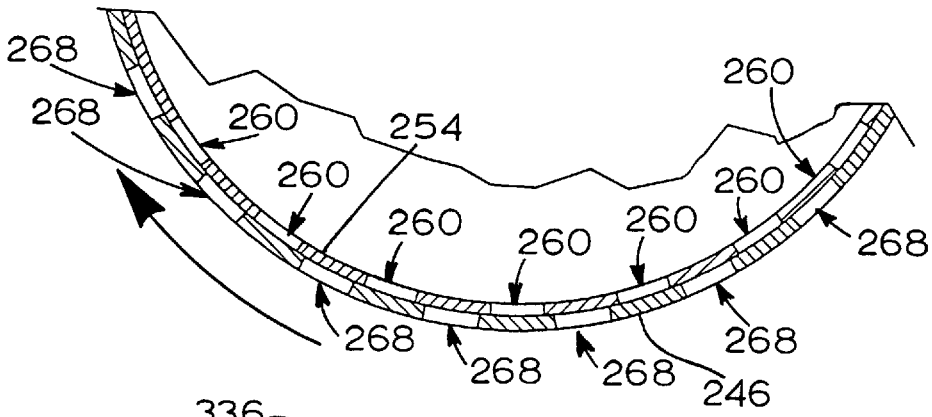
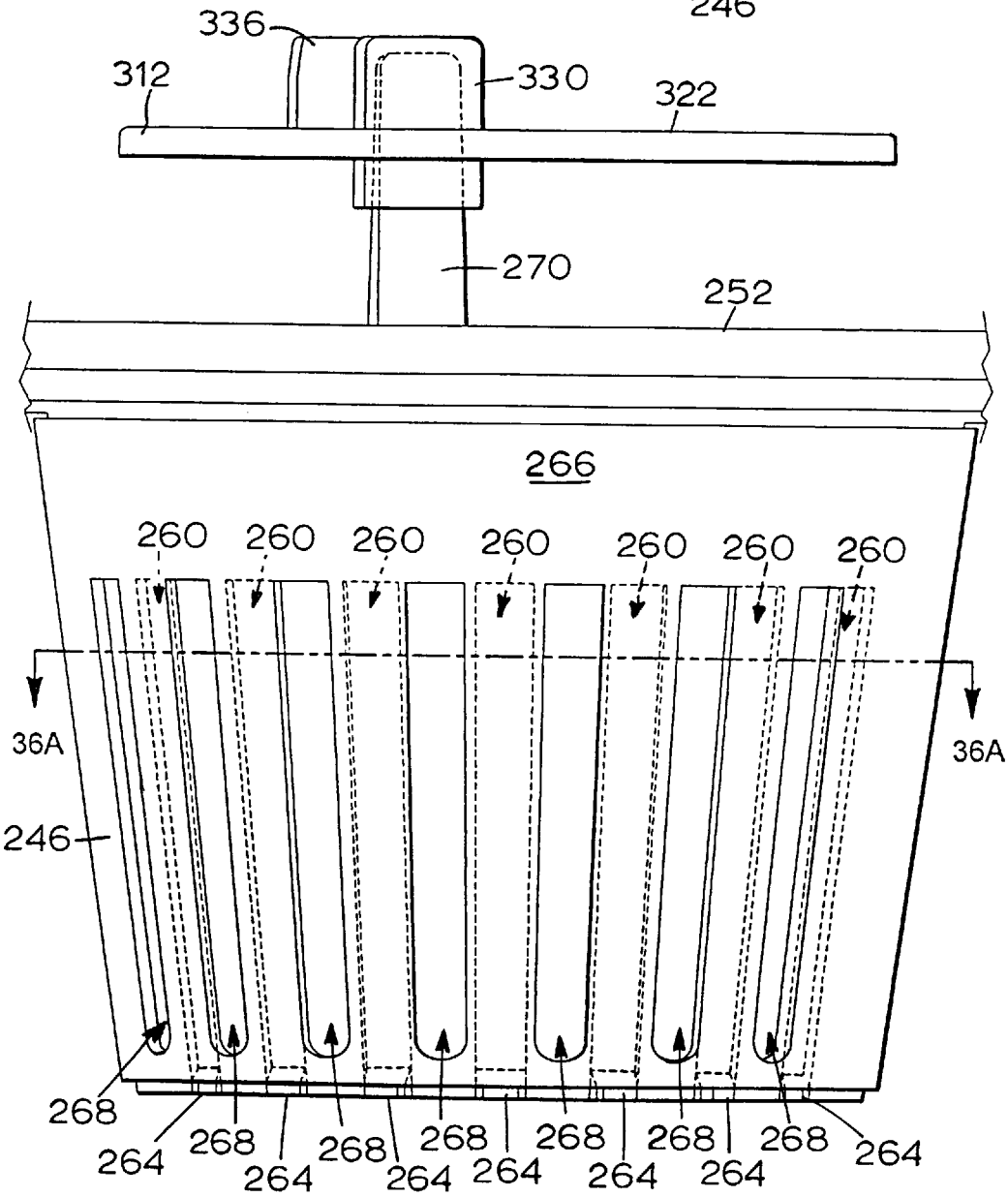
FIG. 36

SELF-EVACUATING VACUUM CLEANER

CROSS REFERENCE TO RELATED APPLICATIONS

The present application is a continuation-in-part of U.S. Ser. No. 08/784,248, filed Jan. 15, 1997, now abandoned; which is a continuation-in-part of U.S. patent application Ser. No. 08/756,165, filed Nov. 25, 1996; which is a continuation-in-part of U.S. patent application Ser. No. 08/727,318, filed Oct. 8, 1996; which is a continuation-in-part of U.S. patent application Ser. No. 08/678,997, filed Jul. 12, 1996, and now U.S. Pat. No. 5,850,668, issued Dec. 22, 1998.

FIELD OF THE INVENTION

The present invention relates to vacuum cleaners, and more particularly to wet/dry vacuum cleaners where liquid material in the tank of the vacuum cleaner is pumped out to waste.

BACKGROUND ART

Tank-type vacuum cleaners are capable of receiving dry materials such as debris or dirt and may also be used for suctioning liquids. When the tank is full, an upper vacuum assembly (which often includes a motor and an air impeller) is removed and the contents are dumped out. If the vacuum cleaner is used on liquid material, the tank, when at or near capacity, may be very heavy so that lifting the tank, to pour the contents into a sink or the like, is difficult. Even tilting the tank to pour the contents into a floor drain may be unwieldy when the liquid level in the tank is high.

One solution to the difficulties encountered in emptying liquid from vacuum tanks has been to provide an outlet at the bottom of the tank. Such a solution is satisfactory when the contents of the tank are emptied into a floor drain; however, if no floor or other low-placed drain is available the tank must be lifted to a sink or similar disposal site. In such cases the outlet at the bottom of the tank is of little value.

A second solution to emptying a vacuum tank of liquid is to provide a pump, usually with a motor located outside of or in the bottom of the tank. The pump removes liquid through a lower portion of the tank and expels it through a hose to waste. While such pumps are generally effective, they may be very costly. The pump requires not only a pump impeller and hoses but also its own electric motor, power cords, and switches. The expense of such items may be significant in the context of the overall cost of a vacuum cleaner, particularly those designed for residential use. Such pumps may also reduce the effective capacity of the vacuum tank or interfere with operation when the vacuum cleaner is used on dry materials. In addition, it may also be necessary to provide costly or complicated structures to prime the pump, if it is not located in the bottom of the tank.

SUMMARY OF THE INVENTION

In accordance with one aspect of the present invention, a vacuum cleaner has a tank with a first inlet for receiving liquid material. A powered pump defines an aperture which places the interior of the pump in air flow communication with the interior of the tank. A second inlet is disposed within the tank and is in fluid communication with the interior of the pump, placing the second inlet in air flow communication with the interior of the tank as well. An air impeller assembly includes a housing and a driven impeller and is disposed in air flow communication with the interior of the tank. The air impeller is disposed within the air impeller housing, and the air impeller housing defines an opening which places the air impeller in air flow communication with the interior of the tank and creates a relatively low pressure area in the interior of the tank. The relatively low pressure area in the interior of the tank, by way of communication, creates relative low pressure areas in the interior of the pump and the second inlet. A priming apparatus, which has a source of pressure which is high relative to the relatively low pressure in the interior of the tank, is disposed within the tank and is in fluid communication with the second inlet. When the liquid material received by the tank reaches the level of the second inlet, the pump becomes primed. Priming occurs due to the source of relatively high pressure acting in concert with the relatively low pressure in the second inlet to establish a pressure differential across the second inlet.

The vacuum cleaner of the present invention may include a means for selectively actuating the source of relatively high pressure to establish the pressure differential across the second inlet. The selective actuating means may be a valve coupled to the priming apparatus.

The priming apparatus of the present invention may include a main body having a top wall wherein a hole is disposed in the top wall, and the priming apparatus may further include a ball disposed in the main body which is engageable with the hole. The priming apparatus may, alternatively, include a main body having a bottom wall wherein a hole is disposed in the bottom wall, and the priming apparatus may further include a ball disposed in the main body which is engageable with the hole. The vacuum cleaner of the present invention may also have an outlet which is in communication with the pump and discharges the liquid material received by the tank. The priming apparatus may have a main body in which the second inlet is disposed, a conduit in fluid communication with the outlet and the main body and a selectively actuable valve disposed within the conduit between the outlet and the main body.

The valve disposed within the conduit between the outlet and the main body may include an air inlet in fluid communication with the conduit. The valve may also be movable among three positions. In a first position, the valve blocks the outlet from communicating with the conduit. In a second position, the valve allows the outlet to communicate with the pump and the conduit and allows the air inlet to communicate with the conduit. In a third position, the valve allows the outlet to communicate with the pump and the conduit and blocks the air inlet from communicating with the conduit.

The pump may be disposed adjacent to the air impeller assembly, and the pump may include an upper pump assembly and a pump adapter assembly. The upper pump assembly includes a pump impeller and a pump impeller housing with the impeller disposed in the housing. The pump adapter assembly includes the priming apparatus and the pump adapter assembly is removably attached to the upper pump assembly.

Other features and advantages are inherent in the vacuum cleaner claimed and disclosed or will become apparent to those skilled in the art from the following detailed description in conjunction with the accompanying drawings.

BRIEF DESCRIPTION OF THE DRAWINGS

FIG. 20 is a partial view, partially in section, of the actuator mechanism, the toggle member, and the switch of the mechanical shut-off and bypass assembly in an "ON" position;

FIG. 21 is a partial view, partially in section, of the actuator mechanism, the toggle member, and the switch transitioning from the "ON" to an "OFF" position;

FIG. 22 is a partial view, partially in section, of the actuator mechanism, the toggle member, and the switch in the "OFF" position;

FIG. 23 is a partial view, partially in section, of the actuator mechanism, the toggle member, and the switch transitioning from the "OFF" to the "ON" position;

FIG. 32A is an enlarged view of the pump and pump housing of FIG. 32;

FIG. 35 is a side elevational view of a plenum and the baffle, with the baffle lever in an open position;

FIG. 35A is a sectional view along the line 35A—35A in FIG. 35;

FIG. 36 is a side elevational view of the plenum and the baffle, with the baffle lever in a closed position;

FIG. 36A is a sectional view along the line 36A—36A in FIG. 36;

DESCRIPTION OF THE PREFERRED EMBODIMENT(S)

Figure 1:
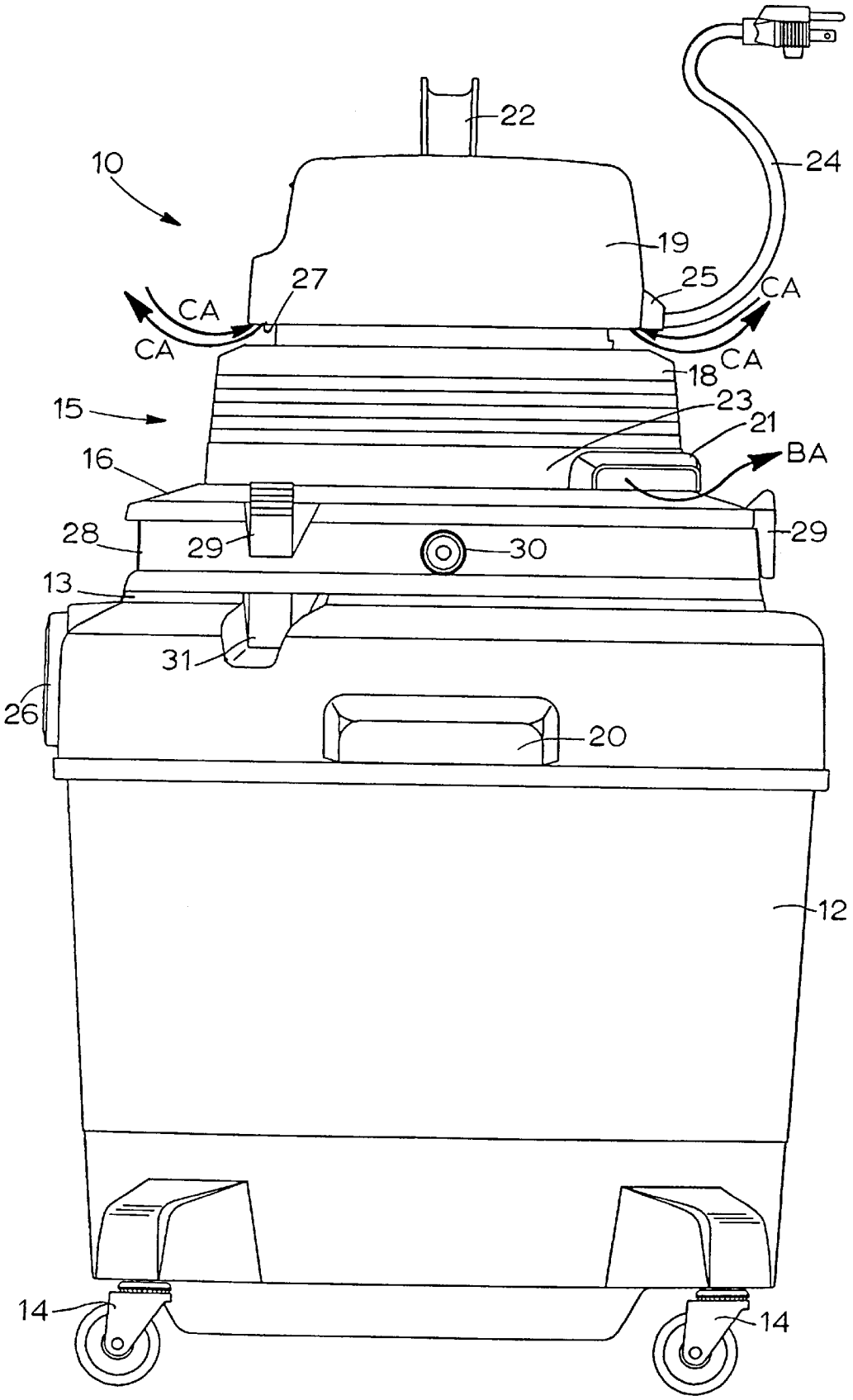
FIG. 1 is a side elevational view of a vacuum cleaner of the present invention.

Referring initially to FIG. 1, a vacuum cleaner of the present invention, indicated generally at 10, has a tank 12 supported by casters 14. The tank 12 further includes a pair of handles 20 (FIGS. 1 and 3), an inlet 26, and an upper rim 13. The handles 20 may be used to assist the user in lifting and moving the vacuum cleaner 10. The inlet 26 may be fitted with a vacuum hose (not depicted) for applying suction at desired locations.

Figure 3:
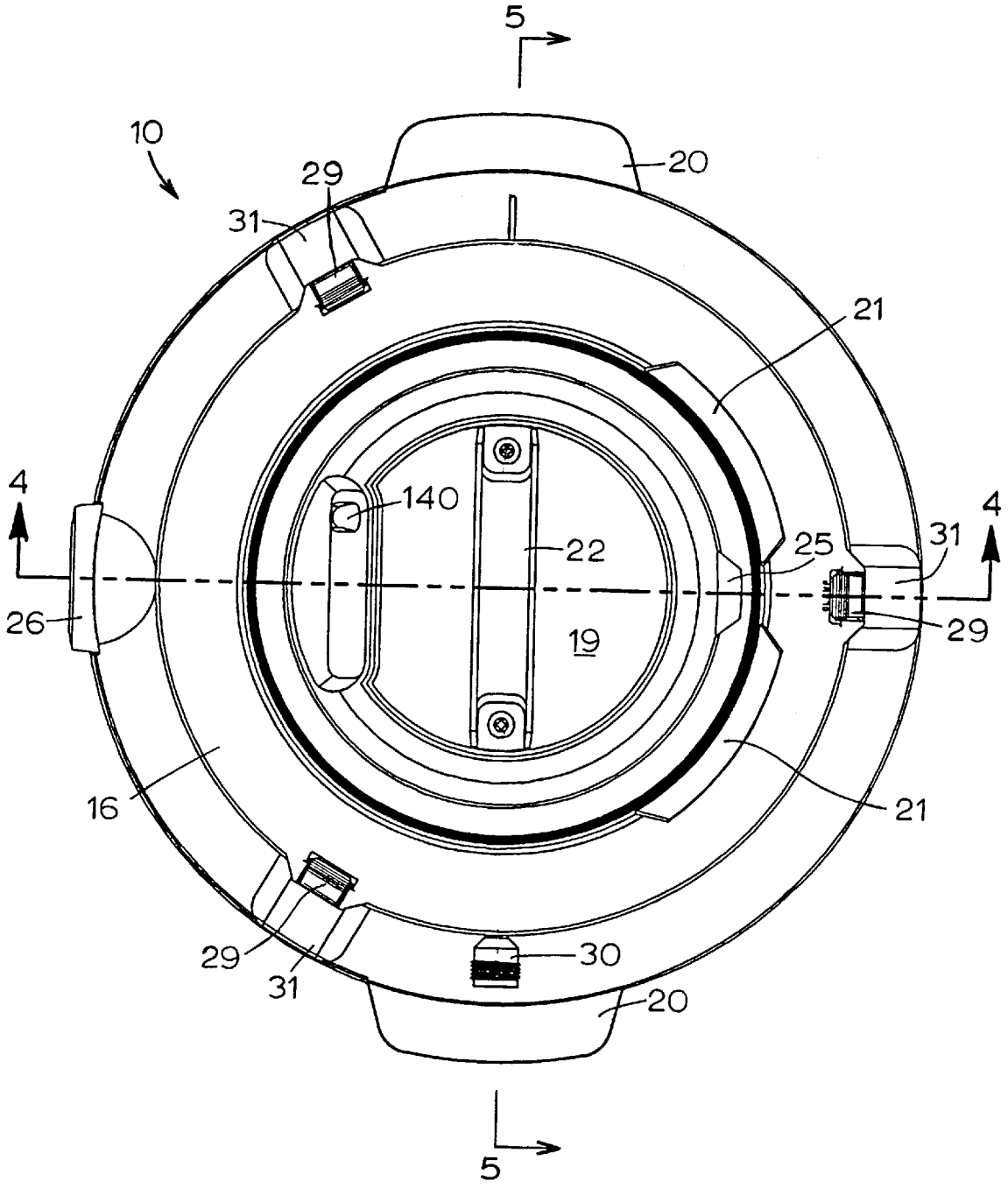
FIG. 3 is a top plan view of a vacuum cleaner of the present invention.

The tank 12 supports a removable tank extension 28. The tank extension 28 engages the upper rim 13 of the tank 12 and is disposed within the tank 12. The tank extension 28, in turn, supports an upper vacuum assembly, indicated generally at 15. The upper vacuum assembly 15 includes a lid 16, a motor housing 18, a cover 19, and a handle 22. The lid 16 is disposed above the tank extension 28 and may be attached to the tank extension 28 by one or more latches 29 which are carried by the lid 16. The latches 29 fit into tank recesses 31 when the tank extension 28 is removed. The motor housing 18 is disposed above the lid 16 and is connected to the lid 16. The motor housing 18 defines a pair of blower air discharge slots 21 (FIGS. 1 and 3). The blower air discharge slots 21 are disposed along a lower portion 23 of the motor housing 18. Air drawn into the vacuum cleaner 10 by the inlet 26 is expelled through the blower air discharge slots 21 as shown by the arrow BA in FIG. 1. The cover 19 may be formed as two separate, detachable pieces or as one piece, integral with one another. The cover 19 includes an electric cord attachment 25. The electric cord attachment 25 connects the cover 19 to an electric cord 24 which provides power to the vacuum cleaner 10. The motor housing 18 and the cover 19 further define a cooling air opening 27. The cooling air opening 27 allows air to enter and exit under the cover 19, as shown by the arrows CA in FIG. 1. The air entering and exiting under the cover 19 circulates downward and cools a motor (not depicted) disposed within the motor housing 18. The handle 22 is disposed above the cover 19 and is connected to the cover 19.

Figure 2:
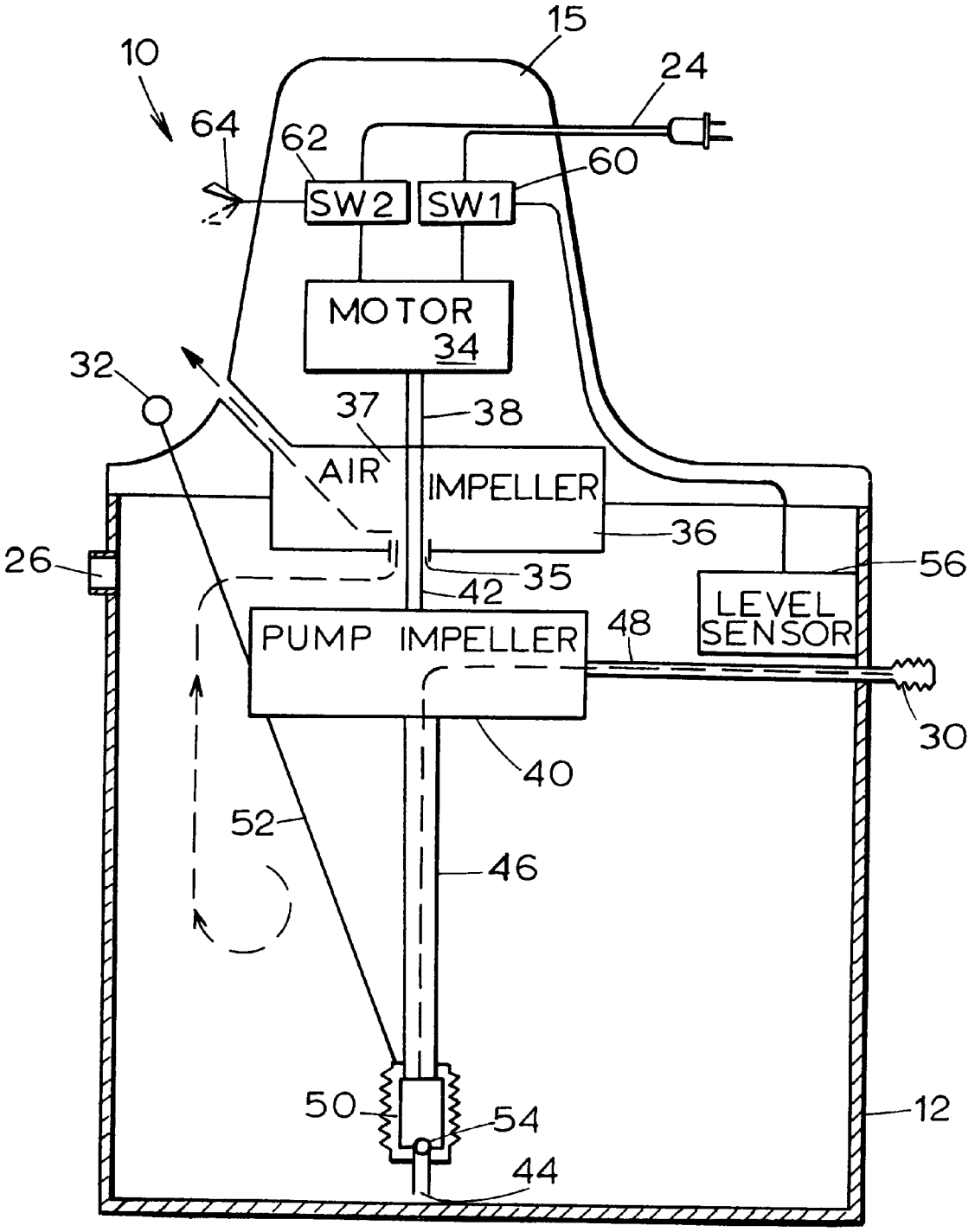
FIG. 2 is a diagrammatic view of a vacuum cleaner of the present invention.

FIG. 2 is a diagram showing the overall electrical and mechanical operation of the vacuum cleaner 10. A motor 34 drives an air impeller 36 via a shaft 38. The air impeller 36 draws air through an opening 35 in an air impeller housing 37 from the tank 12, which in turn draws air and other material through the inlet 26. Air may be expelled directly from the air impeller 36 through the upper vacuum assembly 15, or may pass through or over the motor 34 to provide cooling.

A pump impeller 40 is driven by a shaft 42 which passes through the opening 35 in the air impeller housing 37. The shaft 38 may be integral with the shaft 42 so that a unitary structure drives both the air impeller 36 and the pump impeller 40. Alternatively the shaft 42 may be separate from the shaft 38, in which case the shafts are preferably essentially collinear. As yet another alternative, the shaft 38 and the shaft 42 may not be collinear but may instead transfer torque from the motor 34 through the shaft 38 to the shaft 42 and pump impeller 40 via a transmission or gears.

The pump impeller 40 is not self-priming. A user has to prime the pump impeller 40 in order to pump liquid material out of the tank 12. This feature provides a significant advantage to the user. With a priming system, the pump only operates when the user is ready to discharge the liquid material collected in the tank 12. In other words, with the present invention, the user can vacuum up liquid material at a first location lacking a drainage source, stop vacuuming, then move the vacuum cleaner 10 to a second location having a drainage source, prime the pump impeller 40 and begin pumping out the liquid material collected in the tank 12.

In a first embodiment, priming is manually accomplished by compressing a bellows 50 using the priming handle 32 and a priming rod 52. When liquid material enters the tank 12 it collects in the bottom of the tank 12 and enters the bellows 50 through a pump inlet 44. When there is a sufficient level of liquid material in the bellows 50 and the user is ready to begin pumping liquid material out of the tank 12, the user pulls on the priming handle 32 to compress the bellows 50. A check valve 54 adjacent the pump inlet 44 permits liquid to enter the bellows 50 through the pump inlet 44 but resists flow of material from the bellows 50 out through the pump inlet 44. Therefore, compression of the bellows 50 forces liquid material up through an inlet tube 46 to the pump impeller 40. When the liquid material reaches the pump impeller 40, the pump is primed. Once primed, the rotation of the pump impeller 40 draws liquid into the pump inlet 44 and through the inlet tube 46. Liquid material reaching the pump impeller 40 is discharged through an outlet tube 48 to a pump outlet 30. A hose (not depicted) may be attached to the pump outlet 30 so that liquid material removed from the tank 12 can be directed to a drain or a sink. As noted in greater detail hereinafter, the priming method just described is only one of a number of ways envisioned to prime the pump. The present invention may be practiced with any pump priming system.

At times, the tank 12 will become overfilled with liquid material. A level sensor 56 may therefore be provided to detect when the level of liquid in the tank 12 is at or above a specified level. When the level sensor 56 detects liquid at or above the specified level it sends a signal to a switch 60. The switch 60, upon receiving the signal, interrupts current flowing through the electric cord 24 to the motor 34. The motor 34 and air impeller 36 thereby cease operating so that no additional liquid material enters the tank 12.

Interruption of power to the motor 34 and the air impeller 36 will also prevent the pump impeller 40 from operating if the pump impeller 40 was in operation. Under such a condition, liquid material previously collected in the tank 12 will not be removed. A switch 62 with a depressible actuator 64 is therefore provided to allow a user to override the interruption in power caused by activation of the level sensor 56. The depressible actuator 64 is biased to the "OFF" position and must be maintained in the depressed position in order for the switch 62 to provide electric power to the motor 34. While the user depresses the depressible actuator 64, the user is aware that the tank 12 is full and that the user should avoid further suctioning of additional liquid material into the tank 12 through the inlet 26. As the motor 34 continues to operate, the pump impeller 40 will also continue to operate. Continued operation of the pump impeller 40 will empty the tank to a level below the specified level for the level sensor 56 so that the switch 60 thereafter permits flow of electric power to the motor 34 without the need to depress the depressible actuator 64. A second level sensor (not depicted) may be placed at a level higher than the specified level which prevents the interruption in power from being overridden. Thus, if the user holds down the toggle while allowing additional liquid material to enter the tank 12, the second sensor will disable the motor 34 and prevent the tank 12 from overfilling. Numerous types of level sensors 56 may be used, including float sensors, proximity sensors, optical sensors, pairs of electrodes which pass current to each other through liquid in the tank when the liquid is at a sufficient height, etc.

Instead of the level sensor 56 and depressible actuator 64 shown in FIG. 2, two level sensors could be provided (not depicted). In such a system the first, lower sensor activates a light or alarm to warn the user that the tank 12 is almost full. When so notified, the user ceases suctioning additional material into the tank until the level of liquid material in the tank is lowered. If the user fails to heed the warning and the liquid level in the tank continues to rise, the second level sensor interrupts power to the motor 34.

Figure 4:
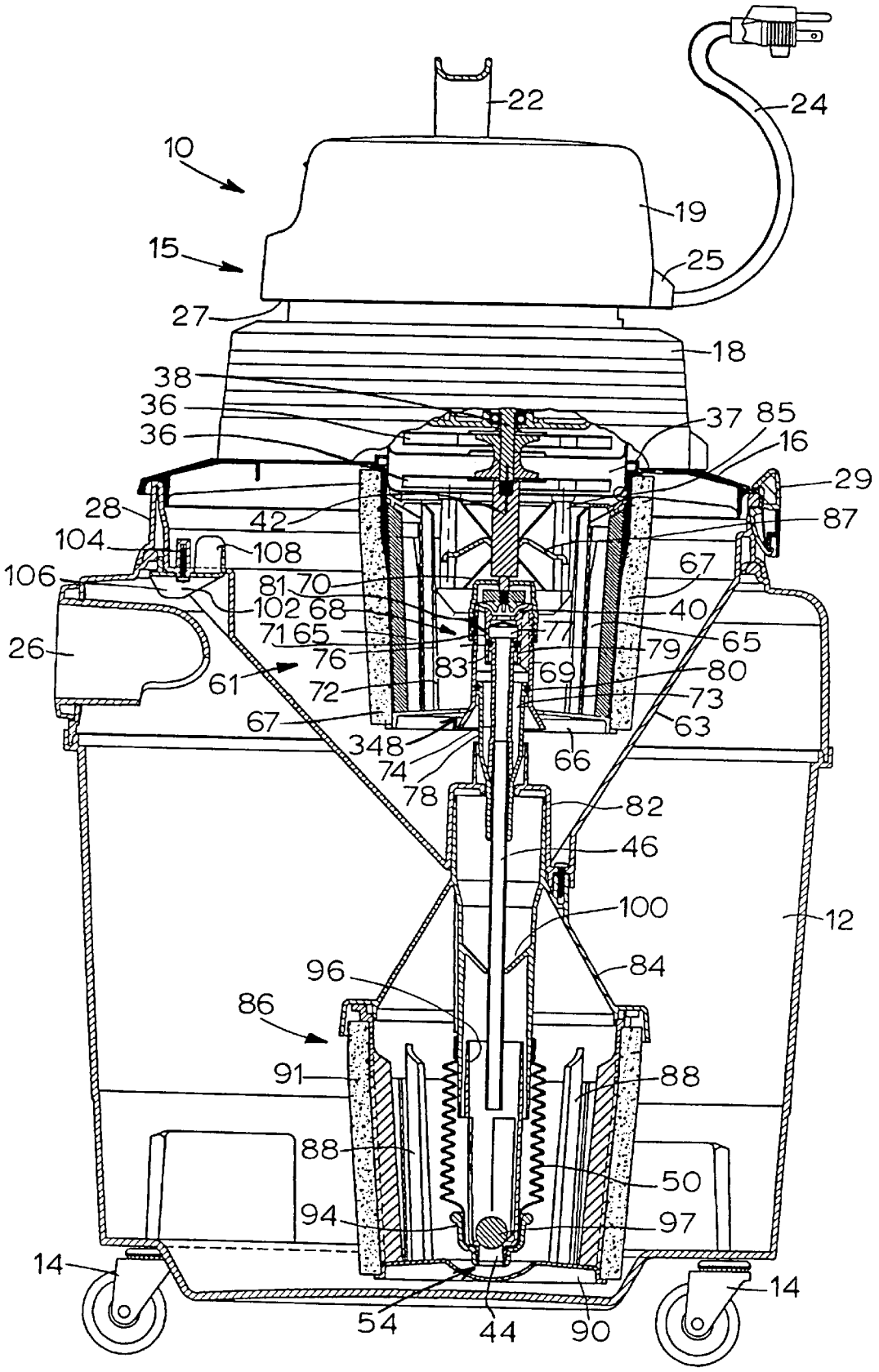
FIG. 4 is a side elevational view, partially in section along the line 4—4 in FIG. 3.
Figure 5:
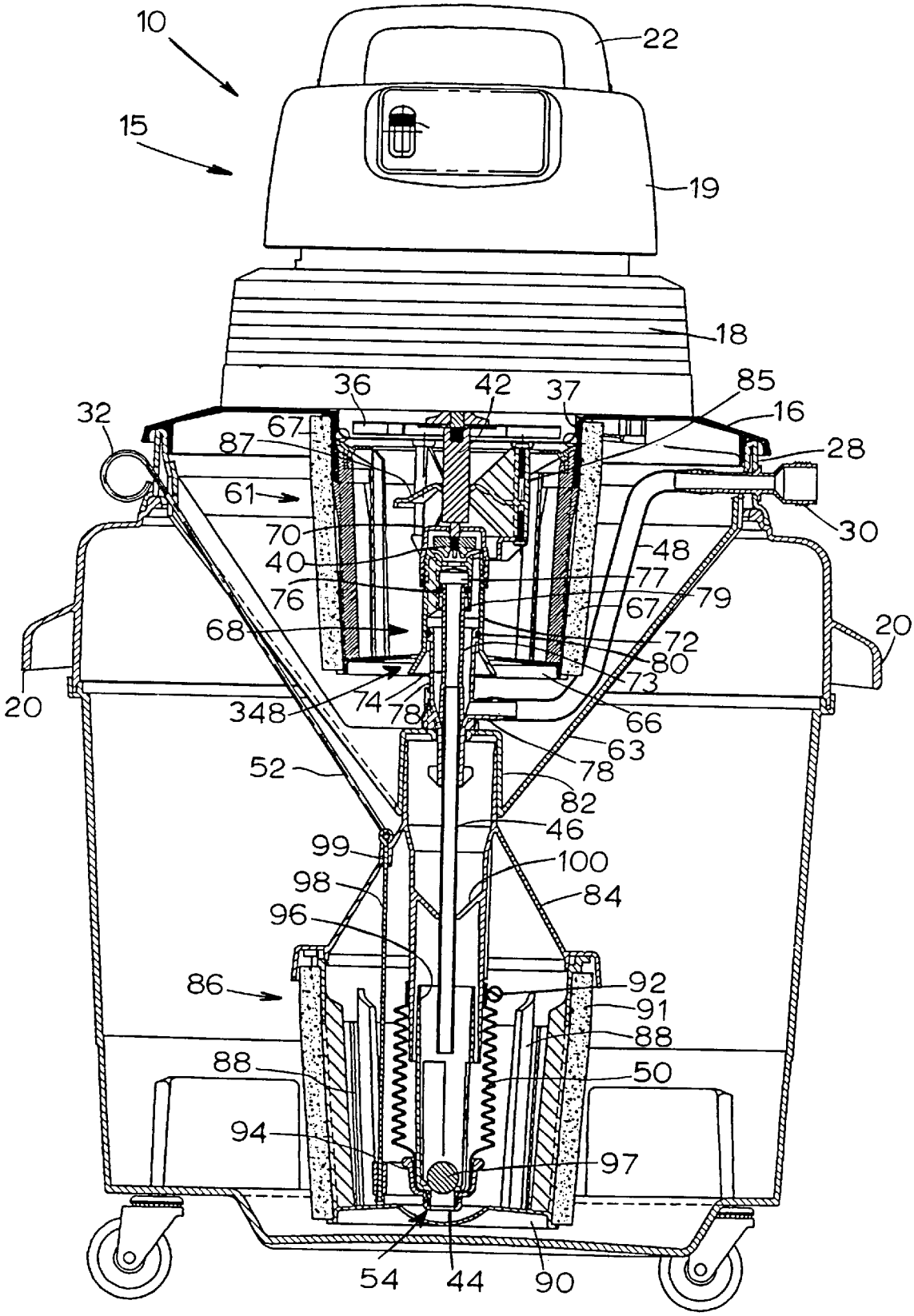
FIG. 5 is a front elevational view, partially in section, along the line 5—5 in FIG. 3.

FIGS. 4 and 5 depict the internal structure of an embodiment of the vacuum cleaner 10. The motor (not depicted) drives two air impellers 36 mounted in an air impeller housing 37 via the first axle 38. If desired, the vacuum cleaner 10 may alternatively have only a single air impeller. The air impellers 36 draw air through a lid cage indicated generally at 61, which in turn draws air through a depending portion 63 of the tank extension 28. The depending portion 63 defines several holes or slots (not depicted) which permit air flow to the air impellers 36. The lid cage 61 has several braces 65 supporting a plate 66 and surrounded by a foam filter 67. The upper vacuum assembly 15, which carries the cage 61, impellers 36, and motor, may be of conventional construction. Except for the pump and shut-off switches discussed below, the upper vacuum assembly 15 and its associated components may be identical to a Shop Vac Model QL20TS vacuum cleaner as manufactured by Shop Vac Corporation of Williamsport, Pa.

A pump indicated generally at 68 includes the pump impeller 40, which is mounted between an upper impeller housing 70 and a lower impeller housing 72. The lower impeller housing 72 is inserted through an aperture 348 and includes an outer chamber wall 69 and an inner chamber wall 71, best seen in FIG. 8. The outer chamber wall 69 defines one portion of a discharge recess 73 and the inner chamber wall 71 defines an inner chamber 75. An inlet tube 74 is telescoped within the inner chamber 75. The inlet tube 74 includes a seal 76 which is disposed between the inlet tube 74 and the inner chamber wall 71. The seal 76 divides the inner chamber 75 into an upper priming chamber 77 and a lower chamber 79. The lower chamber 79 is in communication with the discharge recess 73. The inlet tube 74 is secured by any suitable means to the inlet tube 46. A pump outlet fitting 78 is telescoped within the housing 72. The pump outlet fitting 78 includes a seal 80 which is disposed between the pump outlet fitting 78 and the housing 72. The pump outlet fitting 78 defines the other portion of the discharge recess 73.

The pump impeller 40 draws liquid through the inlet tubes 46 and 74 into the upper priming chamber 77, and finally into the discharge recess 73. The liquid in the discharge recess 73 surrounds the tubes 46 and 74. The liquid then passes from the discharge recess 73 through the pump outlet fitting 78, into an outlet tube 48, and out of the tank 12 through the pump outlet 30 (FIG. 5). The seal 80 prevents liquid from escaping past the interface between the housing 72 and the pump outlet fitting 78.

When the discharge recess 73 is full with liquid, the seal 76 is surrounded by liquid. The liquid in the upper priming chamber 77 over chamber 79 contacts a bottom surface 83 of the seal 76. Consequently, when the pump 68 is in operation, the seal 76 is surrounded by liquid on the top and bottom surfaces 81, 83. Surrounding the seal 76 with liquid is a significant advantage of the present invention. By surrounding the seal 76 with liquid, the pump 68 will not lose its prime.

In the design of other pumps, one side of a seal, equivalent to the seal 76, is in contact with air only and not liquid. In these other designs, if the seal deteriorates, the pump will lose its prime because the liquid will leak from the upper priming chamber to the air-filled lower chamber thereby allowing air to enter the upper priming chamber. Consequently, the pump, in other designs, will not function under this condition. In the present invention, however, if the seal 76 deteriorates, the pump will not lose its prime and the pump 68 will continue to function. This is because both the upper priming chamber 77 and the lower priming chamber 79 are filled with liquid, and hence there is no opportunity for air to enter the upper priming chamber even when the seal deteriorates. Granted, in the present invention, the pump 68 will operate less efficiently if the seal 76 begins to deteriorate and liquid starts to leak from the upper priming chamber 77 to the lower chamber 79, but the pump 68 does not stop functioning.

The lower impeller housing 72 is attached to the upper impeller housing 70, which is in turn attached to a pump mount 85. The pump mount 85 is attached to the air impeller housing 37. The pump mount 85 also carries a water deflector 87, which inhibits water from passing into the air impellers 36. Ordinary pumps have a seal where the shaft 42 passes through the upper impeller housing 70. The pump 68 has no such seal because seals often require cooling fluid and the pump impeller 40 may rotate without any fluid in the upper impeller housing 70. A small amount of liquid will therefore pass out of the upper impeller housing 70 around the shaft 42. The water deflector 87 will direct the liquid back into the tank 12.

The pump outlet fitting 78 is mounted to an inverted cup 82 on the tank extension 28. The tank extension 28 carries an intake support 84 and a lower cage indicated generally at 86 having brackets 88 and a plate 90. The lower cage 86 may be surrounded by a foam filter 91 to prevent large particles suspended in liquid in the tank 12 from entering the pump inlet 44. The lower cage 86 also houses the priming mechanism for the pump 68, including the bellows 50, which is secured to the intake support 84 by a hose clamp 92 (FIG. 5). The lower end of the bellows 50 is captured between a bracket 94 and a cup 96. The bellows 50, bracket 94, and the cup 96 each have an opening to allow liquid material in the tank 12 to enter into the cup 96. A ball 97 seats in the cup 96 to form the check valve 54 which prevents liquid material in the cup 96 from flowing out of the cup 96 through outlet 44. A priming rod 98 (FIGS. 5 and 6) extends through a hole 99 in the intake support 84 and is attached to the priming rod 52 and to a bracket extension 94 so that upward movement of handle 32 from tank extension 28 lifts the bracket 94 and the cup 96 to compress the bellows 50.

Figure 6:
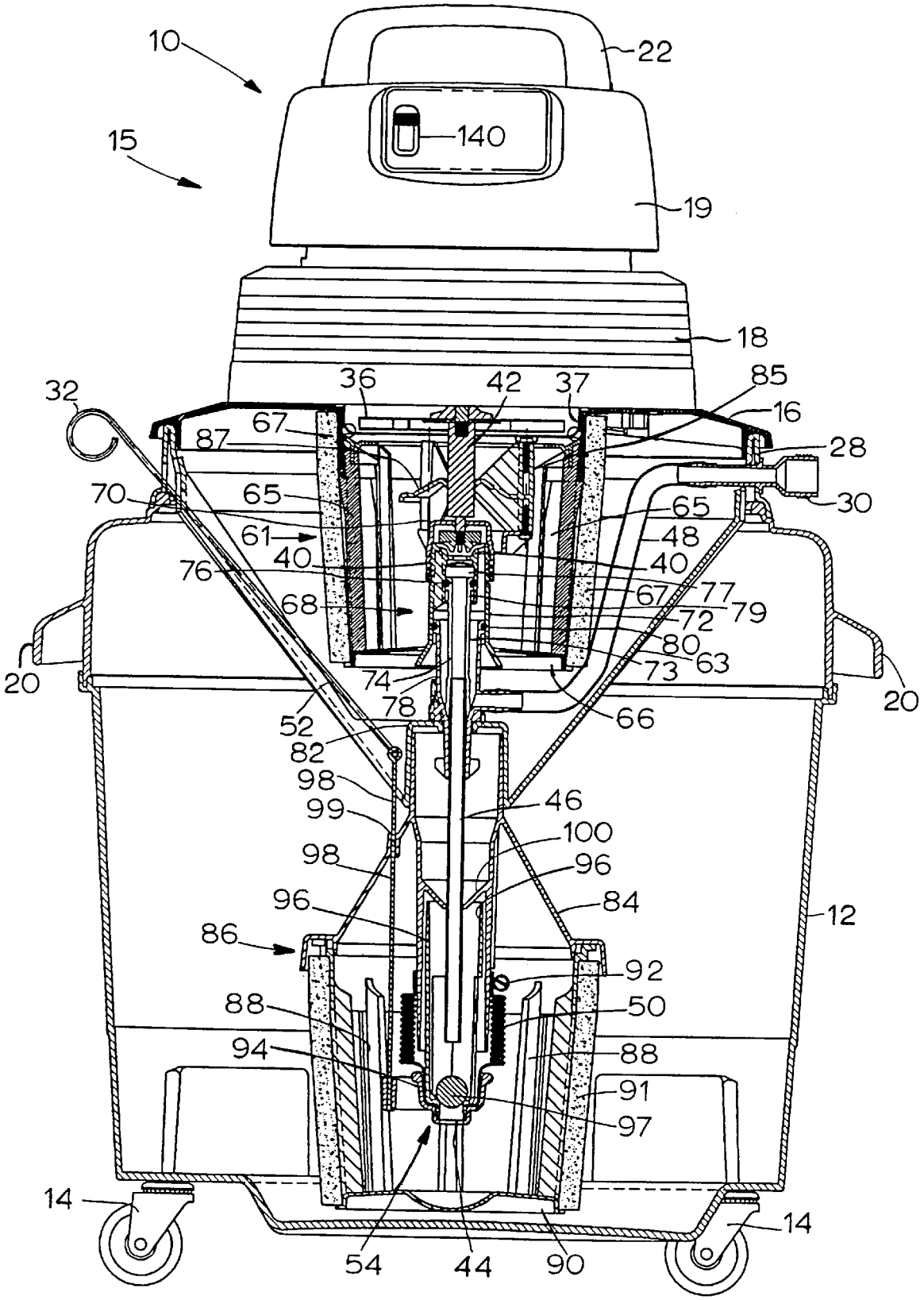
FIG. 6 is a view similar to FIG. 5 showing the pump of the vacuum cleaner being primed.

FIG. 6 depicts the cup 96 in its upper position. The cup 96 is moved upward by a user pulling the priming handle 32, thereby lifting the priming rods 52 and 98 and the bracket 94. In moving from the position of FIG. 5 to the position of FIG. 6, liquid in the cup 96 and the bellows 50 is forced up into inlet tube 46 and eventually to the pump impeller 40. A seal 100 in the intake support 84 prevents liquid and/or air in the support 84 from being pushed farther up into intake support 84 to force liquid in the cup 96 into inlet tube 46. The bellows 50 compresses when the cup 96 is in its upper position and also prevents liquid in the cup 96 from leaking back into the tank 12.

Figure 7:
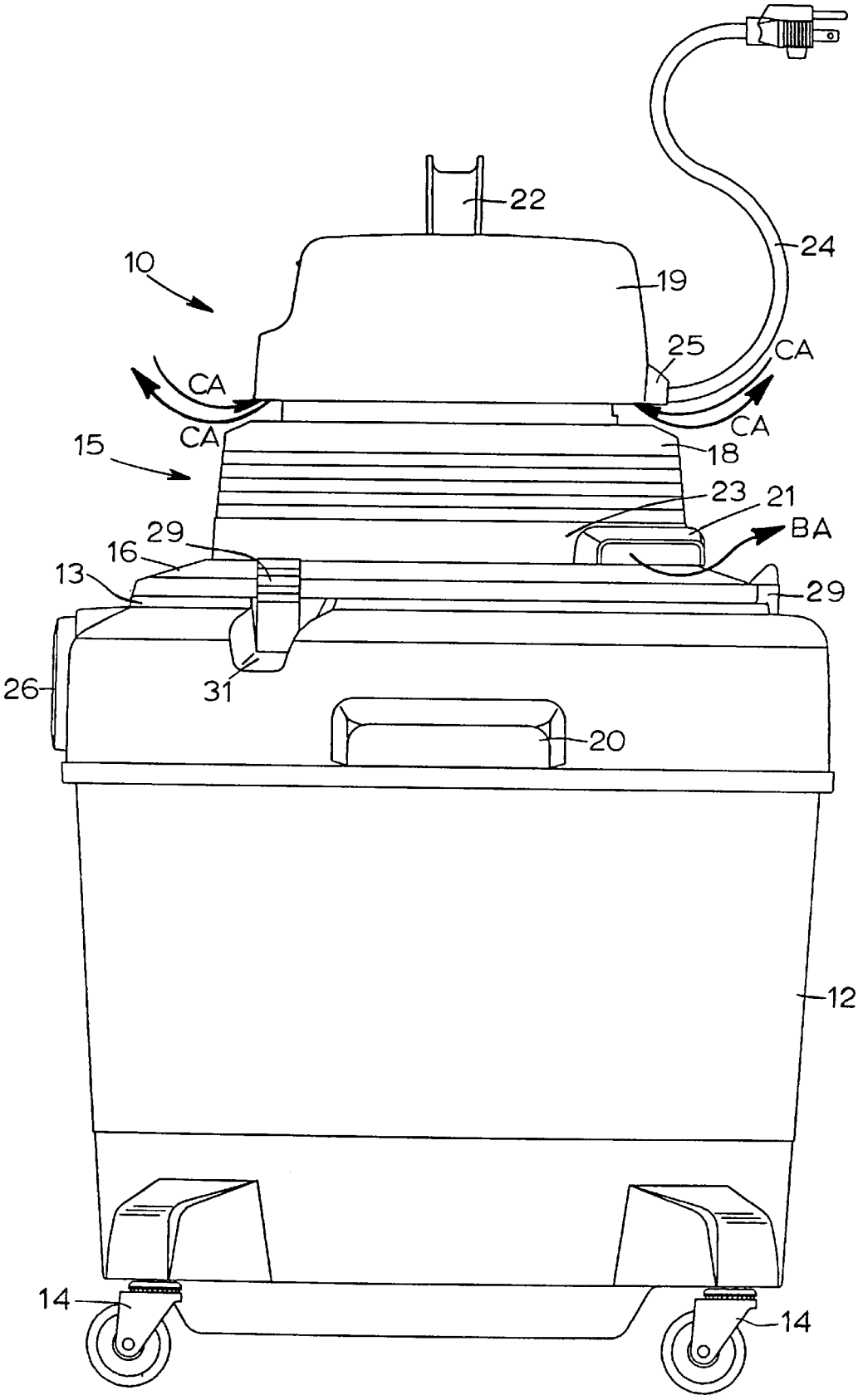
FIG. 7 is a side elevational view of a vacuum cleaner of the present invention with a tank extension removed.
Figure 8:
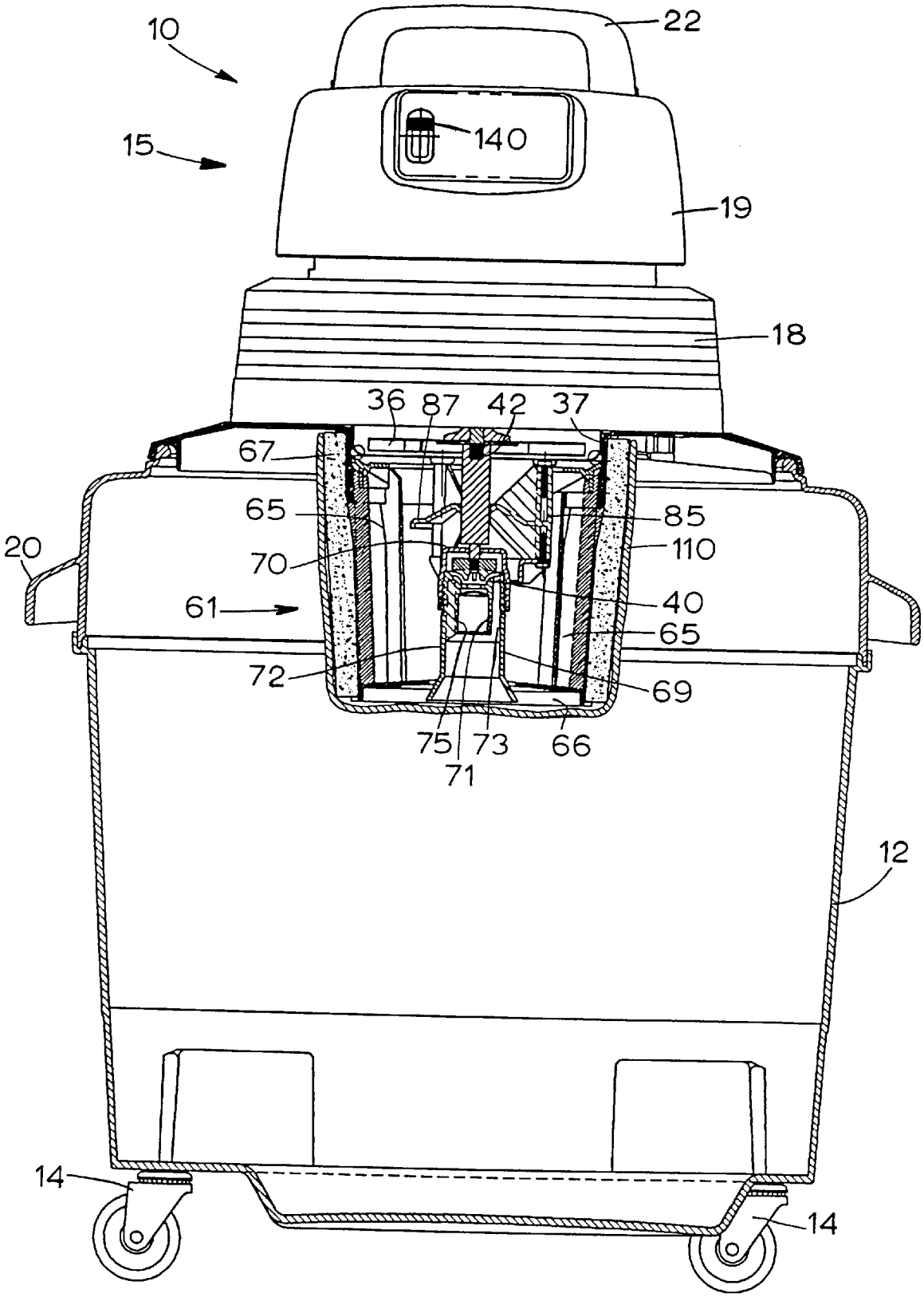
FIG. 8 is a view similar to FIG. 5 of the vacuum cleaner of FIG. 7.

FIGS. 7 and 8 depict the vacuum cleaner with the tank extension 28 (FIGS. 1 and 4–6) and its associated components removed from between the tank 12 and the upper vacuum assembly 15. By removing the tank extension 28 and the entire inlet assembly for the pump 68, the vacuum cleaner 10 is readily usable for suctioning dry material. With the tank extension 28 and its associated components removed, there is additional capacity for vacuuming dry material. Further, the removed pump inlet components will not be clogged with dry material when later used to expel liquid material from the tank 12. In addition, the openings through the tank extension 28 for the priming rod 52 and pump outlet 30, which might otherwise allow air to leak into the tank 12, are not present when the vacuum cleaner 10 is used on dry material. Thus, removability of the tank extension 28 may also increase the suctioning ability of the vacuum cleaner 10 when used on dry material.

The vacuum cleaner 10 can be used to vacuum wet or dry material with the tank extension 28 either in place or removed. With the tank extension in place (FIGS. 1–6), the vacuum cleaner 10 is advantageously configured for suctioning liquid material since that material can be readily removed from the tank 12. Similarly, with the tank extension 28 removed (FIGS. 7 and 8), the vacuum cleaner 10 is advantageously configured for suctioning dry material.

Referring once again to FIG. 4, the tank extension 28 has a latch or latches, indicated generally at 102, each of which is held to the tank extension 28 by a screw 104. Each of the latches 102 has a locking arm 106 which engages an edge of the tank 12 to hold the tank extension 28 to the tank. A tab 108 on the latch 102 is accessible to a user when the lid 16 has been removed from the tank 12 and tank extension 28 by unlocking the latches 29. Rotation of the tab 108 about the screw 104 releases the tank extension 28 from the tank 12.

As can be seen by comparing FIG. 4 with FIG. 8, removal of the lid 16 from the tank extension 28 divides the pump 68 into an upper pump assembly and a lower pump assembly. The upper pump assembly includes the upper impeller housing 70, the lower impeller housing 72, the pump impeller 40, and their associated components. The lower pump assembly includes the inlet tube 74, pump outlet fitting 78, the inlet tube 46, outlet tube 48 (FIG. 5), and their associated components. All components of the upper pump assembly are attached to and, during normal operation by a user, remain with the upper vacuum assembly 15. All components of the lower pump assembly are attached to and, during normal operation by a user, remain with the tank extension 28. Therefore, when the upper vacuum assembly 15 is separated from the tank extension 28, the upper pump assembly separates from the lower pump assembly at the seals 76 and 80. The lower portion of the lower impeller housing 72 is flared to facilitate insertion of the lower pump assembly into the upper pump assembly upon reconfiguration of the vacuum cleaner 10 for removal of liquid material from the tank 12. The flared end of the lower impeller housing 72 aligns the seals 76 and 80 to provide the proper relationship of the components of the pump 68.

As seen in FIG. 8, once the tank extension 28 and its associated lower pump assembly are removed from the lid cage 61, a particulate filter 110 may be placed over the lid cage 61. The particulate filter 110 covers the plate 66 and the opening in the plate 66 through which the lower impeller housing 72 extends.

Figure 9:
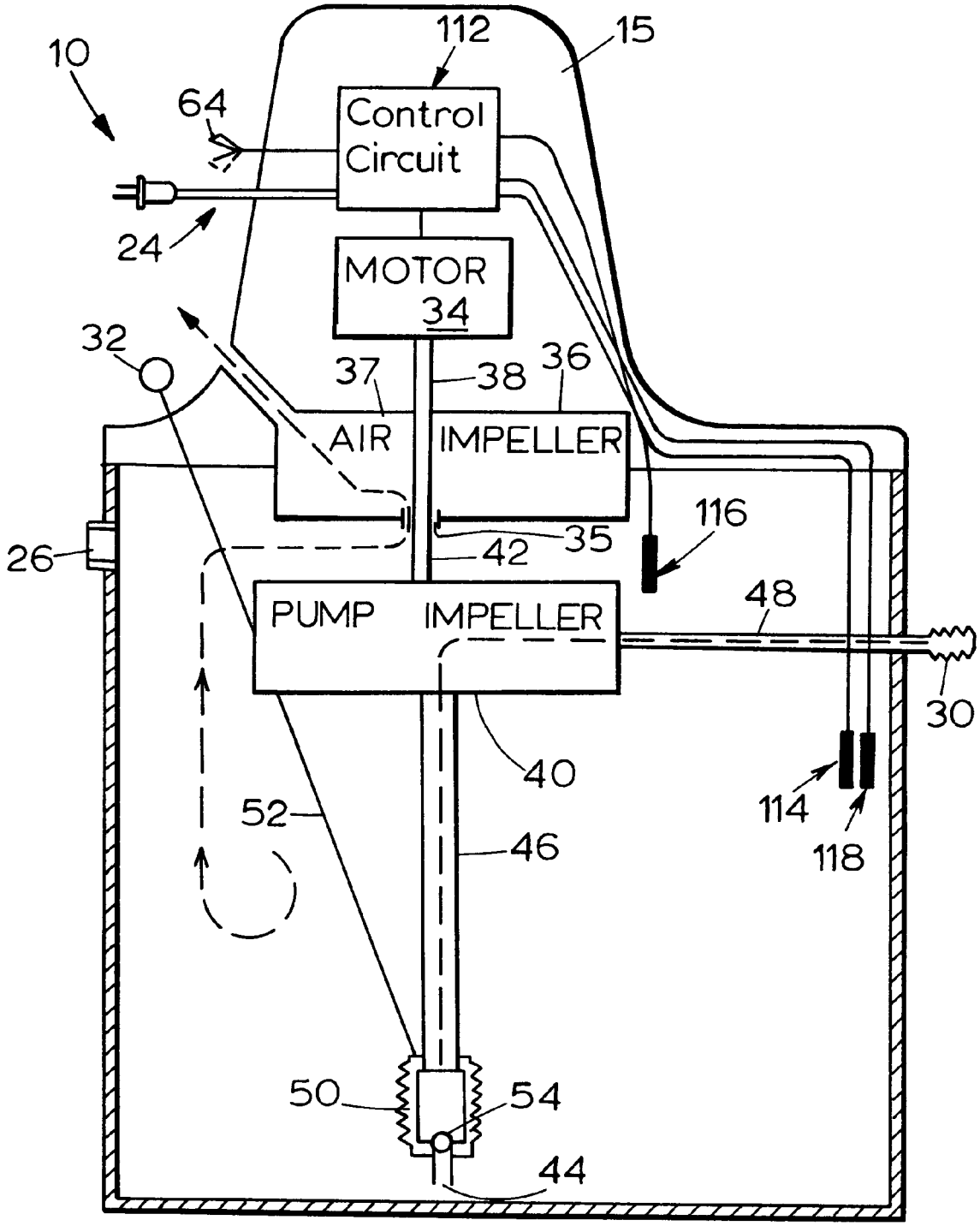
FIG. 9 is a diagrammatic view of the vacuum cleaner of the present invention configured with electrode level sensors.

FIG. 9 illustrates an embodiment of the present invention where the level sensors are electrodes. A control circuit 112 enables and disables the motor 34 based on the level of the liquid in the tank 12. The control circuit 112 also includes the depressible actuator 64 that opens and closes a switch internal to the control circuit, an electrode 114, and a further electrode 116, all of which are shown external to the control circuit 112 in FIG. 9 for clarity.

When the liquid level in the tank 12 is below the electrode 114, the control circuit 112 enables the motor 34 and the vacuum operates in normal vacuuming/pumping mode. As the user vacuums, liquid enters the tank 12 through the inlet 26 and if the pump impeller 40 is in operation, is pumped out of the tank 12 through the pump outlet 30. In the preferred embodiment, a potential-setting electrode 118 is disposed at the same particular liquid level height as the electrode 114. When the liquid level in the tank 12 reaches the potential-setting electrode 118 and the electrode 114, a conductive path is formed through the liquid between the two electrodes.

If desired, the potential-setting electrode 118 need not be disposed at the same height as the electrode 114, as a conductive path will be formed whenever the water level reaches the higher of the two.

The current passing between the electrodes 114 and 118 signals the control circuit 112 to turn off the motor 34, shutting off the air impeller 36 and the pump impeller 40. This prevents the user from vacuuming more liquid into the tank 12 and further raising the liquid level. However, it is desirable that the user be able to use the motor 34 to lower the liquid level rather than emptying the tank 12 manually. Once the motor 34 has been disabled by the control circuit 112, the user may reactivate the motor 34 by depressing the depressible actuator 64. This signals the control circuit to re-enable the motor 34, allowing a user to hold the vacuum nozzle out of the liquid and pump the liquid out of the tank 12 through the outlet 30.

If the user fails to remove the vacuum nozzle from the liquid while depressing the depressible actuator 64, the liquid level in the tank 12 may continue to rise and may contact the further electrode 116 that is disposed at a liquid level height above the electrode 114. Once liquid contacts the further electrode 116, the control circuit 112 will deactivate the motor 34. The only way to restart the motor 34 is to manually empty the tank 12 and reset the power to the control circuit 112.

Figure 10:
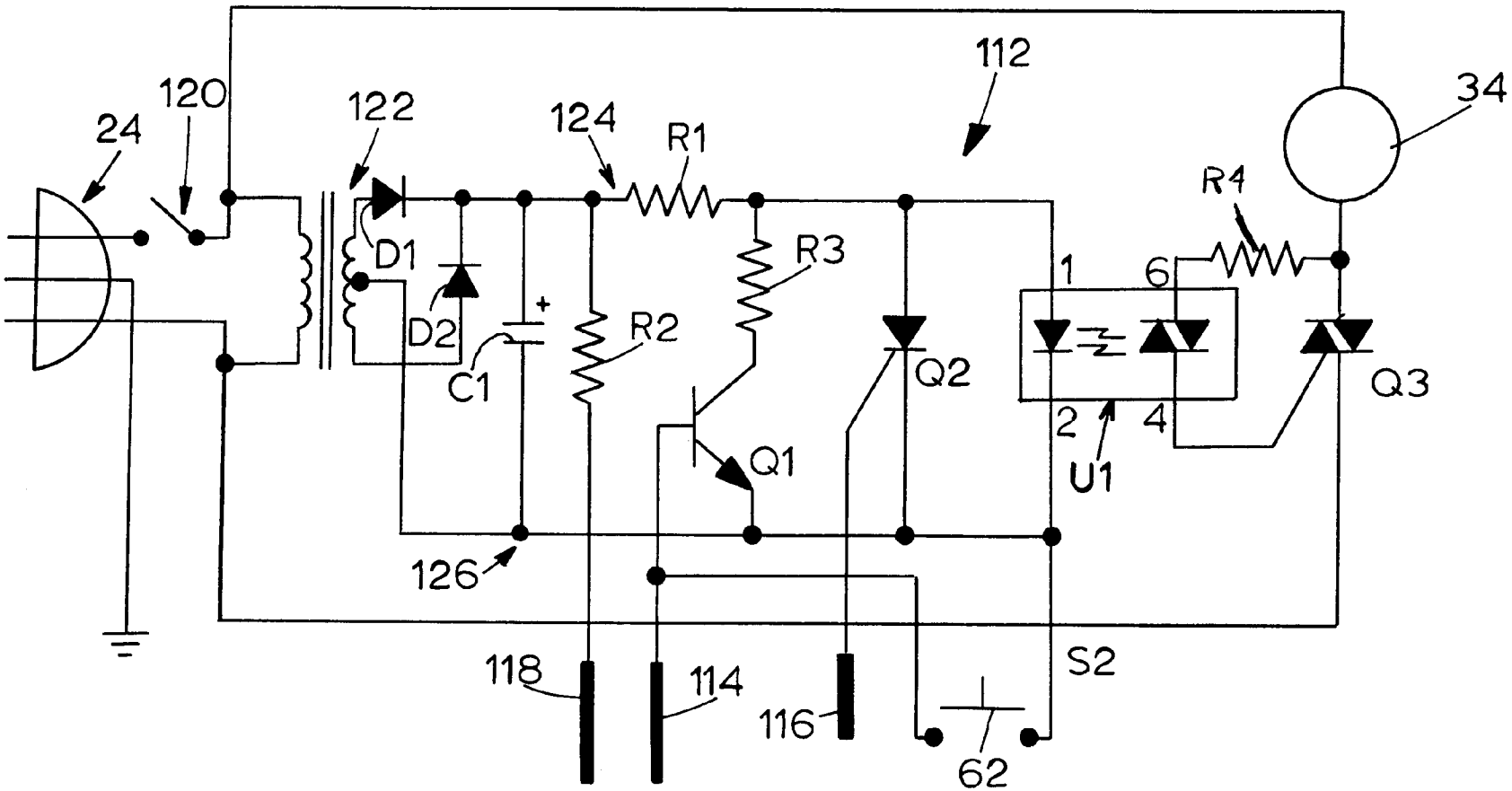
FIG. 10 is a schematic diagram of a preferred embodiment of a control circuit.
Figure 11:
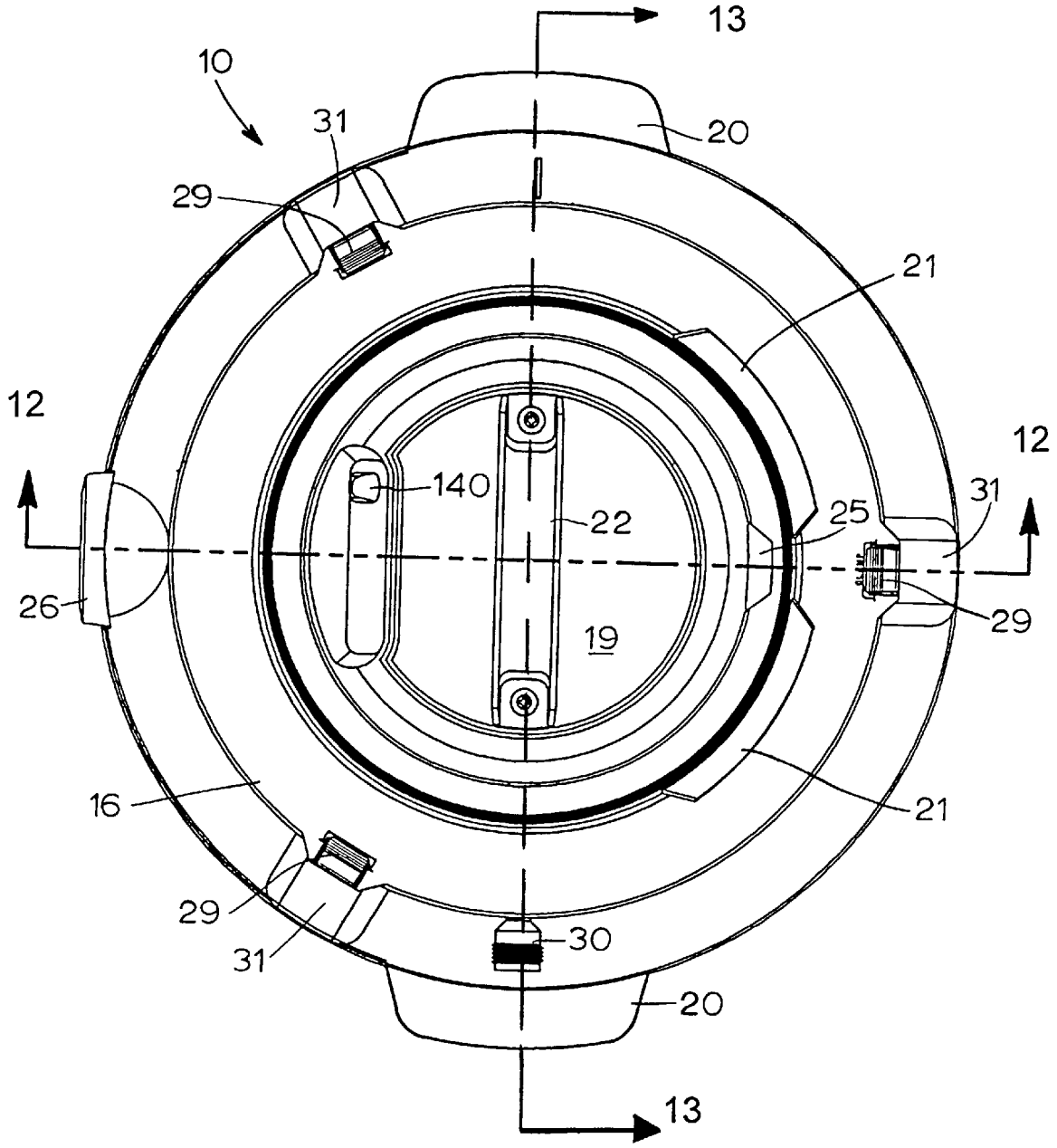
FIG. 11 is a top plan view of a vacuum cleaner of the present invention employing a preferred embodiment of a mechanical shut-off and bypass assembly.

FIG. 10 depicts a schematic diagram of the preferred embodiment of the control circuit 112. The electric cord 24 connects the control circuit 112 to an AC power supply through a main power switch 120 and a step-down transformer 122. The main power switch 120 disconnects power from both the motor 34 and the step-down transformer 122 when opened. In the preferred embodiment, the step-down transformer 122 has a 6 volt secondary winding. Diodes D1 and D2 and a smoothing capacitor C1 rectify and smooth the 6 volt secondary AC voltage, creating a DC voltage across nodes 124 and 126. This provides the DC supply required for the operation of the control circuit 112.

During normal operation of the vacuum, the switch 62 (connected to the depressible actuator 64, not shown) is open and a transistor Q1 and a SCR Q2 are off. A current flows from the node 124 to the node 126 through a resistor R1 and an LED in an optocoupler U1, lighting the LED. This actuates a diac of the optocoupler U1 which, in turn, provides gate current to a gate of a triac Q3. The triac Q3 is thus switched into a low impedance state and allows AC current from the electric cord 24 to reach the motor 34. The AC current causes the motor 34 to operate, allowing normal vacuuming and pumping to take place.

Referring to FIG. 9, in the event that the liquid in the tank 12 rises above the particular liquid level height, a conductive path is formed between the potential-setting electrode 118 and the electrode 114. This allows current to flow from the node 124 (FIG. 10) through a resistor R2 and the potential-setting electrode 118 through the liquid and the electrode 114 to the base of the transistor Q1. The current turns the transistor Q1 on.

Once the transistor Q1 is on, current passes from the node 124 through the resistor R1, a resistor R3 and the transistor Q1 to the node 126 rather than passing through the LED in the optocoupler U1. This turns off the LED in the optocoupler U1, thus turning off the diac and removing the gate drive from the triac Q3. The triac Q3 thus switches to a high impedance state preventing AC current from reaching the motor 34, turning off the motor 34 and preventing any vacuuming or suctioning operations.

When the depressible actuator 64 (shown in FIG. 9) is depressed to command further operation of the motor 34, the switch 62 is closed. Closing the switch 62 connects the base of the transistor Q1 to the node 126, eliminating the base drive therefor and turning the transistor Q1 off. With the transistor Q1 off, current again flows from the voltage node 124 through the resistor R1 to the LED in the optocoupler U1, turning on the diac of the optocoupler U1 and the triac Q3. The motor 34 is therefore turned on, as commanded.

When the liquid eventually reaches the further electrode 116, current flows from the node 124 through the resistor R2 and the electrodes 116 and 118 to the gate of the SCR Q2. This gate current forces the SCR Q2 into a conductive state, shunting the current away from the optocoupler U1 and thereby turning off the triac Q3 to stop the motor 34. Once the gate of the SCR Q2 is activated, the SCR Q2 latches in the conductive state and the optocoupler U1 remains disabled until the liquid level in the tank 12 is manually lowered below the further liquid level height and the main power switch 120 is opened. This action removes the gate drive from and the forward bias across the SCR Q2 to turn off same and thus resets the control circuit 112.

In the preferred embodiment, the control circuit is isolated from the AC power source. This is achieved at the input side by the stepdown transformer 122, and at the output side by the optocoupler U1. This isolation prevents leakage currents from being introduced into the liquid in the tank.

Alternatively, the switch 62, the further electrode 116, the transistor Q1 and the resistor R3 could be replaced by a timing mechanism coupled to the SCR Q2. Once the liquid level in the tank 12 rises to the particular liquid level, the timing mechanism is actuated for a specific period of time. The motor 34 continues to operate while the timing mechanism is engaged, allowing the user to lower the level of liquid in the tank 12 by removing the vacuum nozzle from the liquid while the pump continues to expel the contents of the tank 12. If the liquid level is not below the particular liquid level height when the period measured by the timing mechanism expires, the timing mechanism provides gate current to the gate of the SCR Q2, latching it in the conductive state. This, as noted above, shunts current from the optocoupler U1 and latches the motor 34 off. If the liquid level falls below the particular liquid level height when the period expires, the timing mechanism disengages and resets, thereby allowing continued operation of the motor 34.

Referring now to FIGS. 11–27, an alternative embodiment of the present invention is illustrated. The embodiment includes an actuator mechanism 130, a toggle member 132, a switch 134, a float transmission rod 136, and a float 138.

Figure 14:
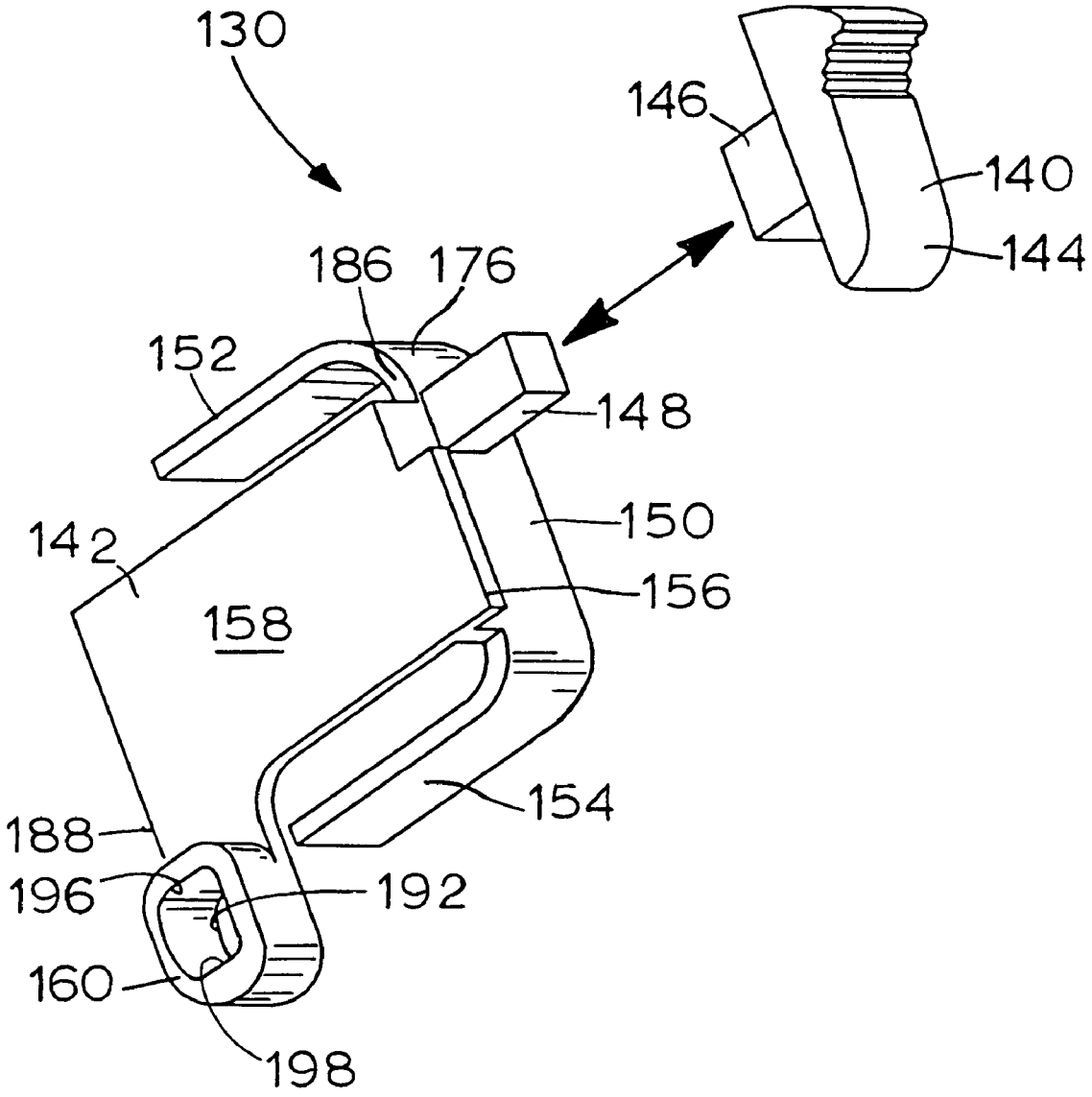
FIG. 14. is a perspective view of a linkage and a toggle actuator of an actuator mechanism.

FIGS. 14–23 illustrate the actuator mechanism 130 and the toggle member 132 in greater detail. Referring to FIG. 14, the actuator mechanism 130 includes a toggle actuator 140 and a linkage 142. The toggle actuator 140 has an engageable portion 144 and a hollow stem coupler 146. The linkage 142 includes an actuator stem 148, a leaf connection member 150, an upper leaf spring 152, a lower leaf spring 154, a standoff 156, a linkage web 158, and a female coupling member 160. The actuator stem 148 is fitted within the stem coupler 146 and moves with the toggle actuator 140. In the preferred embodiment, all of the elements of the toggle member 132 and the actuator mechanism 130 are made of plastic. The toggle member 132 and the toggle actuator 140 are preferably made from acrylonitrile-butadiene styrene copolymer ("ABS"). The linkage 142 is preferably made from a polyamide polymer (e.g. nylon).

As seen in FIG. 20, an actuator slot 166 of the cover 19 is defined by a pair of sidewalls 168, a top lip 170, and a bottom lip 172. The engageable portion 144 of the toggle actuator 140 is disposed on an outer surface 174 of the cover 19. The stem coupler 146 of the toggle actuator 140 extends inwardly through the actuator slot 166.

The actuator stem 148 extends away from a front side 176 (FIG. 14) of the leaf connection member 150, as does the standoff 156. A leading edge of the standoff 156 abuts an inner surface 178 of the cover 19 (FIGS. 20–23). Also, in the preferred embodiment, the upper leaf spring 152, the leaf connection member 150, and the lower leaf spring 154 form a single, U-shaped piece (FIG. 14). The legs of the "U" point back and downwardly toward the motor housing 18 (FIGS. 20–23). The upper leaf spring 152 abuts an upper rib 180, formed integrally in the cover 19, and creates a first load. The lower leaf spring 154 abuts a lower rib 182 which is formed in a switch mounting box 184, and creates a second load. In the preferred embodiment, the first load and the second load are equally balanced. Therefore, when a user releases the toggle actuator 140, the equally balanced loads will return the toggle actuator 140 to a centered position in the actuator slot 166.

Figure 15:
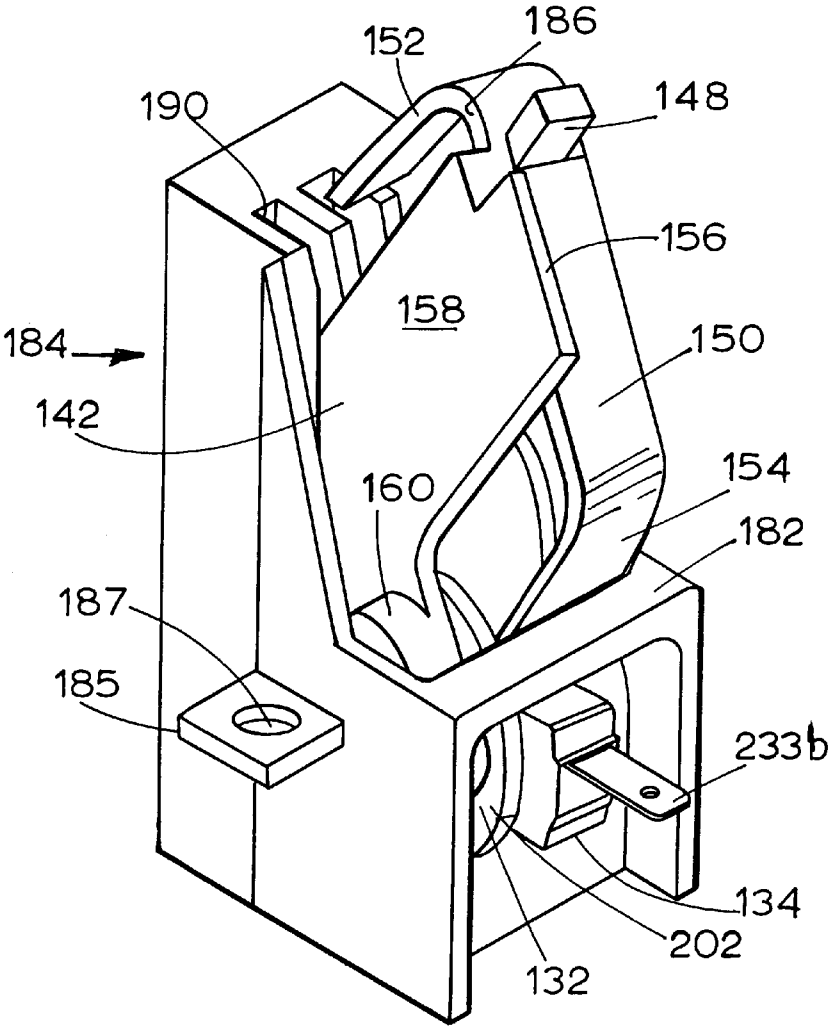
FIG. 15 is a perspective view of the actuator mechanism, a toggle member, and a switch mounted in a switch mounting box.
Figure 16:
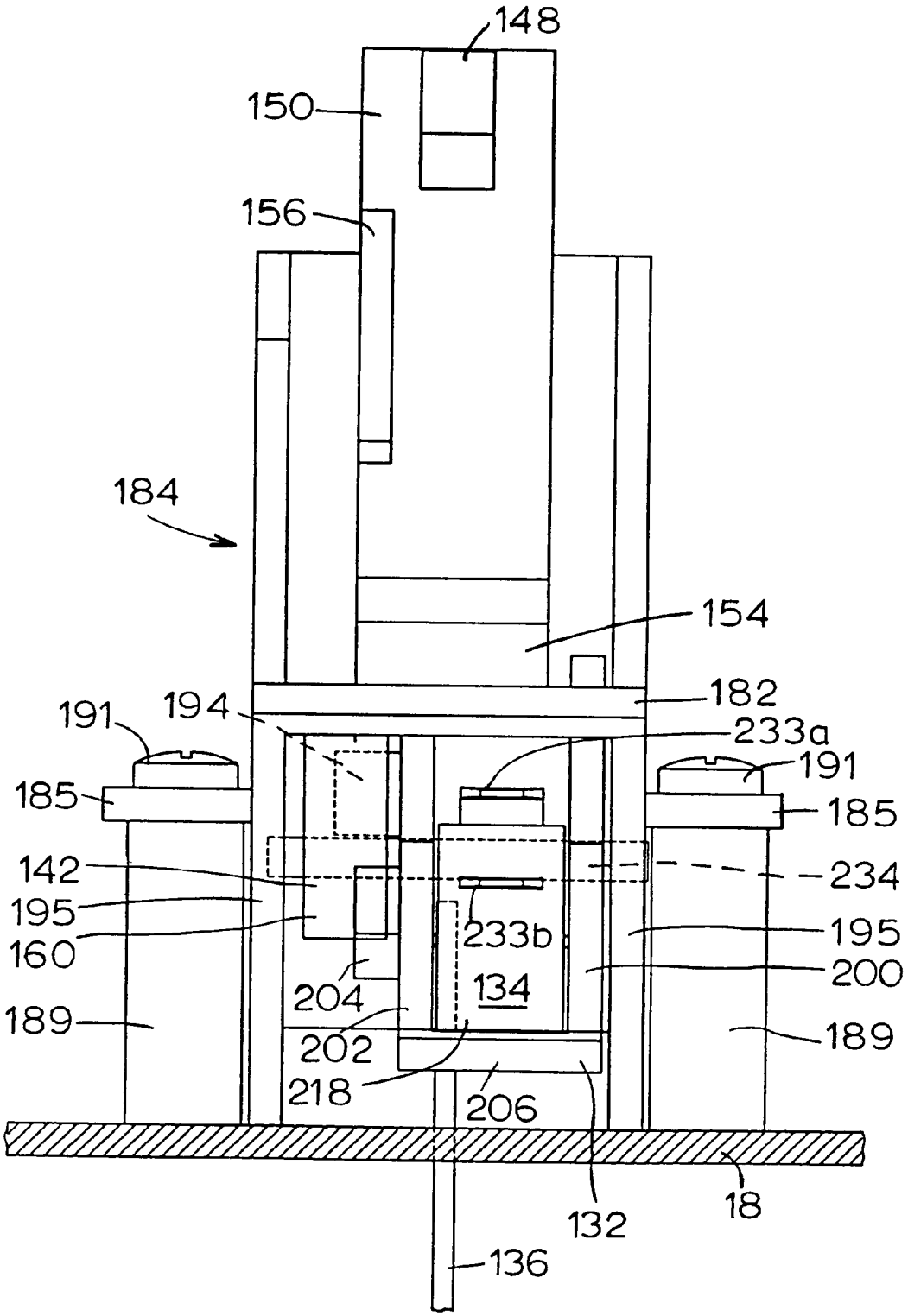
FIG. 16 is a front elevational view of the actuator mechanism, the toggle member, and the switch mounted in the switch mounting box and the switch mounting box attached to a motor housing.

The switch mounting box 184 is a compartment designed to receive and securely hold the switch 134 by any convenient means, as best seen in FIG. 15. The switch mounting box 184 includes a pair of outwardly extending flanges 185 (FIGS. 15 and 16) each of which includes a bolt hole 187 extending therethrough. The motor housing 18 includes a pair of upward extending bolt receiving bosses 189 (FIG. 16). The switch mounting box 184 is secured to the motor housing 18 by bolts 191 which extend through the bolt holes 187 and are secured within threaded bores in the bolt receiving bosses 189.

The linkage web 158 is connected to a sidewall 186 of the leaf connection member 150 and extends backward in the same direction as the leaf springs 152, 154, as best seen in FIGS. 14 and 15. The linkage web 158 has a back end 188 that abuts a base surface 190 of a channel formed integrally in the switch mounting box 184 (FIGS. 15 and 20–23). The female coupling member 160 is disposed at a lower end of the back end 188 and is substantially thicker than the linkage web 158. The extra thickness of the female coupling member 160 provides additional strength and reduces the possibility of breakage that may arise due to repetitive use of the linkage 142.

A boss slot 192 extends through the female coupling member 160. The toggle member 132 (FIG. 16) has a boss 194 which is disposed within the boss slot 192 (FIGS. 20–23). Defining the top and bottom of the boss slot 192 is an upper flange portion 196 and a lower flange portion 198, respectively (FIG. 14). The upper and lower flange portions 196, 198 do not displace the boss 194 in any substantial fashion when the toggle actuator 140 is at rest. However, as will be explained in detail below, when the toggle actuator 140 is engaged, either the upper or lower flange portion 196, 198 engages the boss 194 to move the toggle member 132 to the desired position.

Figure 17:
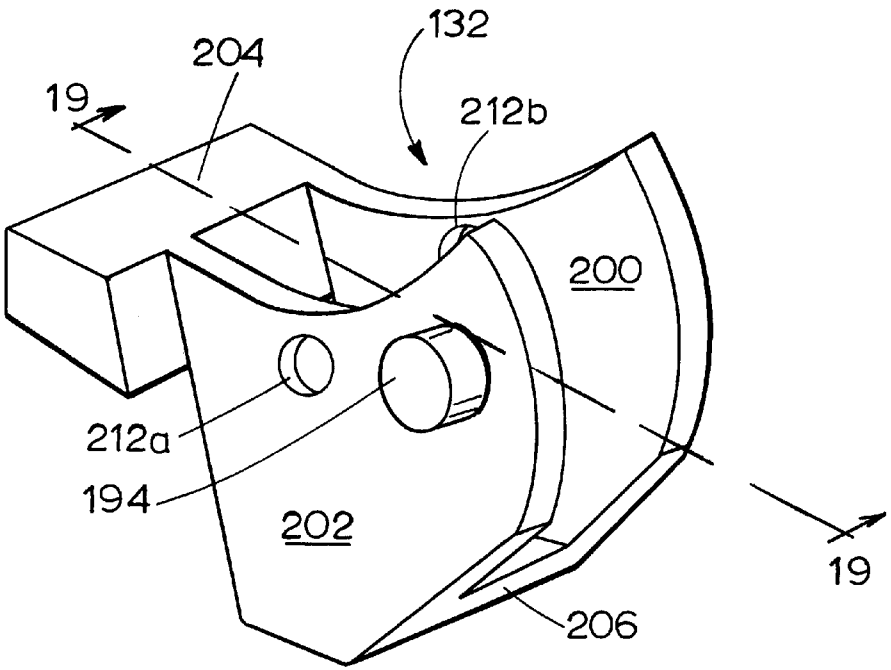
FIG. 17 is a perspective view of the toggle member.
Figure 19:
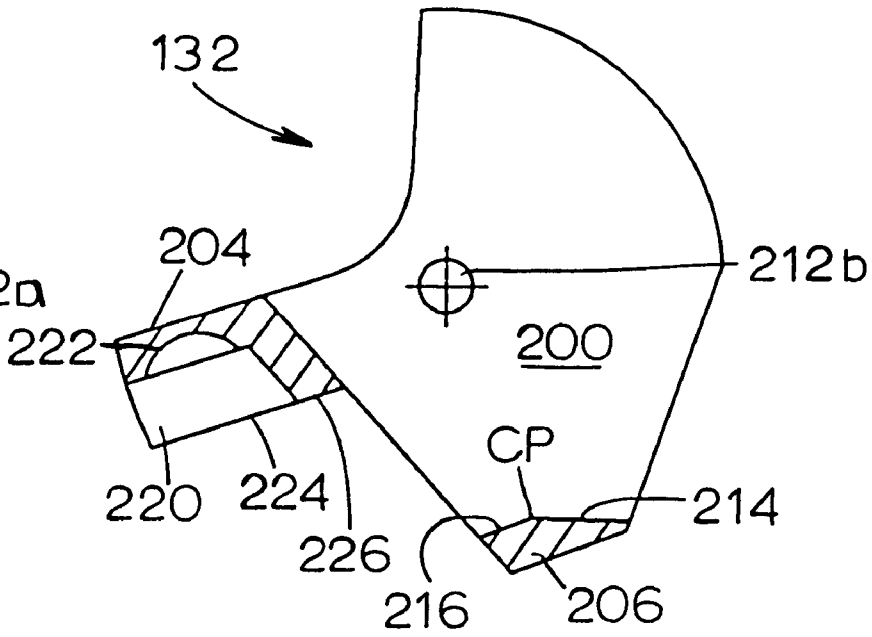
FIG. 19 is a sectional view of the toggle taken along the line 19—19 in FIG. 17.
Figure 18:
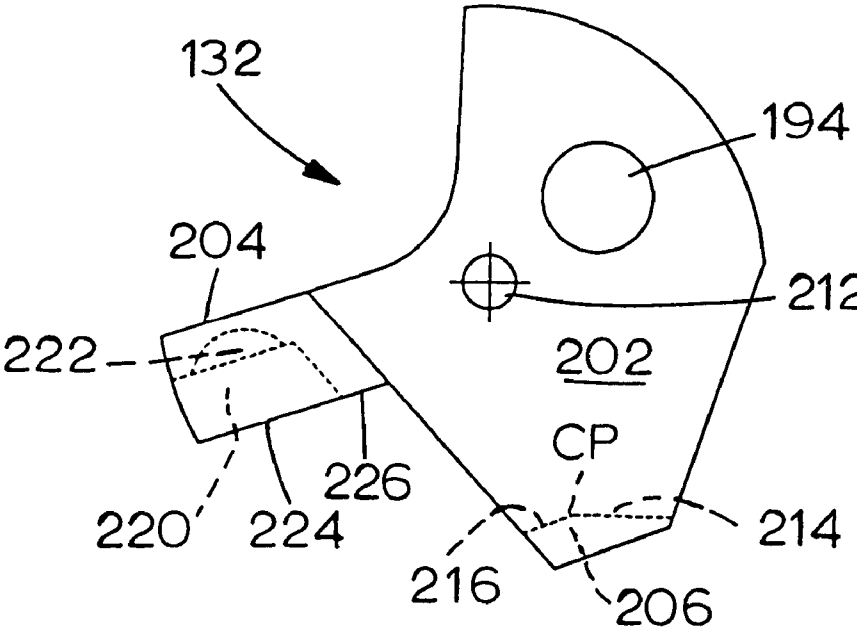
FIG. 18 is a side elevational view of the toggle.

Referring now to FIGS. 17–19, the toggle member 132 includes integrally-formed elements including the boss 194, first and second sidewalls 200 and 202, a rod receiving extension 204, and a locking brace 206 spanning the distance between the sidewalls 200, 202. When the toggle member 132 is assembled together with the switch mounting box 184, the first and second sidewalls 200, 202 are disposed on opposite sides of the switch 134 between first and second ends 208, 210 thereof (FIGS. 15, 16 and 20–23). The second sidewall 202 is disposed between the switch 134 and the linkage 142. The sidewalls 200, 202 include aligned bores 212*a*, 212*b*, respectively, disposed near the first end 208 of the switch 134 (FIG. 17). The boss 194 extends outwardly from the second sidewall 202 into the boss slot 192 of the female coupling member 160 (FIGS. 16, 17 and 20–23).

The locking brace 206 is disposed beneath the first end 208 of the switch 134. As seen specifically in FIGS. 18 and 19, the locking brace 206 includes a ramp portion 214 and a locking portion 216. The ramp portion 214 is angled such that when the toggle member 132 is rotated fully counterclockwise as seen in FIG. 20, the ramp portion 214 lies flush against a bottom surface 218 of the switch 134 (this condition is also shown in FIG. 16). Additionally, the locking portion 216 intersects with the ramp portion 214 at a point CP (FIGS. 18 and 19). In the preferred embodiment, the included angle between the ramp portion 214 and the locking portion 216 is approximately 158 degrees, although this dimension may vary from such value, as will be apparent to one of ordinary skill in the art.

Figure 25:
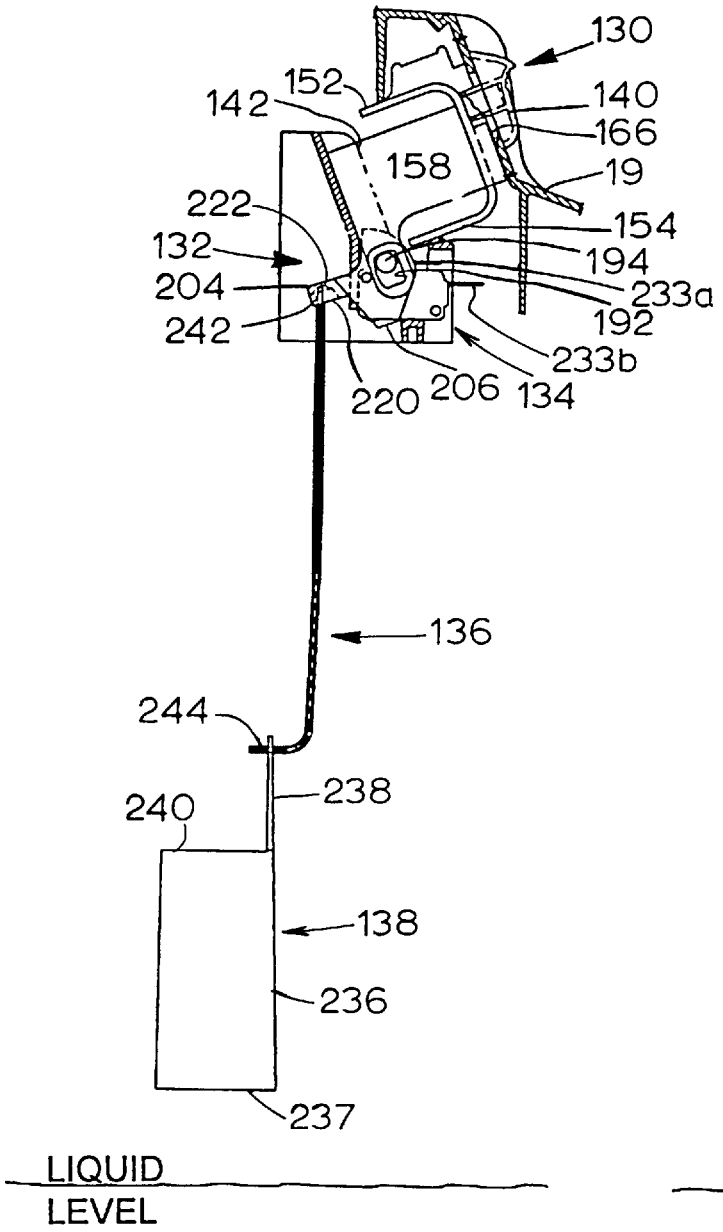
FIG. 25 is a side elevational view of the mechanical shut-off and bypass assembly in an "ON" position.

Referring again specifically to FIGS. 17 and 20–23, the rod receiving extension 204 is disposed behind the first end 208 of the switch 134 spanning the distance between the sidewalls 200, 202 and further extends outwardly beyond the sidewall 202. As seen in FIGS. 18 and 19, the rod receiving extension 204 defines a guide opening 220 and a semi-circular rod receiving cup 222 above the guide opening 220. The rod receiving cup 222 and the guide opening 220 together receive the float transmission rod 136 (FIG. 25).

Referring now to FIGS. 15, 16 and 20–23, the switch 134 is a standard electrical microswitch and includes an axle bore 228, a momentary actuator 230, an internal spring 232, and a pair of electrodes 233*a*, 233*b*. In the preferred embodiment, a Unimax Model #TFCJV4SP004AY made by C&K is used. The switch 134 is securely seated in the switch mounting box 184, and the axle bore 228 is disposed near the first end 208 of the switch 134. The switch 134 is normally in the "OFF" position. To turn the switch 134 "ON", the actuator 230 must be depressed. When the actuator 230 is released, the internal spring 232 pushes the actuator 230 outward, returning the switch 134 to the normally "OFF" position.

An axle 234, best seen in FIG. 16, has ends disposed in a pair of opposing walls 195 of the switch mounting box 184 and extends through the aligned bores 212*a*, 212*b* in the first and second sidewalls 200, 202 of the toggle member and the axle bore 228 of the switch 134. The axle 234 acts as an axis of rotation for the toggle member 132.

Figure 12:
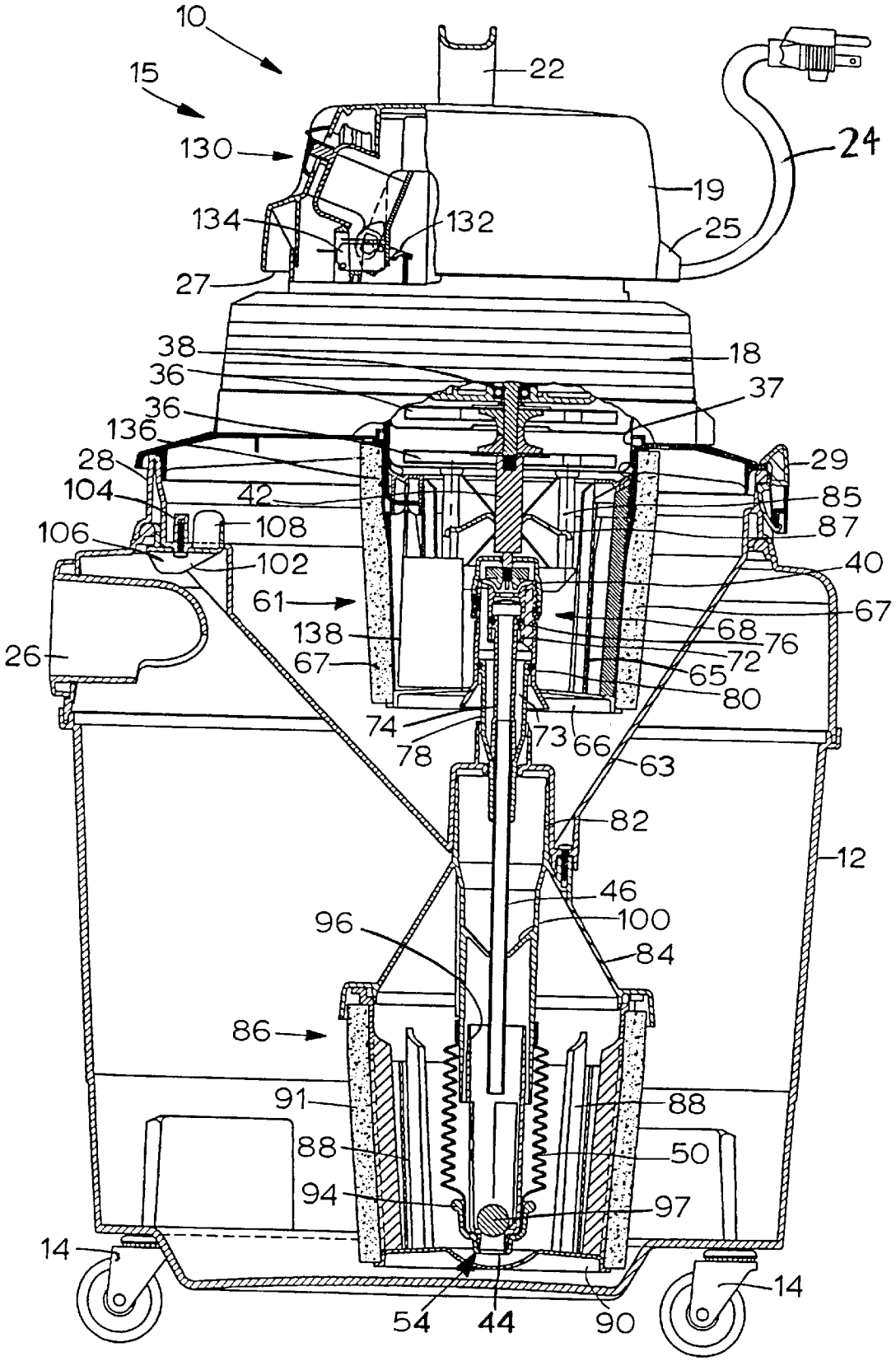
FIG. 12 is a view similar to FIG. 4 showing the preferred embodiment of the mechanical shut-off and bypass assembly.
Figure 13:
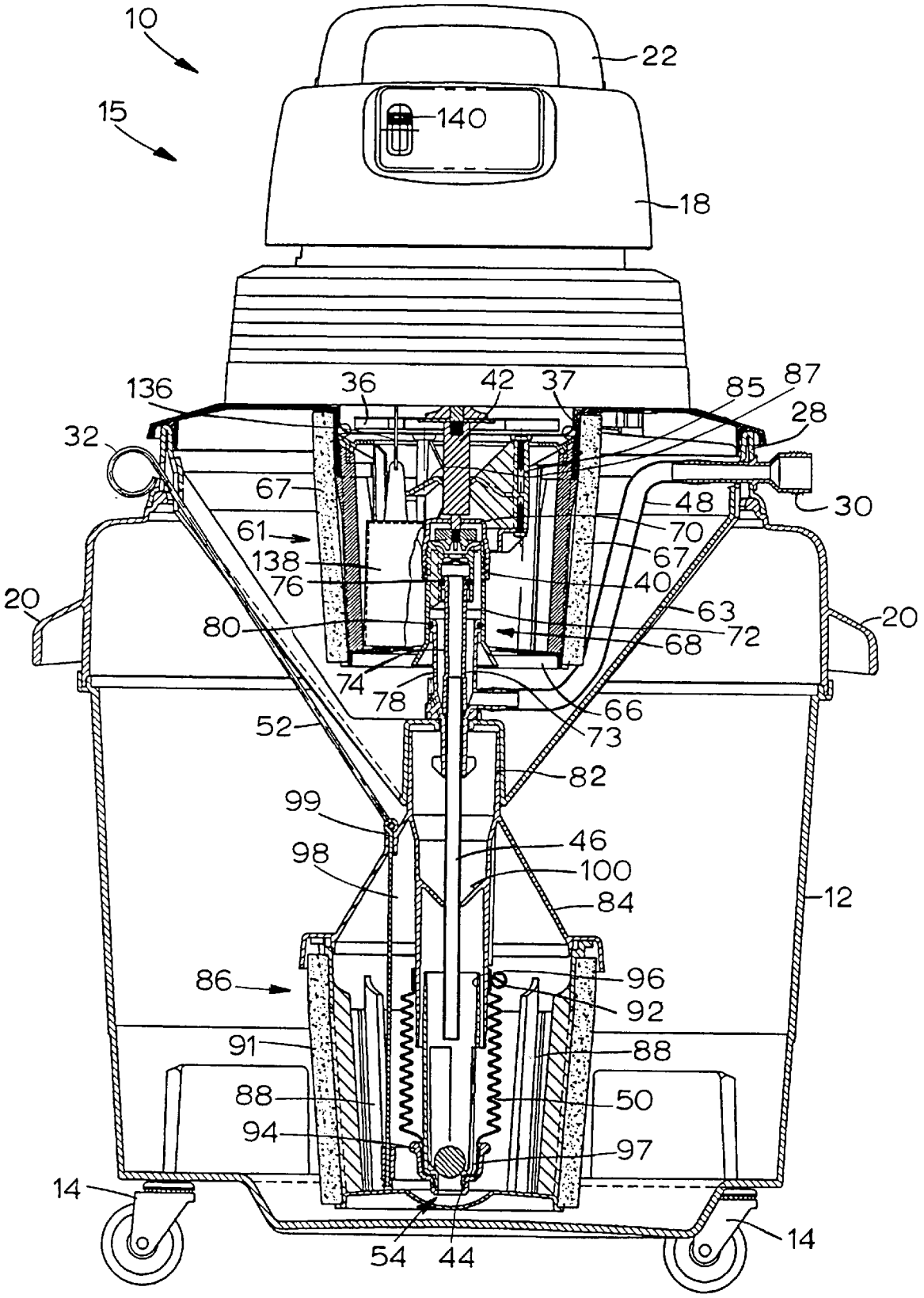
FIG. 13 is a view similar to FIG. 5 showing the preferred embodiment of the mechanical shut-off and bypass system.

Referring now to FIGS. 12 and 24–27, the float 138, which may be hollow and made of any suitable material, is disposed within the lid cage 61. The float 138 includes a float body 236 and an upwardly extending rod cooperating extension 238. The float body 236 rests on the plate 66 when there is no liquid in the tank 12 (FIG. 12).

The float transmission rod 136 has a top end 242 and a bottom end 244. The bottom end 244 is retained within a hole in the rod cooperating extension 238. Alternatively, the bottom end 244 need not be connected to the rod cooperating extension 238, but may instead seat in a groove or slot formed in the rod cooperating extension 238 and still function properly. The top end 242 of the float transmission rod 136 extends into the guide opening 220 of the rod receiving extension 204. Preferably, although not necessarily, the top end 242 is not connected to the rod receiving extension 204 in any manner.

The float transmission rod 136 moves in an unrestricted, non-contained linear up-and-down path in the preferred embodiment. However, other embodiments are envisioned in which the float transmission rod 136 would travel in a linear up-and-down path in a contained channel or guidance slot.

FIGS. 20–23 illustrate different phases of the working relationship between the actuator mechanism 130, the toggle member 132, and the switch 134.

FIG. 20 illustrates the switch 134 in an "ON" position with the toggle actuator 140 at rest and centered in the actuator slot 166. As described above, the upper and lower leaf springs 152, 154 maintain the toggle actuator 140 in this centered position in the actuator slot 166. In the "ON" position, the toggle member 132 is rotated counterclockwise and the locking brace 206 is engaging the actuator 230.

FIG. 21 illustrates the toggle member 132 in transition from the "ON" to the "OFF" position. In the transition phase illustrated, the user exerts a downward force on the engageable portion 144 of the toggle actuator 140. The downward force is transmitted through the linkage 142 and moves the boss slot 192 downwardly until the upper flange portion 196 of the boss slot 192 engages the boss 194. Continued downward force moves the upper flange portion 196 further downward, which in turn moves the boss 194 downward and rotating the toggle member 132 clockwise around the axle 234. The clockwise rotation of the toggle member 132 moves the locking brace 206 out of engagement with the actuator 230. The compressed internal spring 232 pushes the actuator 230 outward and turns off the switch 134, which in turn shuts off the motor 34. The bottom lip 172 of the actuator slot 166 acts as a stop on the stem coupler 146 of the toggle actuator 140 and keeps the user from pushing the boss 194 too far downward.

Also as the toggle actuator 140 is moved downwardly during the transition from "ON" to "OFF", the upper leaf spring moves out of contact with the upper rib 180 of the switch mounting box 184 and the lower leaf spring 154 is compressed against the lower rib 182. As a result, when the user releases the engageable portion 144 of the toggle actuator 140, the net upward force developed on the leaf connection member 150 causes the actuator mechanism 130 to move upward. The upward movement of the actuator mechanism 130 continues until the forces imposed on the leaf connection member 150 by the upper and lower leaf springs 152, 154 are balanced once again. At that point (FIG. 22), the toggle actuator 140 is centered again in the actuator slot 166, and the boss slot 192 is no longer in engagement with the boss 194 due to the geometry of the boss slot 192. The actuator 230 is pushed downwardly by the internal spring 232 causing the switch to assume the "OFF" position and rotating the toggle member clockwise to the position shown.

FIG. 23 illustrates the toggle member 132 in transition from the "OFF" to the "ON" position. In the transition phase illustrated, the user exerts an upward force on the engageable portion 144 of the toggle actuator 140. The upward force is transmitted through the linkage 142 and moves the boss slot 192 upwardly until the lower flange portion 198 of the boss slot 192 engages the boss 194. Continuation of the upward force moves the lower flange portion 198 further upward, in turn moving the boss 194 upwardly and rotating the toggle member 132 counter-clockwise around the axle 234. The counter-clockwise rotation of the toggle member 132 initially moves the ramp portion 214 of the locking brace 206 into engagement with the actuator 230 of the switch 134. As the user further moves the engageable portion 144 upwardly, the actuator 230 begins to move upwardly and the ramp portion 214 of the locking brace 206 slides laterally relative thereto. As the toggle member 132 continues to rotate counter-clockwise, the point CP eventually passes the actuator 230. At this point, the actuator 230 no longer resists the counter-clockwise motion of the locking brace 206, but instead assists such movement and the actuator 230 moves over the surface of the locking portion 216. The locking brace 206 continues to rotate in a counter-clockwise fashion until the ramp portion 214 engages the bottom surface 218 of the switch 134. The components are now in the position shown in FIG. 27.

The upper lip 170 of the actuator slot 166 acts as a stop on the stem coupler 146 of the toggle actuator 140 and keeps the user from pulling the boss 194 too far upward.

Once the ramp portion 214 is flush with the bottom surface 218 of the switch 134, the actuator 230 is latched in the depressed position, and the toggle member 132 remains in the fully counter-clockwise position, owing to the force exerted by the actuator 230 against the locking brace 206.

In the transition from "OFF" to "ON," the upper leaf spring 152 is compressed by the upper rib 180 and the lower leaf spring moves out of contact with the lower rib 182. As a result, when the user releases the engageable portion 144 of the toggle actuator 140, the upper leaf spring 152 transmits a downward force on the leaf connection member 150, causing the actuator mechanism 130 to move downward. The downward movement of the actuator mechanism 130 continues until the forces exerted by the upper and lower leaf springs 152, 154 are again balanced. At that point, the toggle actuator 140 is, once again, centered in the actuator slot 166, and the boss slot 192 is no longer in engagement with the boss 194 (FIG. 20).

Figure 24:
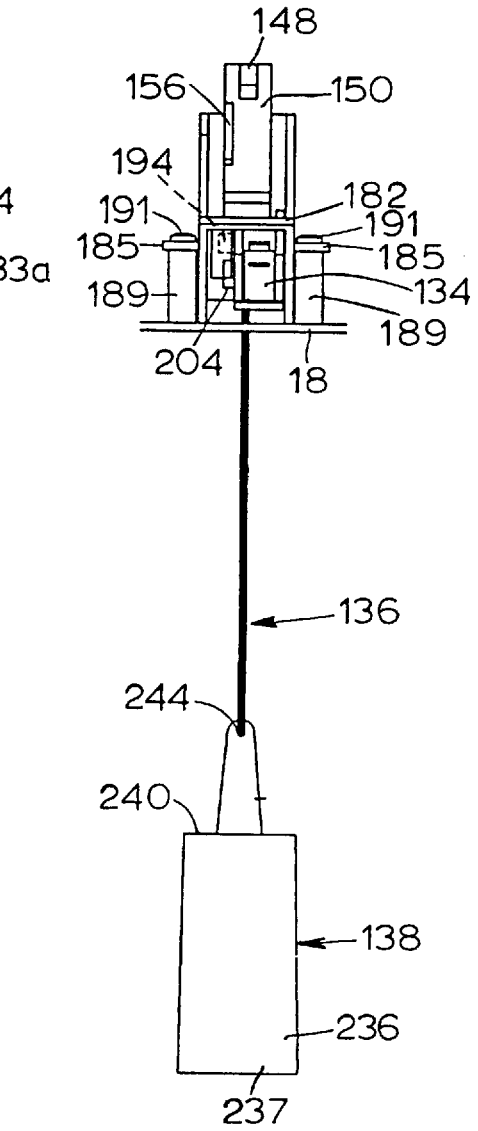
FIG. 24 is a front elevational view of the mechanical shut-off and bypass assembly in an "ON" position.

FIGS. 24–27 illustrate the operation of the mechanical shut-off and bypass assembly. FIGS. 24 and 25 illustrate the toggle member 132 in the "ON" position (FIG. 20) with the liquid level in the tank 12 below the float 138. When the vacuum cleaner 10 is in use, this is the normal operating configuration. In this configuration, the bottom end 244 of the float transmission rod 136 is resting on the rod cooperating extension 238, and the top end 242 is seated in the rod receiving cup 222. The toggle actuator 140 is centered in the actuator slot 166, and the boss slot 192 is not in engagement with the boss 194.

Figure 26:
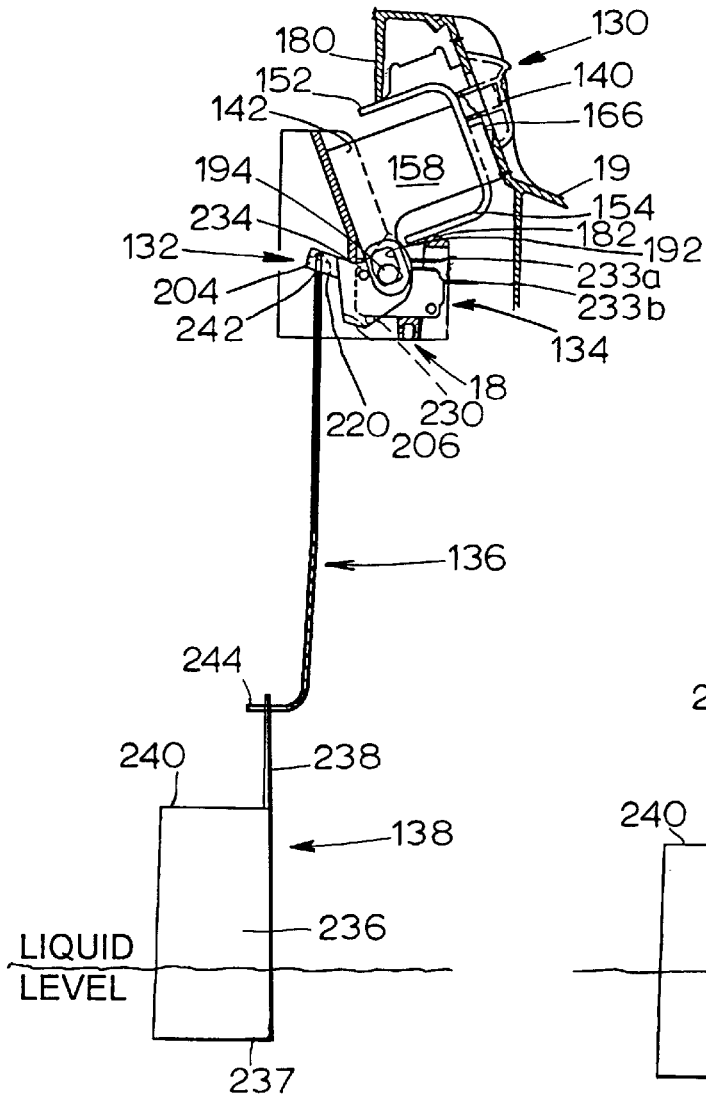
FIG. 26 is a side elevational view of the mechanical shut-off and bypass assembly transitioning to the "OFF" position due to an excessively high water level.

FIG. 26 illustrates the situation where the vacuum cleaner 10 is initially on and the liquid level in the tank 12 rises above a pre-set, motor shut-off level causing the liquid to push the float 138 upward. The float 138 pushes the float transmission rod 136 upward, causing the top end 242 of the float transmission rod 136 to push the rod receiving extension 204 of the toggle member 132 upward. This upward movement causes the toggle member 132 to rotate clockwise, eventually taking the locking brace 206 out of engagement with the actuator 230 of the switch 134, and as a consequence, shutting off the motor 34. At this point, the user has the option of emptying the tank 12 by mechanically bypassing the float shut-off or by removing the upper vacuum assembly 15 and physically emptying the tank 12.

Figure 27:
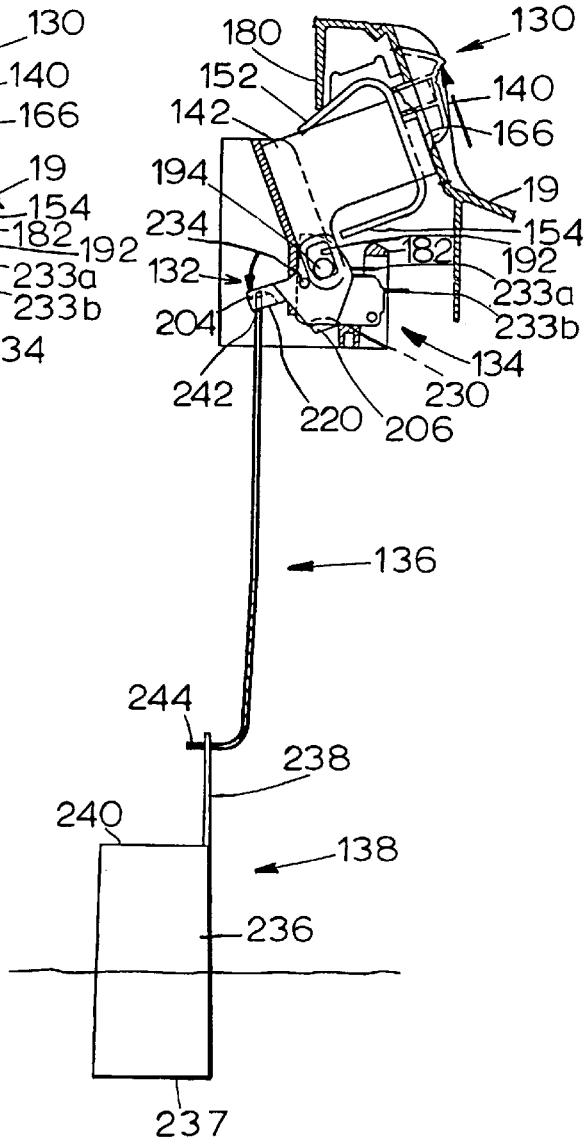
FIG. 27 is a side elevational view of the user bypassing the mechanical shut-off.
Figure 28:
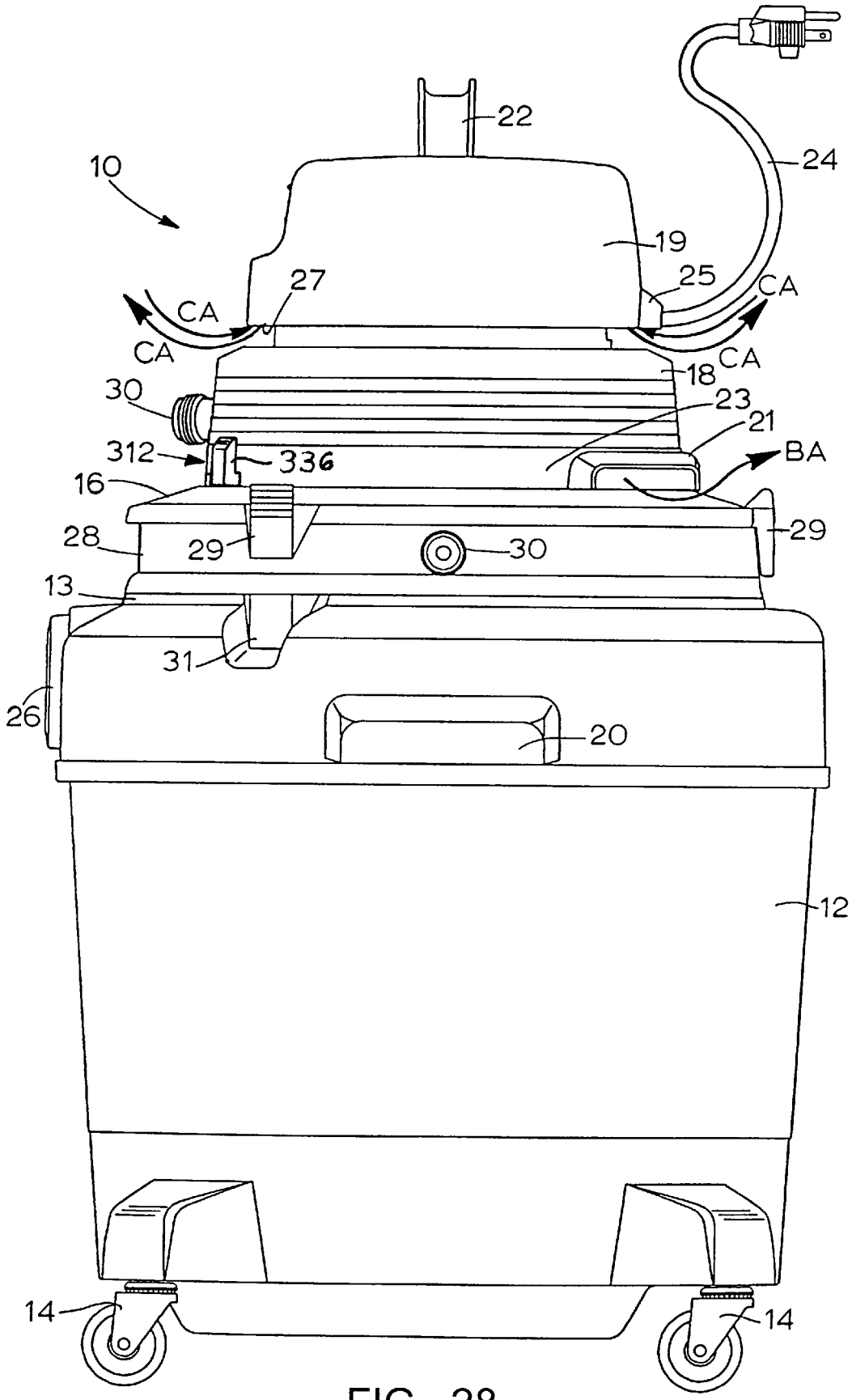
FIG. 28 is a side elevational view of an alternative embodiment of the vacuum cleaner of the present invention with an insertion assembly disposed between a tank and an upper vacuum assembly.
Figure 29:
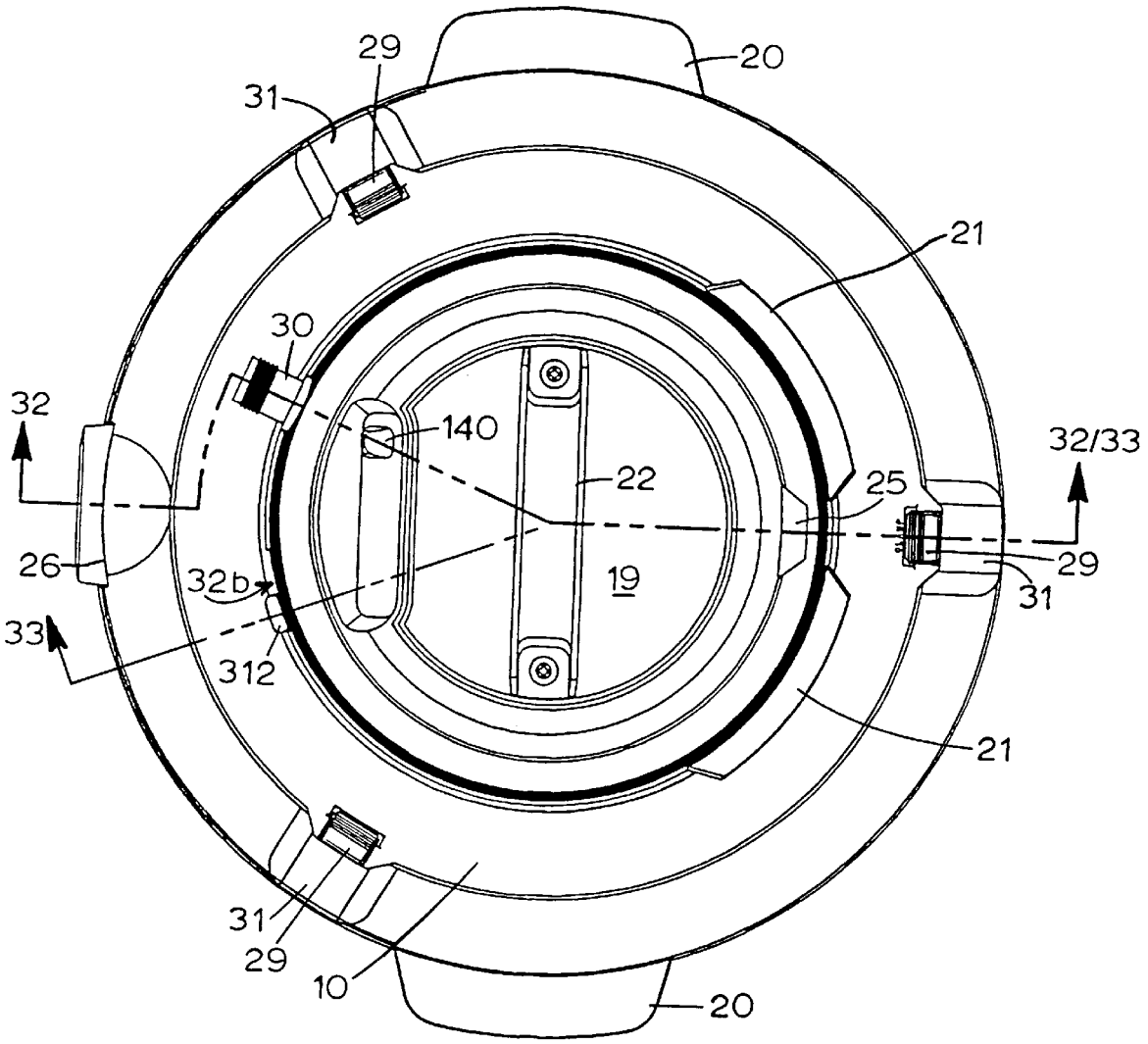
FIG. 29 is a top plan view of the alternative embodiment vacuum cleaner.

To mechanically bypass the float shut-off, the user pushes upward on the toggle actuator 140 (FIG. 27). As discussed previously, the linkage 142 pulls up on the boss 194, rotating the toggle member 132 counter-clockwise, and depressing the actuator 230. This turns the motor 34 back "ON". However, when the motor 34 is turned back "ON", the user has to continue to hold the toggle actuator 140 up until the liquid level is below the pre-set, motor shut-off level; otherwise, the motor 34 will shut off again. This is due to the fact that to keep the motor 34 "ON" the user is actually forcing the float 138 downward against the upward force of the liquid. Once the liquid level is reduced below the pre-set, motor shut-off level, the user can release the toggle actuator 140 and the motor 34 will remain "ON". Then, the user may continue normal operation of the vacuum cleaner 10.

If, on the other hand, the user decides to physically empty the tank 12, the user must first remove the upper vacuum assembly 15, and then, lift or tip the tank 12, emptying the contents of the tank 12 therefrom. Assuming that the user is not moving the toggle actuator 140 upwardly during such time, the motor 34 will remain off.

The mechanical shut-off and bypass assembly employs a number of design features to prevent the toggle member 132 from unintentionally rotating counter-clockwise and re-engaging the actuator 230. One design feature is the lack of a connection between the rod receiving extension 204 and the float transmission rod 136. If the float transmission rod 136 were connected to the rod receiving extension 204, the weight of the rod 136 would pull the toggle member 132 downward when the lid 16 is lifted upward. In the present invention, the rod receiving extension 204 and the float transmission 136 separate from each other when the upper vacuum assembly 15 is lifted upward.

Another design feature is the force of the internal spring 232 of the depressible actuator 230. If the toggle member 132 were to rotate counter-clockwise while the upper vacuum assembly 15 was being lifted upward, the motor 34 would remain "OFF" because the toggle member 132 is not capable of generating enough force to overcome the outward force of the internal spring 232. Consequently, the depressible actuator 230 will not be depressed.

Figure 30:
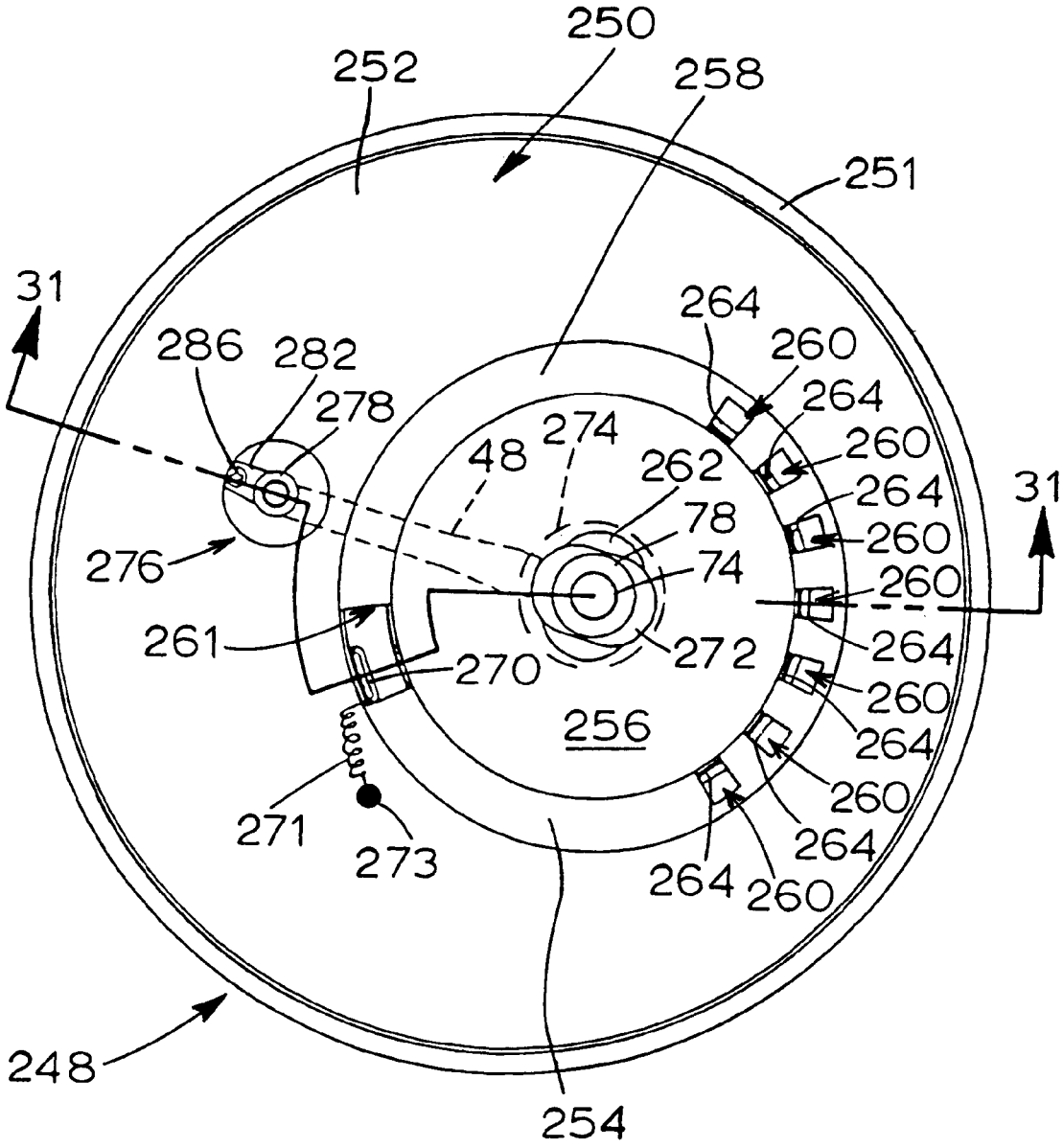
FIG. 30 is a top plan view of the insertion assembly.
Figure 31:
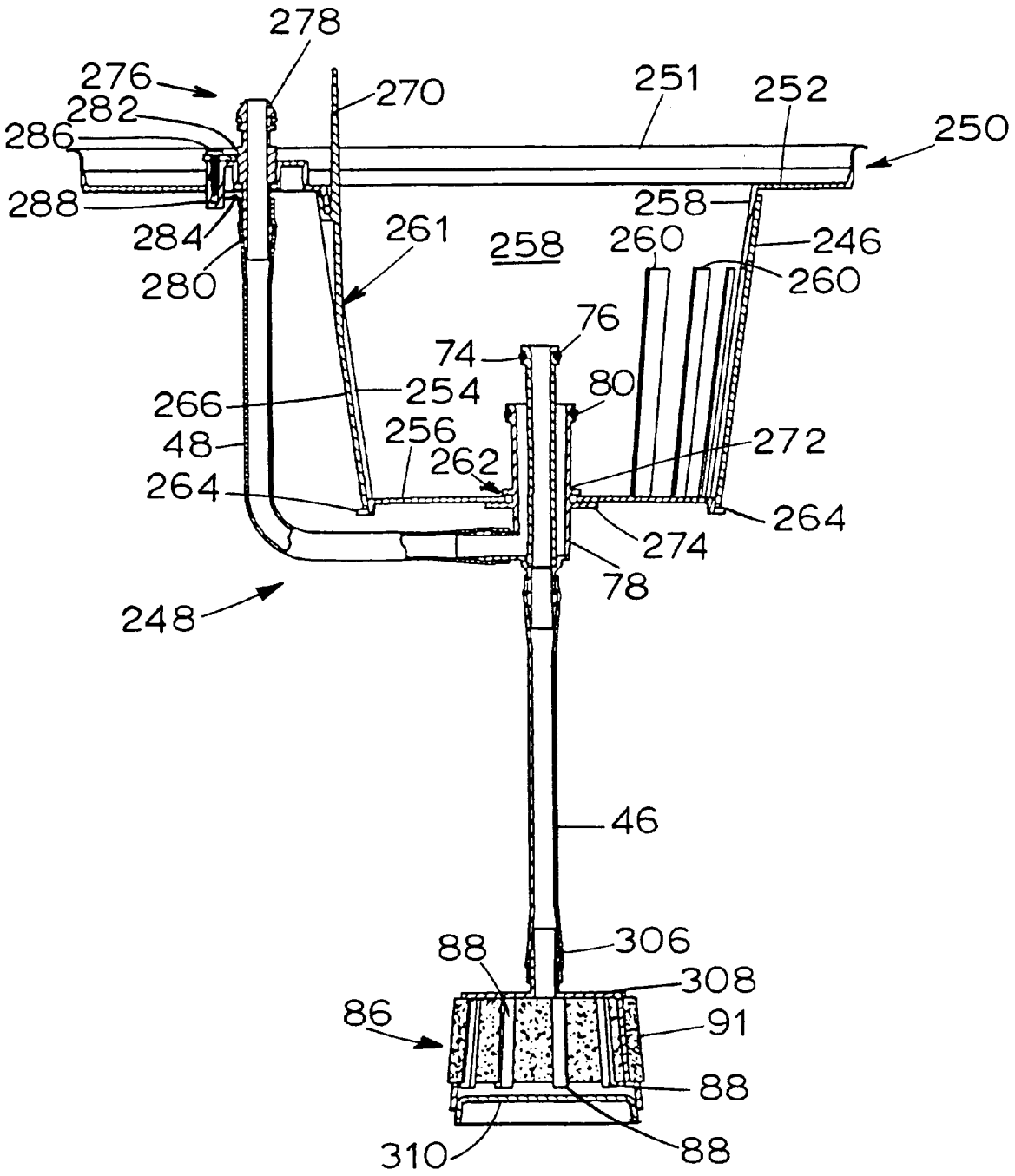
FIG. 31 is a sectional view along the line 31—31 in FIG. 30.
Figure 32:
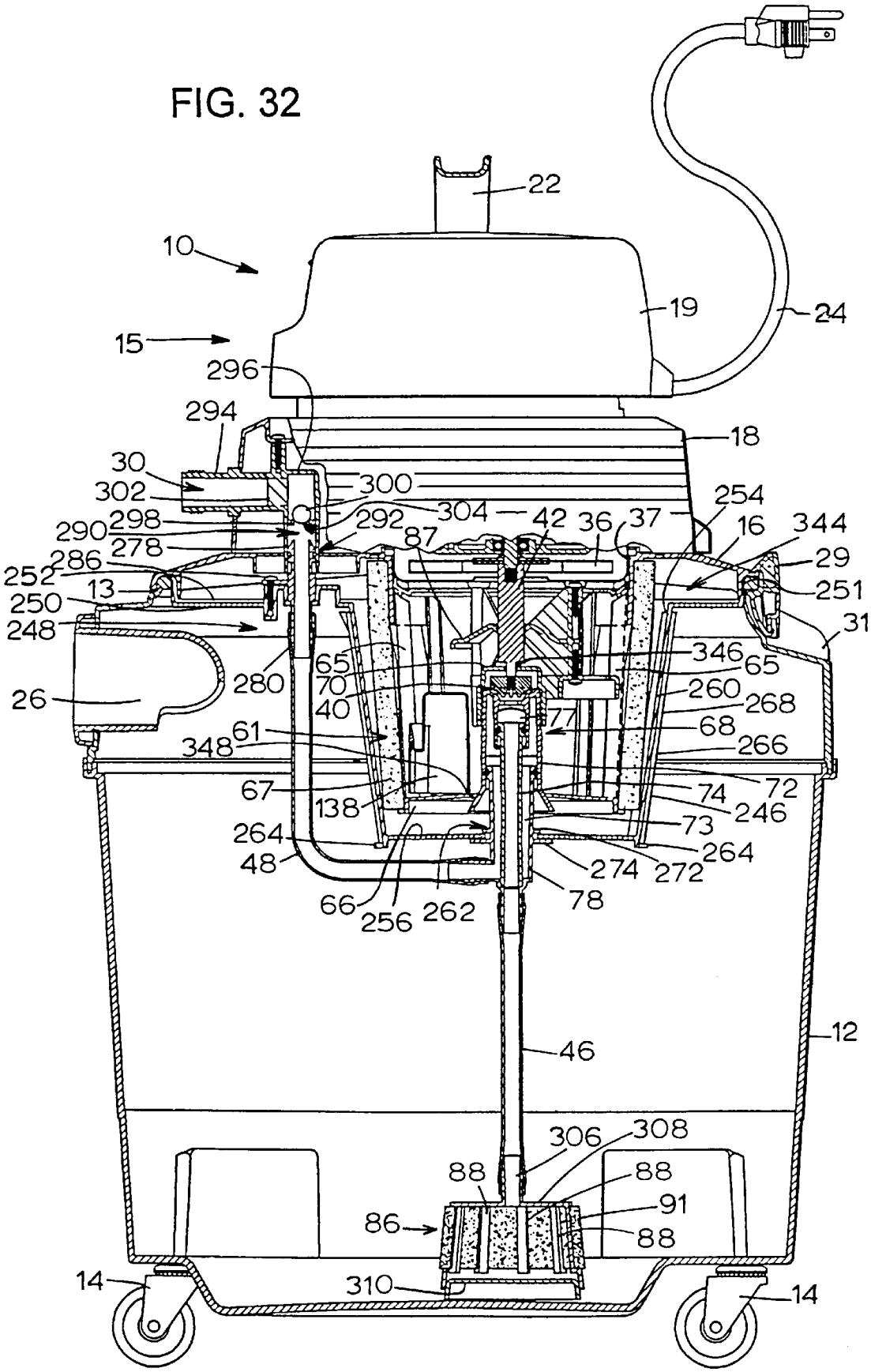
FIG. 32 is a side elevational view, partially in section, along the line 32—32 in FIG. 29.

Turning now to FIGS. 28–39, an alternative embodiment for priming the pump 68 of the present invention is illustrated. In the alternative embodiment, an insertion assembly 248 is disposed between the tank 12 and the upper vacuum assembly 15 (FIG. 32). The insertion assembly 248 takes the place of the tank extension 28 illustrated in previous embodiments. Similar to the tank extension 28, the insertion assembly 248 engages the upper rim 13 of the tank 12 and is disposed within the tank 12. Unlike the tank extension 28, the insertion assembly 248 is relatively thin at the point where it engages the upper rim 13. Therefore the latches 29 secure the upper vacuum assembly 15 to the tank 12 both when the insertion assembly 248 is in place and when it has been removed.

Referring to FIGS. 30–33, the insertion assembly 248 includes a baffle 246 (FIGS. 31–33), a plenum 250, the inlet tube 46, 74, the outlet fitting 78, the outlet tube 48, a connection nozzle 276 (FIGS. 30–32) and the lower cage 86. The plenum 250 includes a lip 251, a support portion 252, an air passage cylinder 254, and a bottom plenum wall 256. The air passage cylinder 254 includes a sidewall 258 which defines a frustoconical cylinder. The sidewall 258 further defines several openings or air slots 260, and a baffle tab slot 261 as best seen in FIG. 30. In the preferred embodiment, the sidewall 258 defines seven air slots 260, and the air slots 260 are disposed on the sidewall 258 opposite the tank inlet 26 (FIG. 32). The sidewall 258 may be integrally formed with the bottom plenum wall 256 and the support portion 252. The bottom plenum wall 256 further defines an oblong opening 262.

A plurality of support tabs 264 are integrally formed with the bottom plenum wall 256. The support tabs 264 are formed at the bottom of the air passage cylinder 254 below each of the air slots 260, and one is formed at the bottom of the baffle tab slot 261 (FIG. 31). The support tabs 264 are disposed below the bottom plenum wall 256 and extend outward from the air passage cylinder 254. The baffle 246 includes a sidewall 266 that is disposed outside and surrounds the air passage cylinder 254. The baffle sidewall 266 also defines several air slots 268, as best seen in FIGS. 35 and 36. The number of air passage cylinder air slots 260 equals the number of baffle air slots 268, in this case seven. The baffle 246 also includes a baffle boss 270 (FIGS. 30, 31, 35 and 36) which is integrally formed with the baffle 246 and extends upward from the baffle 246 through the baffle tab slot 261. The baffle 246 is a single, curved semi-rigid piece with a longitudinal seam opening (not depicted) along one side. The longitudinal seam opening allows the baffle 246 to be slid over the support tabs 264 and then re-form snugly around the outside of the air passage cylinder 254. The baffle 246 is then secured in place by the support tabs 264, and the seam opening may be closed by the use of a spring (not depicted) which pulls the baffle sidewall 266 together circumferentially to close the longitudinal seam opening and create a firm fit between the air passage cylinder 254 and the baffle 246.

The baffle 246 is movable between an open position and a closed position, as best seen in FIGS. 30, 35, 35A, 36 and 36A. The baffle 246 is biased in the open position (FIGS. 30, 35 and 35A) by a bias spring 271 (FIG. 30) connected on one end to the baffle boss 270 and on the other end to a spring boss 273 on the support portion 252. In the open position, the cylinder air slots 260 are aligned with the baffle air slots 268 to allow air to freely move through the slots (FIGS. 35 and 35A). Moving the baffle boss 270 counterclockwise moves the baffle 246 to a closed position (FIG. 36 and 36A). In the closed position, the baffle sidewall 266 covers the cylinder air slots 260 and helps prevent air from flowing through the slots 260.

The pump outlet fitting 78 is disposed in the oblong opening 262 of the bottom plenum wall 256 (FIGS. 30 and 31). An upper oblong flange 272 and a lower radial flange 274 securely hold the pump outlet fitting 78 in the oblong opening 262. The opening 262 is oblong shaped to accommodate the insertion of the oblong flange 272 through the opening 262 during assembly. Once the oblong flange 272 is pushed through the oblong opening 262, the oblong flange 272 is twisted ninety degrees to secure it in place, with the lower radial flange 274 forming a seal around the oblong opening 262.

The pump outlet fitting 78 is connected to the outlet tube 48 and the connection nozzle 276. The connection nozzle 276 includes an insertion nozzle 278, an outlet tube connection fitting 280, and a securing flange 282. The outlet connection fitting 280 extended into the outlet tube 48. The connection nozzle 276 is secured to the support portion 252 by a screw 286 which extends through the securing flange 282 and into a threaded opening 288 in the support portion 252.

The insertion nozzle 278 is inserted into a nozzle opening 290 which is disposed in an opening 292 in the lid 16 and extends upward into the motor housing 18 (FIG. 32). The nozzle opening 290 is one element of a check valve 294 which is disposed in the motor housing 18. The check valve 294 includes a hollow right angle tube 296 which has the nozzle opening 290 at one end and the pump outlet 30 at the other. A ball seat 298, a ball 300, and a rib 302 are disposed within the right angle tube 296 between the pump outlet 30 and the nozzle opening 290. The ball seat 298 is disposed above the nozzle opening 290 and includes a groove 304 in which the ball 300 seats. The ball 300 has a diameter less than the diameter of the tube 296 so that liquid can flow around the ball 300. The rib 302 is positioned between the ball 300 and the pump outlet 30.

Figure 33:
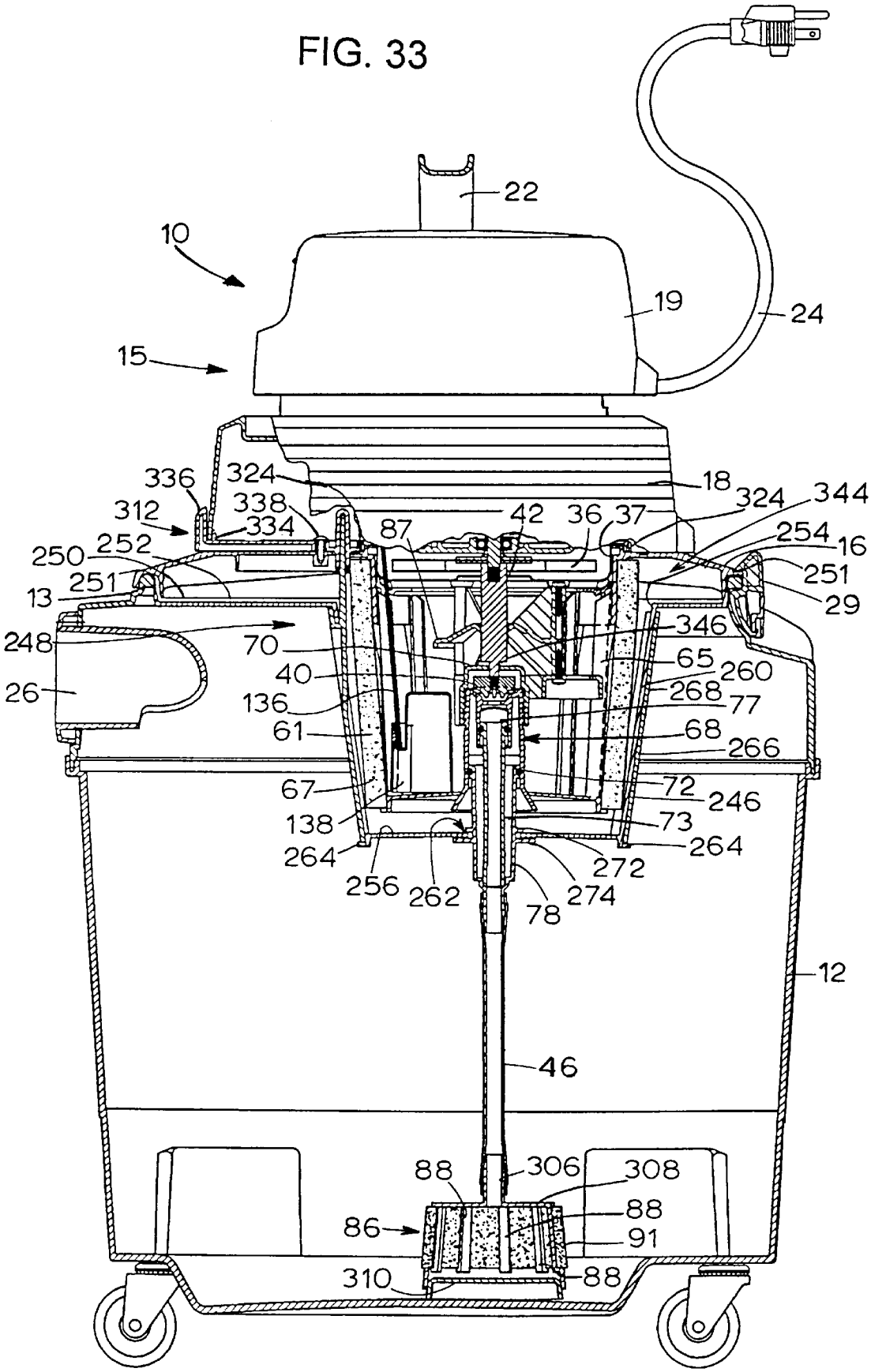
FIG. 33 is a side elevational view, partially in section, along the line 33—33 in FIG. 29.

The inlet tube 74 connects into one end of the inlet tube 46 and a lower cage fitting 306 fits into the other end of the inlet tube 46 (FIGS. 31–33). The lower cage fitting 306 is connected to a top wall 308 of the lower cage 86. The lower cage 86 further includes a bottom wall 310 and brackets 88 which may be surrounded by a foam filter 91, as described above.

Figure 34:
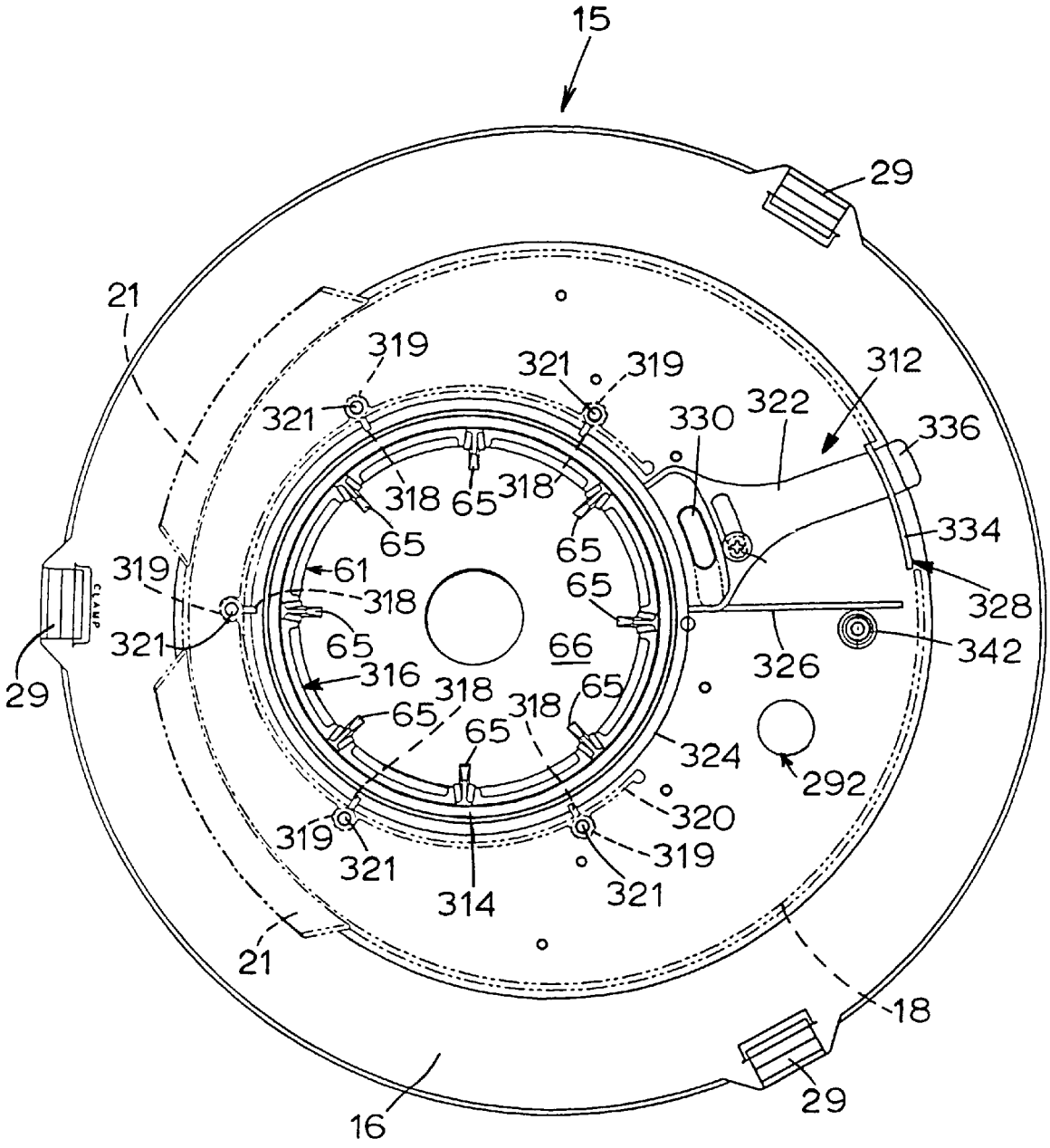
FIG. 34 is a top plan view of a lid and a lid cage with a baffle lever installed.

As best illustrated in FIGS. 33 and 34, the alternative embodiment upper vacuum assembly 15 includes a baffle lever 312. The baffle lever 312 is disposed on top of the lid 16 and surrounds a lip 314. The lip 314 is formed integrally with the lid 16 and defines an opening 316 in which the air impeller housing 37 (not depicted in FIG. 34) is disposed. A stabilizing circular rail 320 is formed along the bottom of the motor housing 18 (motor housing components are shown in phantom in FIG. 34). The stabilizing circular rail 320 includes a plurality of integrally formed threaded bosses 319, and extending inward from each boss 319 is a tab 318. The threaded bosses 319 extend through an equal number of openings 321 in the lid 16. The lid cage 61 is then attached to the lid 16 by screwing screws (not depicted) into the thread bosses 319 from the under side of the lid 16. Once assembled, the stabilizing circular rail 320 and the tabs 318 prevent the baffle lever 312 from moving laterally or upwardly.

Figures 37, 37A:
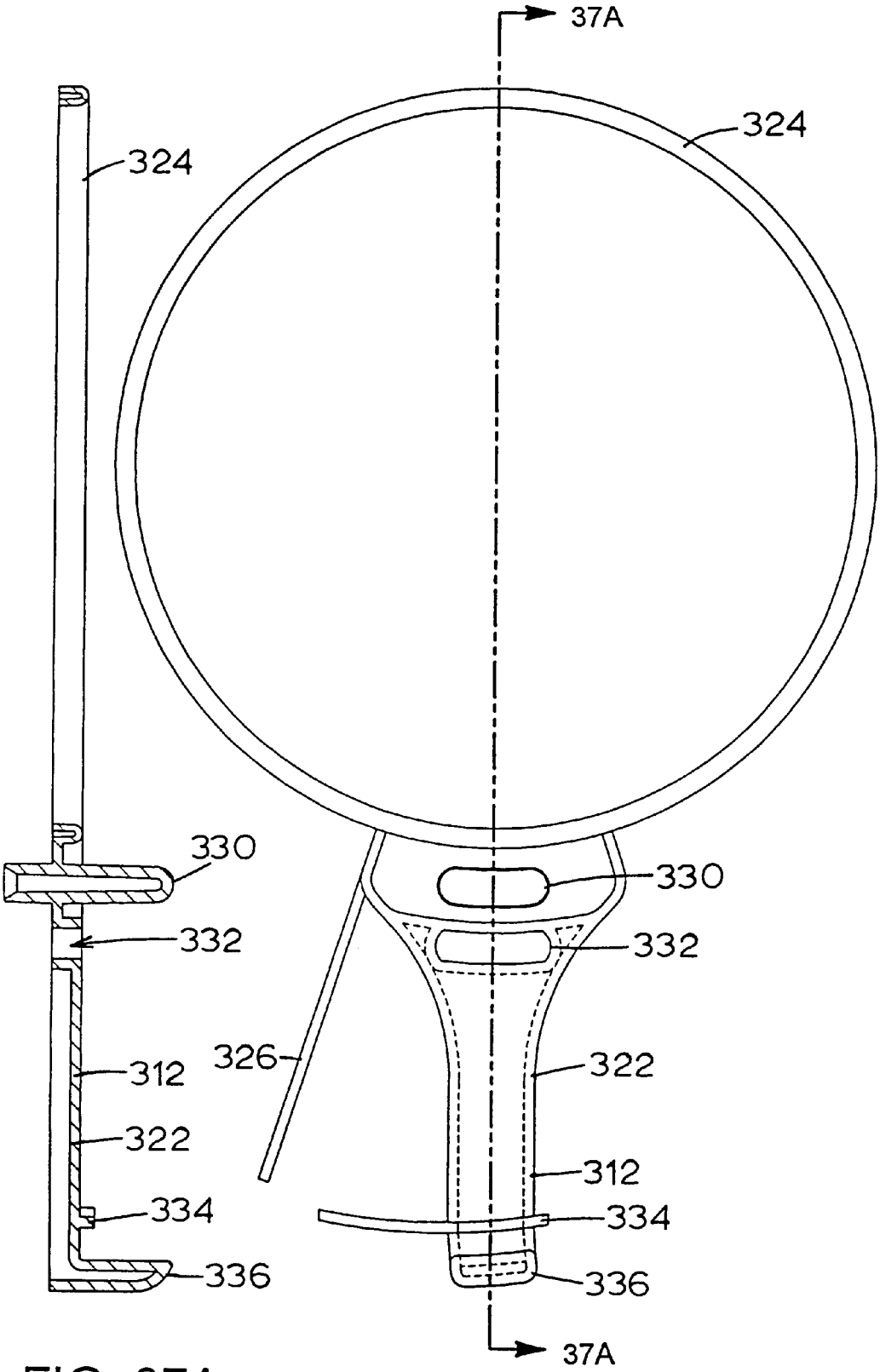
FIG. 37 is a top plan view of the baffle lever.
FIG. 37A is a sectional view along the line 37A—37A in FIG. 37.

The baffle lever 312 includes a lever arm 322, a turning ring 324, and a return spring 326 (FIGS. 34, 37 and 37A). The turning ring 324 surrounds the lip 314. The lever arm 322 and the return spring 326 are integrally formed with the turning ring 324. The lever arm 322 extends outward from the turning ring 324 along the surface of the lid 16 and extends out through a slot 328 in the motor housing 18, as best seen in FIG. 39. The lever arm 322 includes a baffle boss sleeve 330, a fastener slot 332, a sealing lip 334, and an actuation handle 336. The baffle boss sleeve 330 is disposed near the turning ring 324 and seats over the baffle boss 270 (FIGS. 35 and 36). A fastener 338 (FIG. 34) is disposed in the fastener slot 332 and secures the lever arm 322 to the lid 16. The sealing lip 334 is integrally formed with the lever arm 322 and extends upward from the lever arm 322. The sealing lip 334 is positioned so that it seals the slot 328 when the baffle lever 312 is at rest. The sealing lip 334 acts to prevent air from exiting from the slot 328 when the vacuum cleaner 10 is in operation. The actuation handle 336 is integrally formed at the outer end of the lever arm 322 and extends upward from it. The return spring 326 extends outward from the turning ring 324 along the surface of the lid 16 at an angle from the lever arm 322. The return spring 326 makes contact with a post 342 to pre-load the return spring 326 and bias the lever arm 322 to the open position. It should be noted that the lever arm 322 and the baffle boss 270 are separately biased in the open position. Thus, when the insertion assembly 248 is removed (FIG. 38), the baffle boss 270 and the baffle boss sleeve 330 will be separately biased in the same configuration for easy reinsertion when replacing the insertion assembly 248.

The non-pumping operation of the alternative embodiment vacuum cleaner 10 is substantially the same as previous embodiments. The only significant difference is the use of the check valve 294 between the pump outlet 30 and the outlet tube 48 (FIG. 32). The check valve 294 helps reduce the amount of air entering the tank 12 or the pump 68 through the outlet 30 during non-pumping operation. The ball 300 is made denser than the liquids the vacuum cleaner 10 pumps so that the ball 300 will seat in the groove 304 even if liquid is trapped in the right angle tube 296 from previous pumping. During non-pumping operation of the vacuum cleaner 10, the baffle 246 is biased to the open position described above, and air is allowed to freely flow through the baffle air slots 268 and the cylinder air slots 260.

When the user is ready to begin pumping liquid out of the tank 12, the user moves the actuation handle 336 of the baffle lever 312 clockwise in the slot 328 (FIG. 34). The clockwise movement of the lever arm 322 moves the baffle boss sleeve 330, which in turn moves the baffle boss 270 (FIGS. 36 and 36A). The clockwise rotation of the baffle boss 270 rotates the baffle 246 clockwise until the baffle 246 covers the cylinder air slots 260 in the closed position (FIGS. 36 and 36A). A number of limit structures in the vacuum cleaner 10 prevent the baffle 246 from rotating too far and uncovering the cylinder air slots 260. The first is the width of the slot 328 which prevents the user from pushing the lever arm 322 too far (FIG. 34). The second is the fastener 338 in cooperation with fastener slot 332 (FIG. 34). The third limit is the baffle tab slot 261, which engages the baffle boss 270 (FIG. 30). The maximum range of rotation of the baffle 246 may be about nine degrees.

Once the baffle 246 is in the closed position, a pressure differential is created between an upper chamber 344, defined by the plenum 250 and the upper vacuum assembly 15, and the inside of tank 12 (FIG. 32). Closing the baffle 246 essentially reduces the amount of air that the air impeller 36 can draw from the tank 12. As described above, no seal exists where the shaft 42 passes through an aperture 346 in the upper impeller housing 70 (the tolerance, for manufacturing purposes, between the shaft 42 and the upper impeller housing 70 may be about 0.03 inches), putting the upper priming chamber 77 in air flow communication with the upper chamber 344. As a result, the pressure in the upper priming chamber 77 is reduced, creating a significant pressure differential between the upper priming chamber 77 and the tank 12. As a result, a positive suction head is created in the inlet tube 46, 74 drawing liquid in the tank 12 up through the lower cage 86 and into the tubes 46, 74 and priming the pump 68.

Once the pump 68 is primed, the user releases the actuation handle 336, which returns the baffle 246 to the open position. The return spring 326, which is under load due to its contact with the post 342, rotates the lever arm 322 counterclockwise. The counterclockwise rotation of the lever arm 322 moves the baffle boss sleeve 330, which in turn moves the baffle boss 270. The bias spring 271 also helps rotate the baffle boss 270 counterclockwise. The baffle boss 270 continues to rotate counterclockwise until the baffle 246 returns to the normally open position (FIGS. 35 and 35A). Any liquid collected in the plenum 250 during the priming process will drain out through the slots 260, 268. As long as the pump 68 maintains its prime, the user can continue to pump liquid out of the tank 12, regardless of whether the user keeps vacuuming additional material into the tank.

When the pump 68 is operating, the pump impeller 40 draws liquid through the inlet tubes 46 and 74 and the upper priming chamber 77, and finally into the discharge recess 73 (FIG. 32). The liquid in the discharge recess 73 then passes through the pump outlet fitting 78, into the outlet tube 48 past the check valve 294, and out of the vacuum cleaner 10 through the pump outlet 30. The rib 302 is disposed in the center of the tube 296, and defines openings (not shown) on either side of the rib 302. Each opening defines a width less than the diameter of the ball 300 to keep the ball 300 from exiting through the outlet 30.

Figure 38:
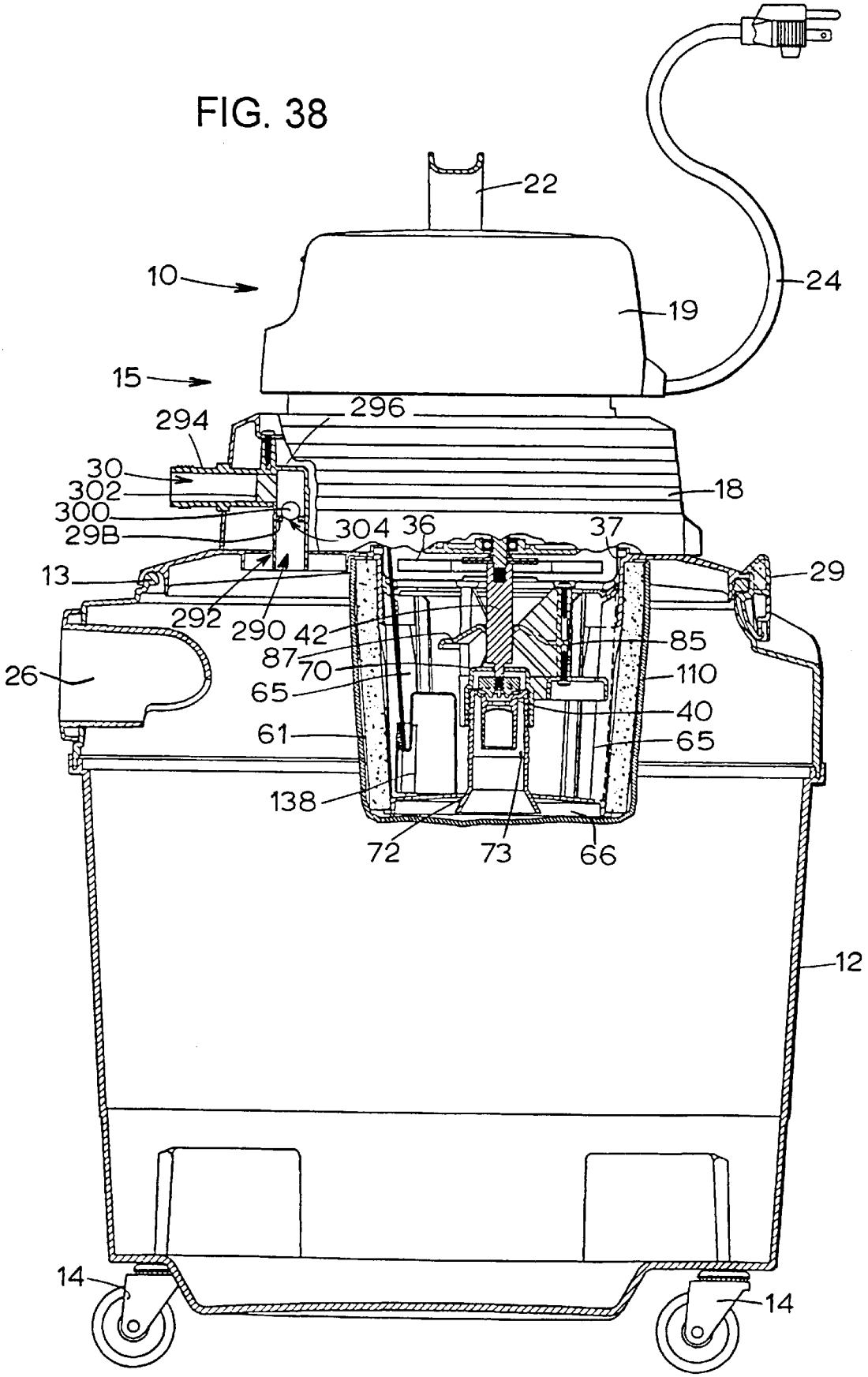
FIG. 38 is a side elevational view of the alternative embodiment vacuum cleaner with the insertion assembly removed.
Figure 39:
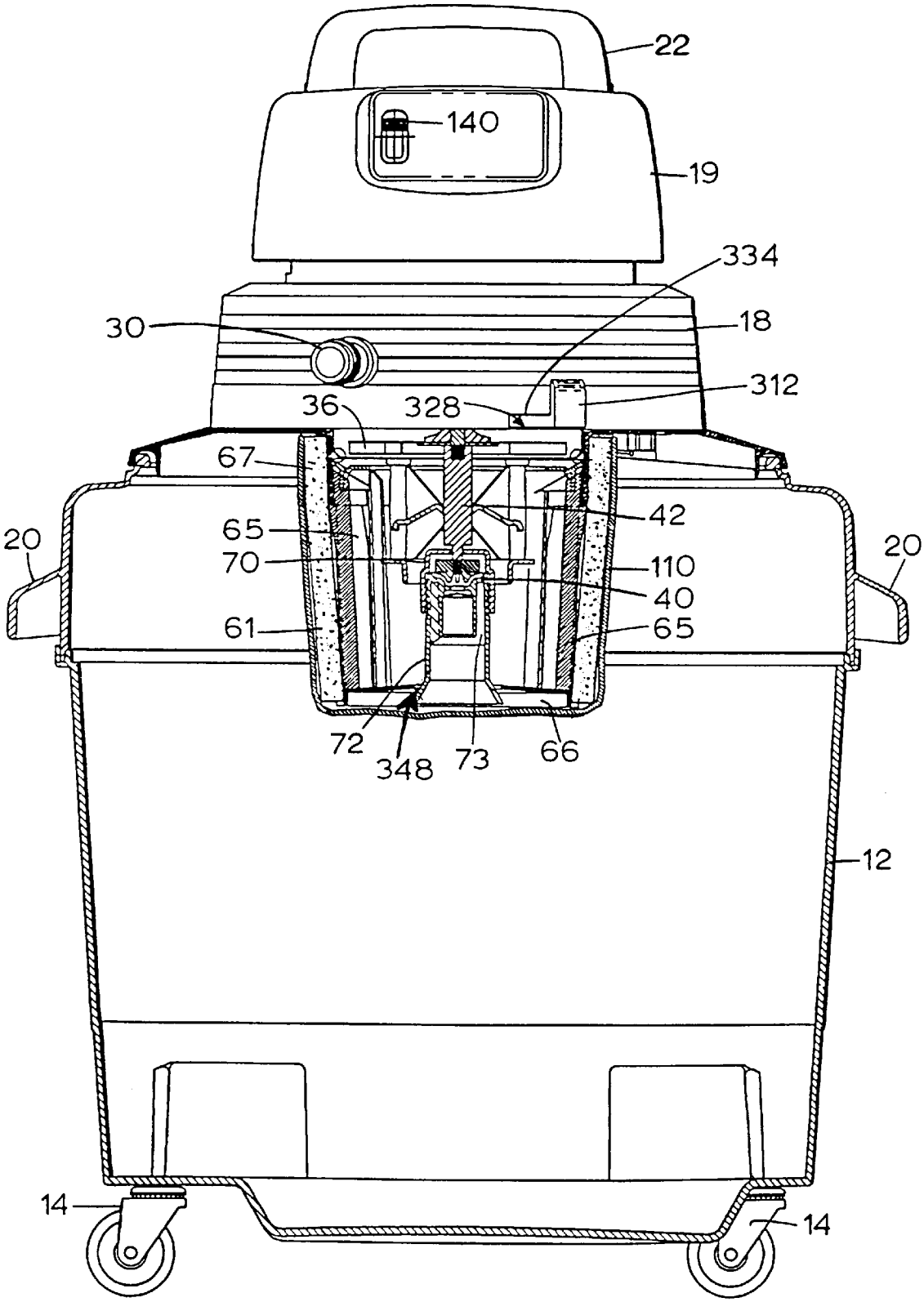
FIG. 39 is a view similar to FIG. 8 of the vacuum cleaner of FIG. 28.

FIGS. 38 and 39 depict the vacuum cleaner 10 with the insertion assembly 248 and its associated components removed from between the tank 12 and the upper vacuum assembly 15. A particulate filter 110 may be placed over the lid cage 61. As previously described, the particulate filter 110 covers the plate 66 and the opening in the plate 66 through which the impeller housing 72 extends. The vacuum cleaner 10 is now ready for use in suctioning dry material. The check valve 294 seals off the tank 12 from outside air, allowing the vacuum cleaner 10 to maintain the required pressure differential for vacuuming.

Figure 40:
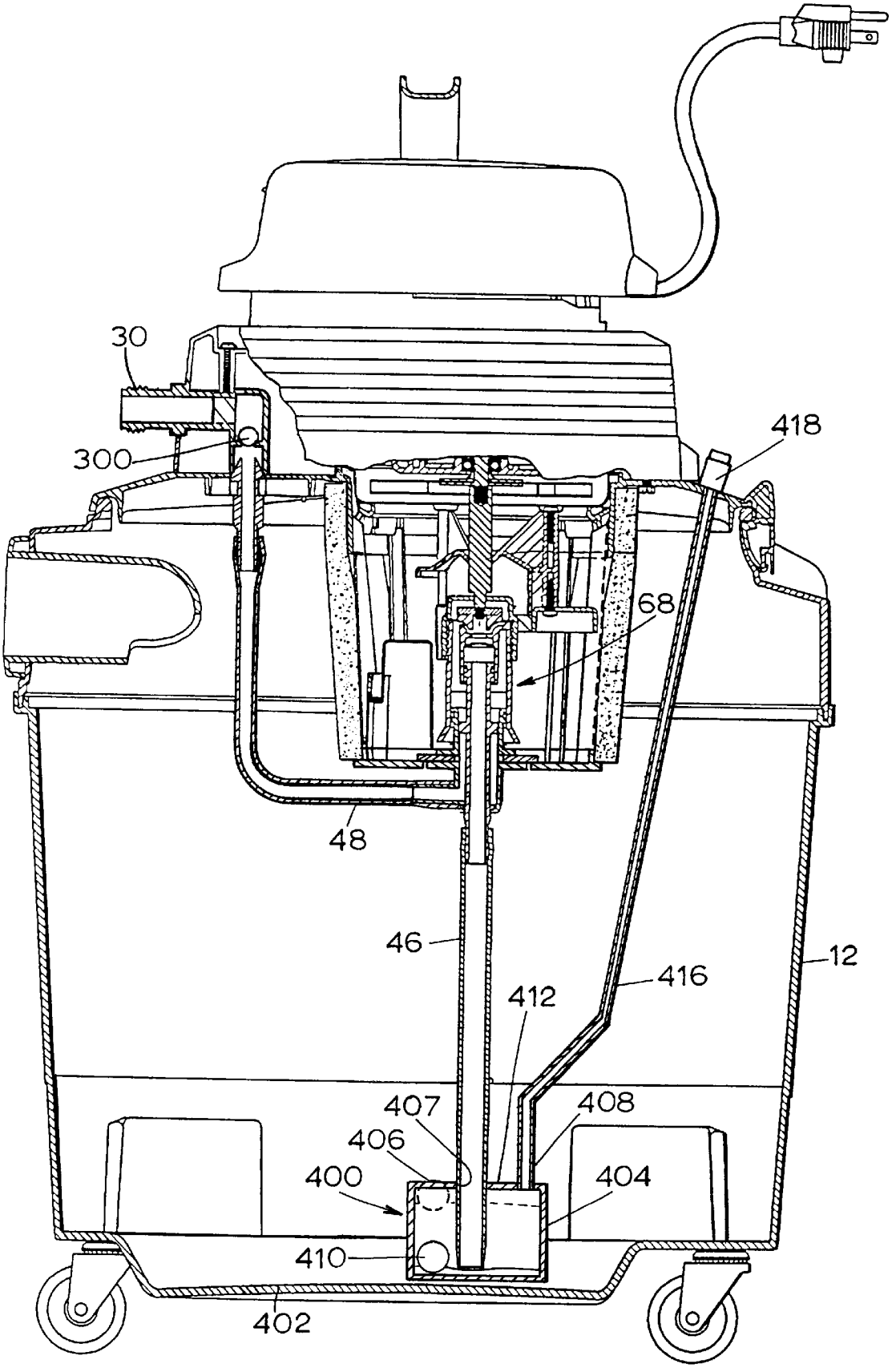
FIG. 40 is a view similar to FIG. 33 of a further embodiment.
Figure 41:
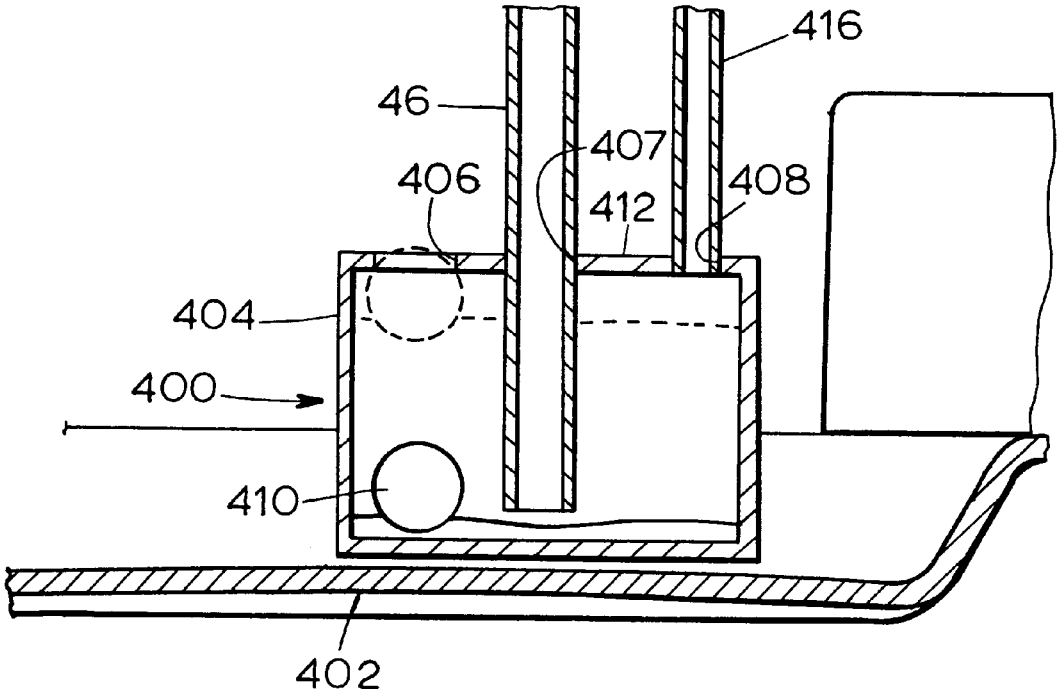
FIG. 41 is an enlarged fragmentary view of a portion of the embodiment of FIG. 40.

FIGS. 40 and 41 illustrate yet another embodiment wherein like numbers designate elements common to the other Figs. This embodiment differs from that shown in FIGS. 29–39 in that an alternative priming apparatus 400 is disposed in the tank 12 in fluid communication with the pump 68, and further advantageously differs in that the plenum 250 is omitted. Preferably, the priming apparatus 400 is secured to and carried by the inlet tube 46 at a height just above a bottom wall 402 of the tank 12. Alternatively, the apparatus may rest on the bottom wall 402, if desired. The apparatus includes a hollow body 404 having first, second and third holes or bores 406, 407 and 408 extending through one or more walls of the body 404 and a ball 410 disposed in the body 404. In the illustrated embodiment, the holes 406–408 are located in an upper wall 412 of the body 404, although, as noted in greater detail hereinafter, this need not be the case. Also preferably, although not necessarily, the ball 410 has a density less than water or any other liquid to be suctioned, and hence is buoyant.

The inlet tube 46 is sealed to the body 404 within the hole 407. A tube or conduit 416 is sealed to the body 404 within the hole 408 and extends upwardly to a valve 418 mounted at any convenient location on the tank 12 or lid 16 or at any other location. Preferably, the valve 418 is manually actuable to momentarily connect ambient air pressure to the body 404 through the tube 416.

As liquid is suctioned into the tank 12, the liquid level rises until the level of the hole 406 in the upper wall 412 is reached, whereupon liquid enters the body 404. The solid line drawings of the ball 410 in FIGS. 40 and 41 show the liquid level when liquid is just beginning to enter the body 404. Eventually, enough liquid enters the body 404 to cause the ball 410 to seat against the surface(s) forming the hole 406 to thereby seal such hole (this condition is illustrated by the dotted lines in FIGS. 40 and 41). Priming can then be accomplished by manually actuating the valve 418 while the pump 68 and fan impeller are operating. In this fashion, a pressure differential is established across the liquid in the body 404 by the application of ambient air pressure through the tube 416 and the low air pressure existing in the inlet tube 46. This pressure differential causes the pump 68 to prime. Thereafter, liquid is pulled into the body 404 past the ball and is discharged by the pump 68 in the fashion noted previously.

It should be noted that the length of time that ambient pressure is supplied by the valve 418 should be sufficient to insure that priming takes place, but not so long as to unduly impair operation of the vacuum components.

If necessary or desirable, a filter may be placed over the hole 46 to prevent debris from entering the body 404. In addition, the ball 410 may be captured in a cage which constrains movement of the ball along a defined path.

Figure 42:
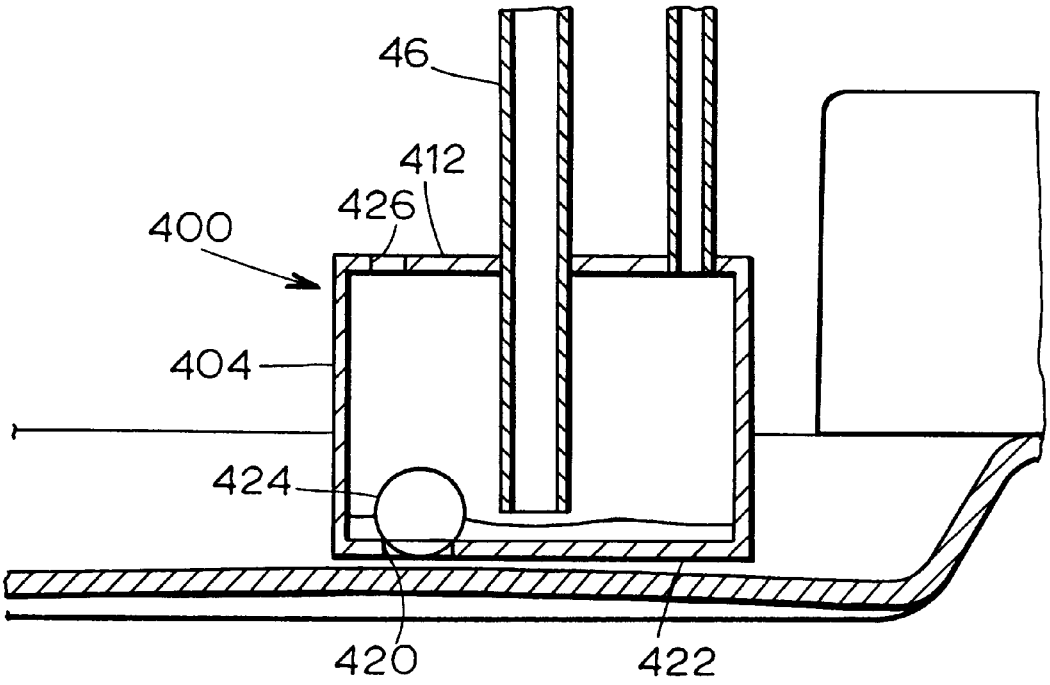
FIG. 42 is a view similar to FIG. 41 illustrating yet another embodiment.

In a still further embodiment, as seen in FIG. 42, an additional hole 420 may be provided in a lower wall 422 of the body 404 and the buoyant ball 410 may be replaced by a non-buoyant ball 424 which is sized to fit within and seal off the hole 420. In addition, in this embodiment, the hole 406 is replaced by a vent hole 426 located preferably (although not necessarily) in the upper wall 412. As liquid is suctioned into the tank 12, the liquid enters the body 404 past the ball 424. During this time, air escapes from the body 404 through the vent hole 426. Eventually, the liquid covers the end of the inlet tube 46, whereupon the valve 418 can be manually actuated to prime the pump 68. Preferably, the vent hole 426 is sized to maintain a sufficient pressure differential thereacross during priming.

As in the immediately preceding embodiment, the ball 424 may be disposed in a cage and one or both of the holes 420 and 426 may be covered by a filter, if desired. This embodiment advantageously permits emptying of the tank 12 to a level substantially coincident with the end of the inlet tube 46, as opposed to the immediately preceding embodiment, which only permits emptying to the level of the hole 406.

Referring again to FIG. 40, it should be noted that the tube 416 need not be connected to the valve 418. For example, a valve may be secured to the pump outlet 30 and the tube 416 may be coupled to the pump outlet at a point between the valve and the ball 300. When priming is to be undertaken, the valve on the pump outlet is opened, establishing the above-describing pressure differential across the liquid in the body 404. Once priming occurs, liquid is passed back to the body 404 through the tube 416, thereby purging the system of air. As should be evident, in this embodiment, the valve on the pump outlet 30 remains open even after priming. Also, if desired, the ball 300 and associated components may be moved upstream near the junction of the outlet tube 48 with the pump outlet fitting 78. The tube 46 may thus be connected to the pump outlet 30 at a point nearer the body 404 so that the tube 416 may be kept short.

Referring now to FIGS. 43–50, another embodiment of the present invention is disclosed having a priming mechanism similar to that shown in the embodiments of FIGS. 40–42. Like elements in FIGS. 43–50 are provided with the same numerals as like elements in previous embodiments.

Figure 43:
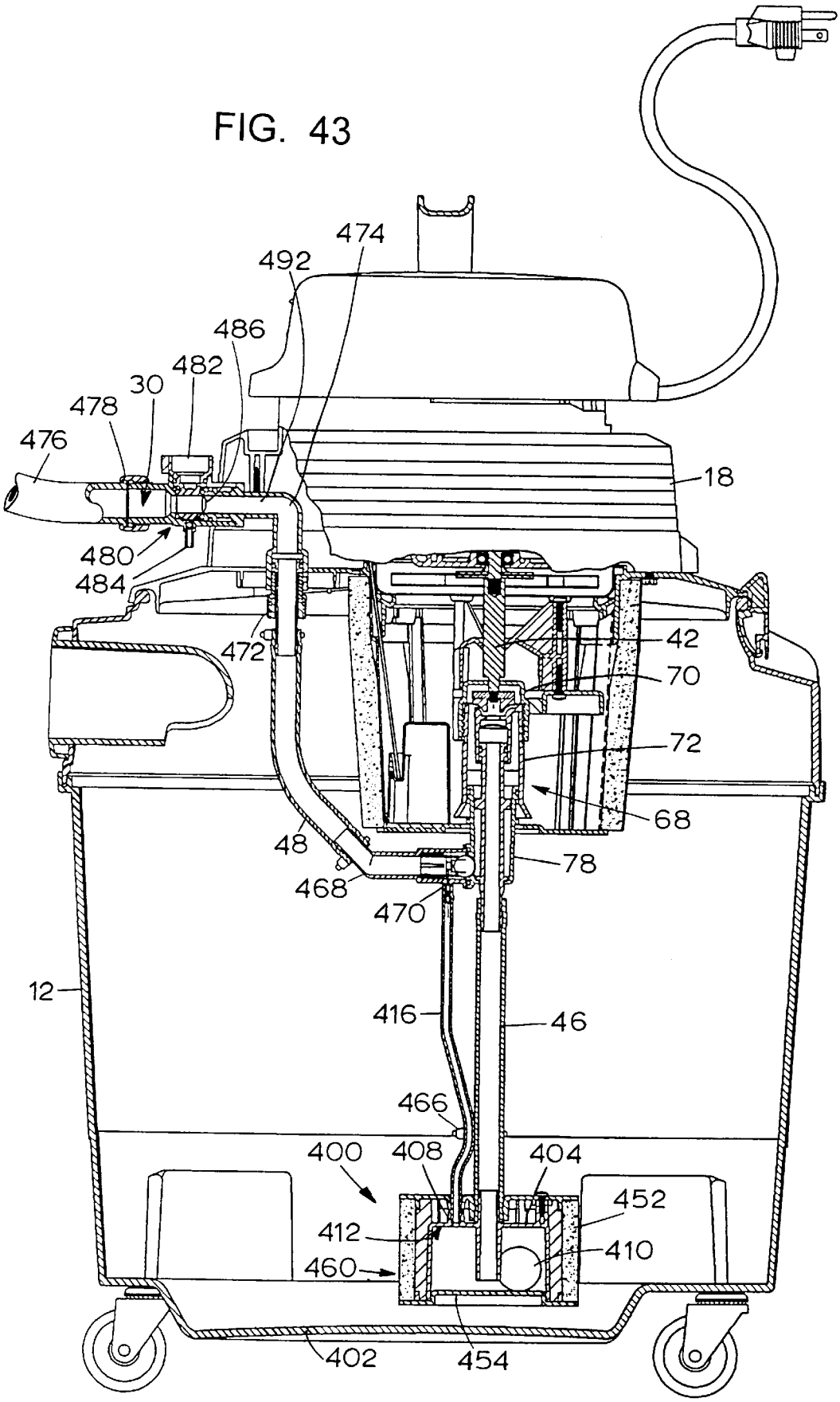
FIG. 43 is a partially broken-way view of yet another embodiment of the present invention.
Figure 44C:
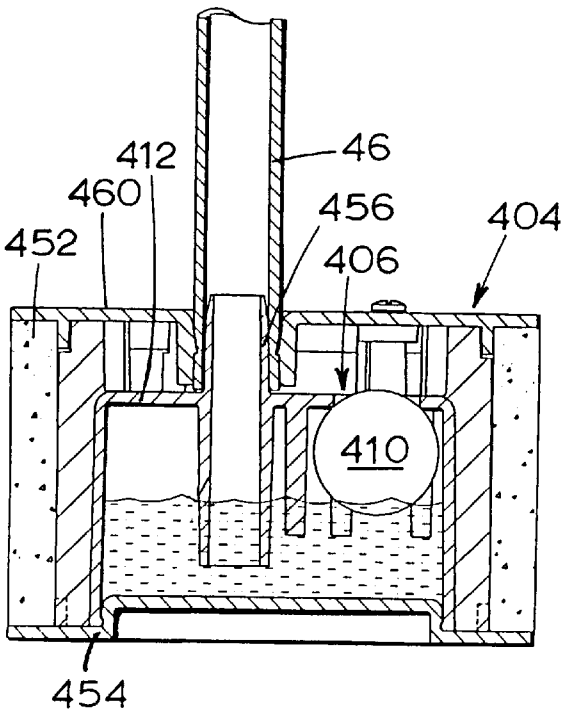
FIG. 44C is a sectional view similar to FIG. 44B showing the lower filter assembly partially filled with water.
Figure 44B:
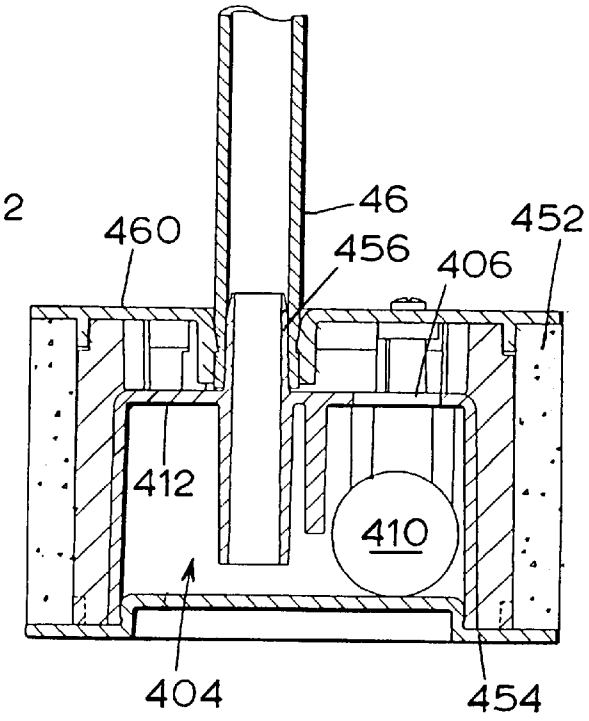
FIG. 44B is a cross-section taken along the line A—A of FIG. 44A of the lower filter assembly.
Figure 44A:
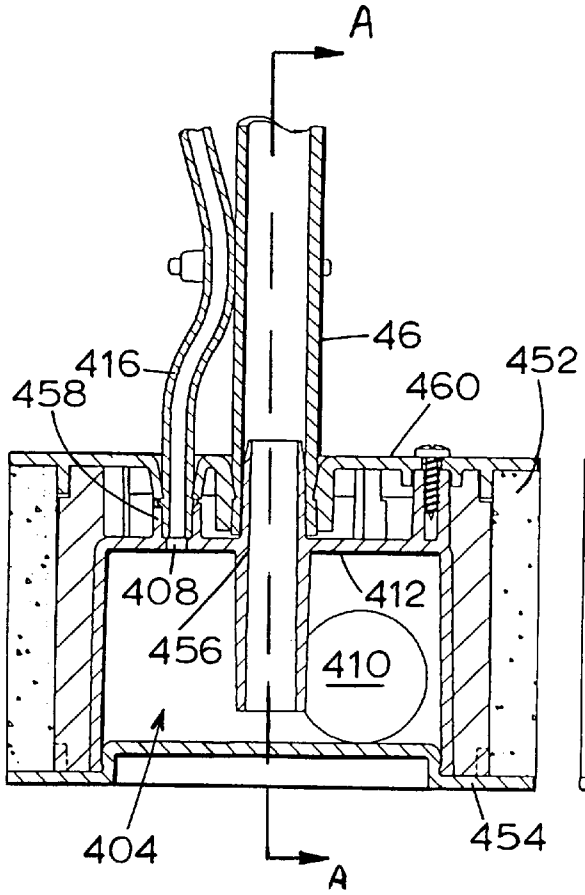
FIG. 44A is an enlarged view of a lower filter assembly of the embodiment of FIG. 43.
Figure 45:
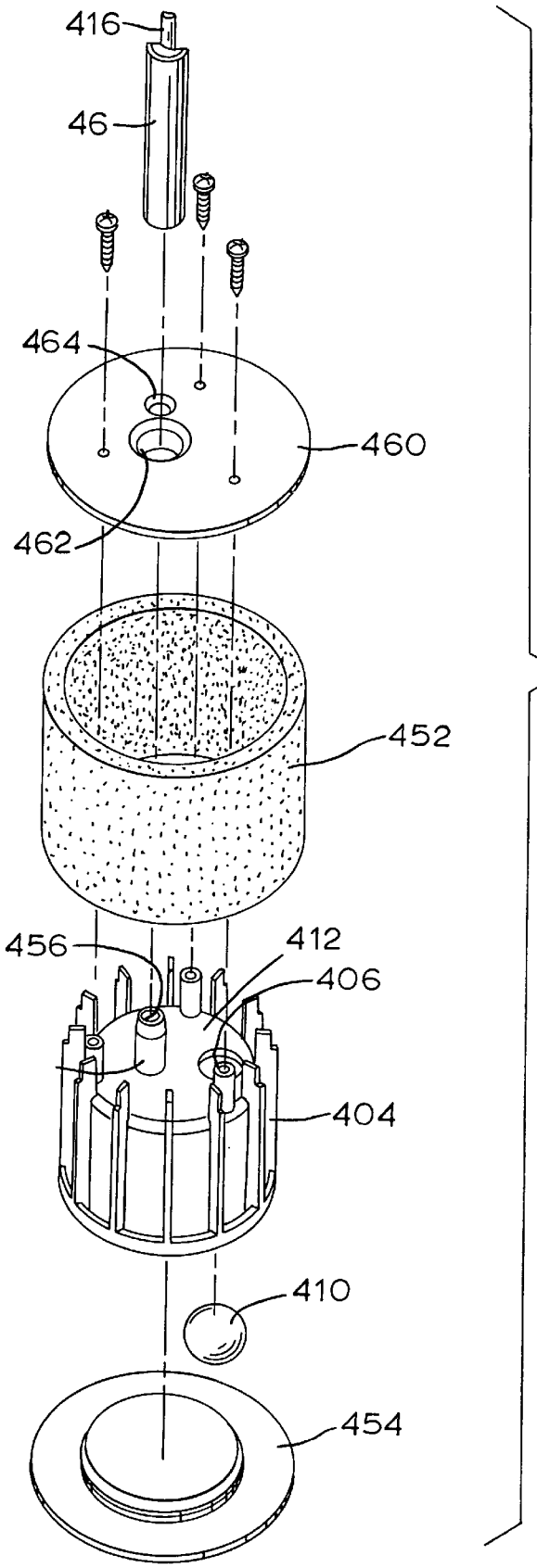
FIG. 45 is a exploded view of the lower filter assembly of the embodiment of FIG. 43.

As shown in FIGS. 43–45, the vacuum cleaner includes a pump 68 and a priming apparatus 400, which includes a lower filter assembly 450 with a filter 452. The lower filter assembly 450 includes a hollow body 404 closed by a bottom plate 454 to form a cavity for ball 410.

As best seen in FIGS. 44A, 44B, 44C, and FIG. 45, the hollow body 404 includes an opening 406 (FIG. 44C) in which ball 410 may seat. The hollow body 404 also has fittings 456 and 458 for attaching, respectively, the inlet tube 46 and the tube or conduit 416. The hollow body 404 has an upper wall 412 on which the fittings 456 and 458 are attached, and through which pass opening 406 and openings for connection to the inlet tube 46 and conduit 416. A top plate 460 is attached to the main body 404 by screws. As best seen in FIG. 45, the top plate 460 has openings 462 and 464 through which the inlet tube 46 and conduit 416 respectively pass. The cover 460 and bottom plate 450 enclose the filter 452 insuring that any liquid passing into the main body 404 through the opening 406 also passes through the filter 452, thereby removing any large particulate material.

Returning now to FIG. 43, the conduit 416 is held against the inlet tube 46 by a clamp 466. The conduit 416 then connects to a fitting 468, which is part of outlet tube 48. The fitting 468 also attaches to the pump outlet fitting 78. The fitting 468 includes a check valve 470, which permits flow from the pump outlet fitting 78 to the fitting 468, but does not permit flow from the fitting 468 to the pump outlet fitting 78. The conduit 416 is attached to the fitting 468 on the outlet side of the check valve 470 so that any fluid passing down through the outlet tube 48 can pass into the conduit 416 without being blocked by the check valve 470.

At the end of the outlet tube 48 opposite the fitting 468 is a connector 472. The connector 472 rotates in order to attach to an elbow 470, which is fixed inside the motor housing 18. The elbow 474 connects the outlet tube 48 with the outlet 30, which may be connected to a hose 476 by a connector 478. The connector 478 may be a threaded ring of the type found on the ends of garden hoses. Between the elbow 474 and the outlet 30 is a ball valve indicated generally at 480. The ball valve has a knob 482 for use in opening and closing the valve. At the bottom of the valve is an inlet 484, the operation of which is described below.

Figure 46A:
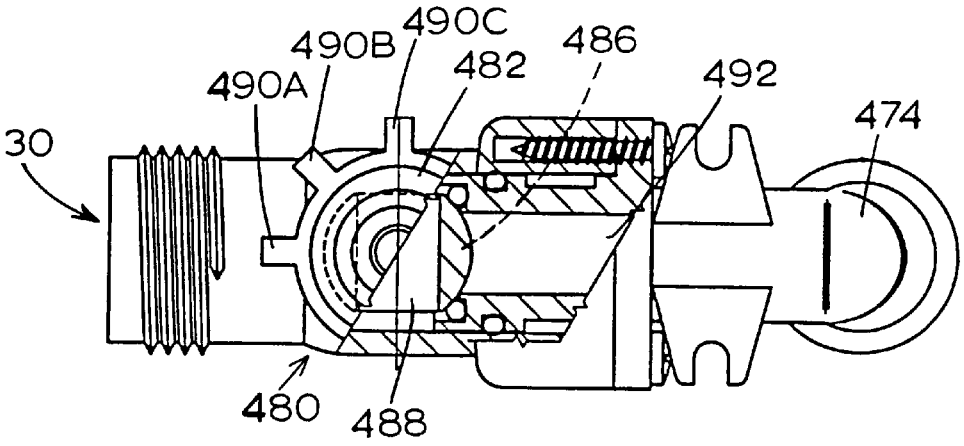
FIG. 46A is a partially broken-way top view of the ball valve assembly of FIG. 43 with the valve in the closed position.
Figure 46B:
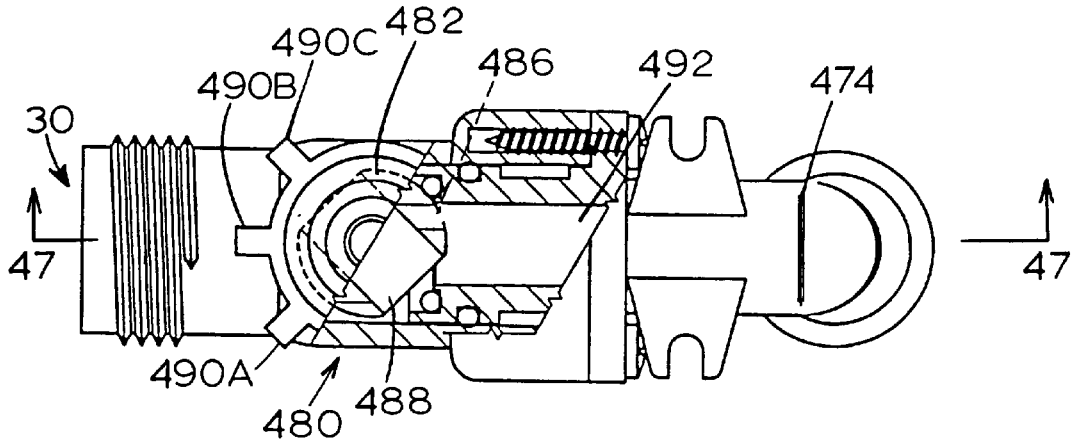
FIG. 46B is a top view similar to that of FIG. 46A with the ball valve in the partially open position.
Figure 46C:
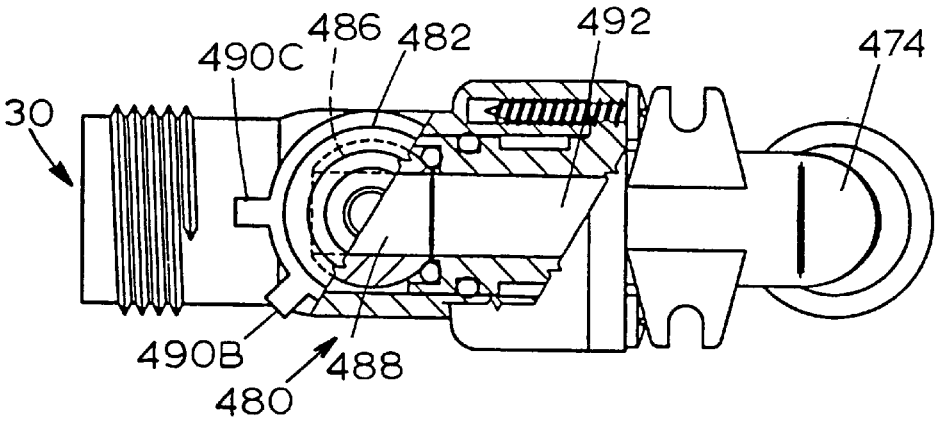
FIG. 46C is a top view similar to FIGS. 46A and B showing the ball valve in the open position.

Referring now to FIGS. 46A–C, the knob 482 is attached to a ball 486, through which a passageway 488 has been bored. The knob 482 includes three dogs 490A, B, and C, which serve to indicate the angular position of the passageway 488 in the ball 486. The ball 486 is mounted within a housing such that when the ball is in the position of FIG. 46A, the ball prevents fluid from flowing from the elbow 474 to the outlet 30 or vice versa. In the position of FIG. 46A, the passageway 488 is perpendicular to a passageway 492 which extends from the elbow 474 to the outlet 30. In the position of FIG. 46A, the dog 490A is aligned with the outlet so that a user can determine the position of the ball.

In the position of FIG. 46B, the passageway 488 is at a 45° angle to the passageway 492, thereby permitting some fluid flow from the elbow 474 to the outlet 30. The dog 490B is aligned with the outlet 30 so that a user can determine the position of the passageway of the ball 482. In the position of FIG. 46C, the passageway 488 is aligned with the passageway 492, thereby permitting maximum fluid flow from the elbow 474 to the outlet 30. The dog 490C is aligned with the outlet 30 so the user can determine the position of the passageway in ball 482. In FIG. 43, the ball valve 480 is shown in the position of FIG. 46B.

Figure 47:
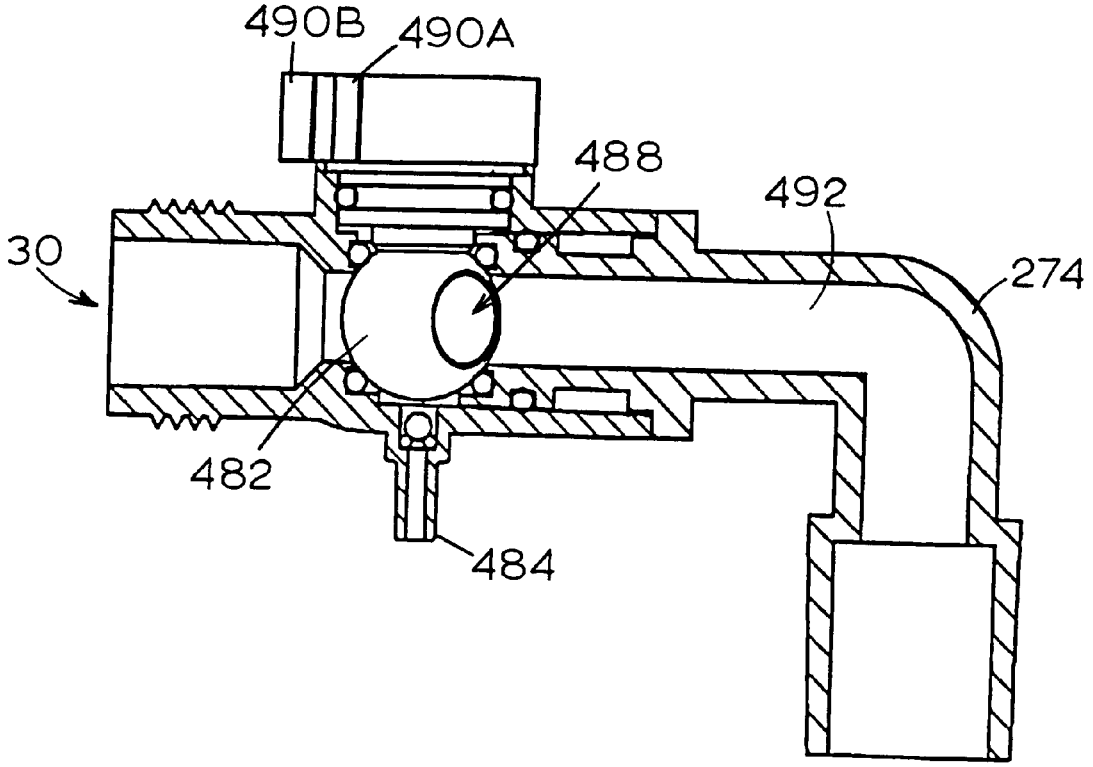
FIG. 47 is a partial sectional view along the line 47—47 of FIG. 46B.
Figure 48:
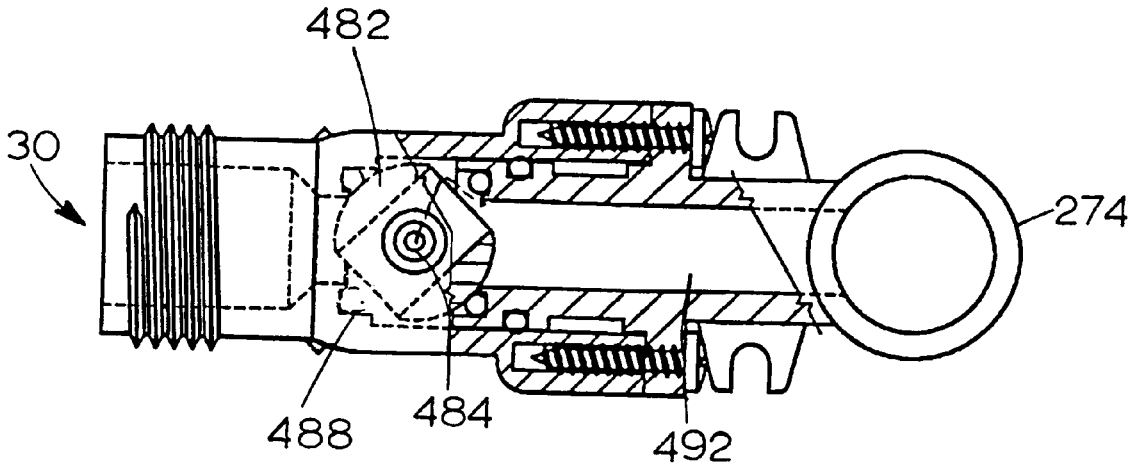
FIG. 48 is a bottom view, partially broken away and partially phantom of the ball valve in the position of FIGS. 46B and 47.

As seen in FIG. 47, the inlet 484 has a check valve 494, which prevents air or liquid from escaping from the elbow 274 or the outlet 30, through the inlet 484. The check valve 494, however, allows air in through the inlet 484 and into the elbow 274 when the ball 482 is at the 45° angle position of FIG. 47. The ball in FIG. 47 has not been sectioned in order that the path air may travel through inlet 484 to elbow 274 can be seen more clearly. The arrows in FIGS. 47 and 48 each show the pathway of air which has entered through the inlet 484. Air passes around the outside of the ball and then across the passageway 488 and into the passageway 492. When the ball is rotated to its 45° position as shown in FIGS. 47 and 48, the housing in which the ball seats is not in contact with the ball in all areas adjacent the entrance to passageway 492. This is due to the fact that in order to place the passageway 488 through the ball 482, the ends of the ball must be removed. There is therefore space, as shown by the arrows in FIGS. 47 and 48, for air to pass into the passageway 492.

Passage of air into the inlet 484 and into the passageway 492 is used to prime the pump 68 (FIG. 43) of the present invention. When the tank 12 has been partially filled with liquid, the user rotates the knob 482 to its 45° position allowing air from the inlet 484 to pass into the passageway 492 through the outlet tube 48 and down into the conduit 416. If the outlet tube 48 and/or conduit 416 are filled or partially filled with liquid, that liquid will flow down toward the hollow body 484. Air is drawn through such a pathway because the air impeller of the vacuum cleaner has created a low-pressure area within the tank. Because of the opening between the upper impeller housing 70 and the shaft 42, a low pressure area is created in the inlet tube 46. Thus, when the ball valve 480 is partially opened, atmospheric pressure flows in to the passageway 492, inlet tube 48, and conduit 416, thereby forcing liquid material in the hollow body 484 up through the inlet tube 486, and up the to the pump 68 to prime the pump. The ball 410 blocks the opening 406 when there is sufficient water in the hollow body 404 (FIG. 44C) so that air rushing in through the conduit 416 cannot simply force water out through opening 406. The check valve 470 prevents air from entering the pump outlet fitting 78 through the outlet tube 48, which might prohibit the pump from being primed.

Figure 49:
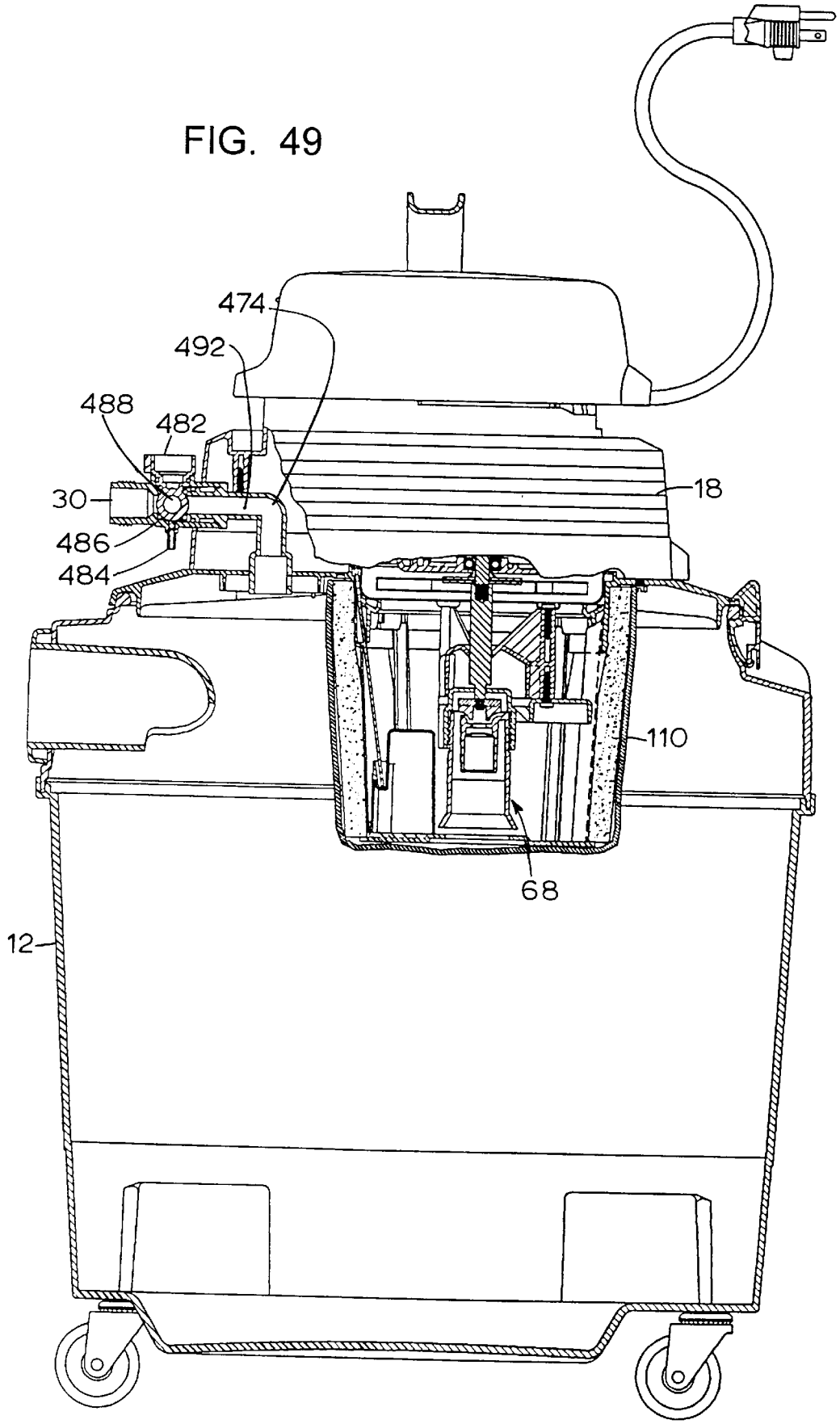
FIG. 49 is a view of the vacuum cleaner of FIG. 42 with the priming mechanism removed.
Figure 50:
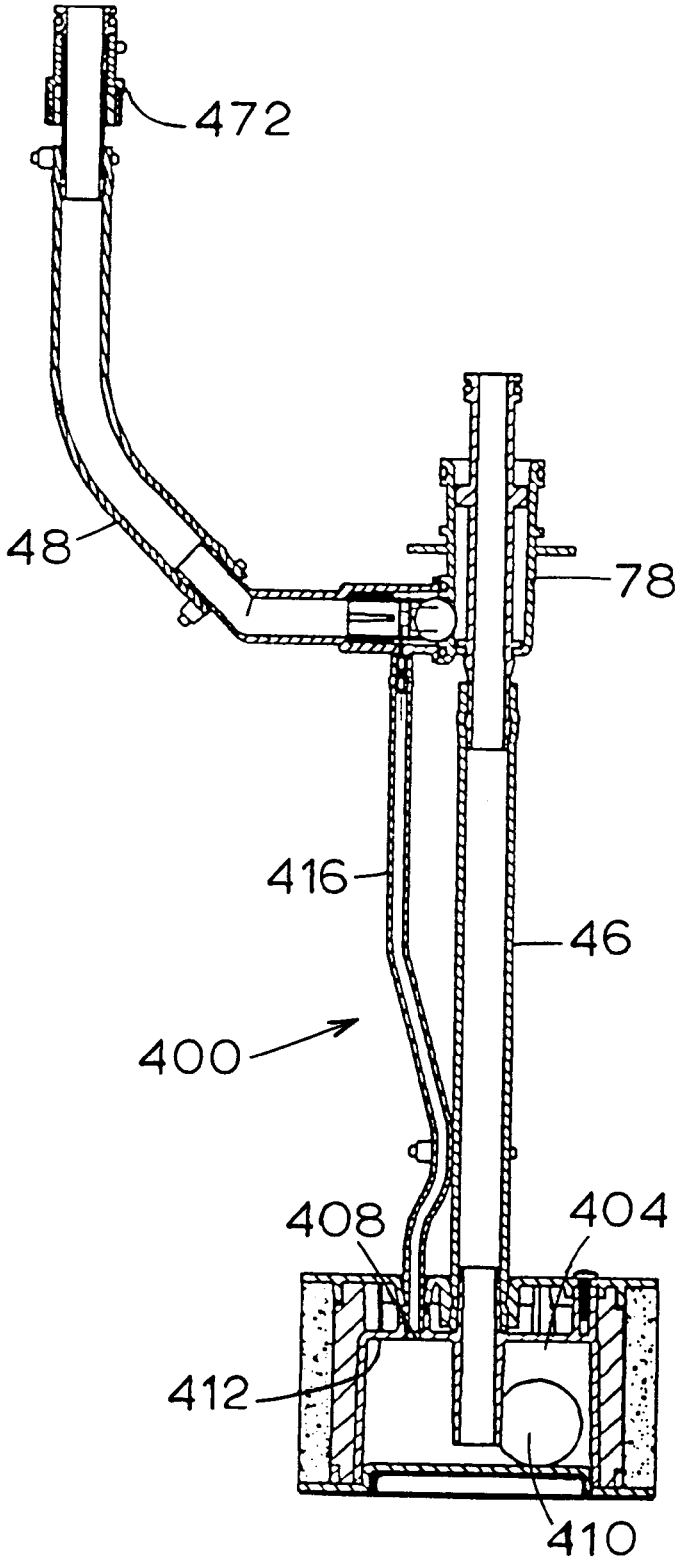
FIG. 50 is a view of the priming assembly of FIG. 43 removed from the vacuum cleaner.

FIG. 49 depicts the vacuum cleaner with the priming mechanism 400 removed, and FIG. 50 shows the removed priming mechanism 400. The priming mechanism is removed by rotating the connector 472 to disengage the outlet tube 48 from the elbow 474. The pump outlet fitting 78 is then rotated with respect to the remainder of the pump 68 so that the pump outlet fitting 78 disengages from the pump 68. After removal, a cloth filter 110 may be placed around the lid cage so as to cover the opening for the pump 68. When the priming mechanism 400 has been removed, the knob 482 is rotated so that the passageway 488 in the ball 486 is perpendicular to the passageway 492. In such a position, air cannot enter the tank 12 through the outlet 30. In addition, air will not pass through the inlet 484 because the position of the ball 486, as shown in FIG. 49, does not permit air to pass around the ball and into the passageway 490.

Although use of a valve 480 is preferred, the system may be primed without a valve in the outlet tube 48. Under most conditions, when water is in the hollow body, that water will be forced toward the pump 68 if the hollow body communicates with atmospheric pressure. Use of a valve may help priming under certain conditions, i.e. when pressure differential is low or there is little liquid in the tank 13. The valve is also desirable because it prevents liquid from being expelled by the pump 68 prior to a user being prepared to properly direct that liquid to disposal.

The priming mechanism as shown in FIGS. 43–50 is advantageous because it allows for quick and easy priming with a minimum of parts. In addition, by attaching the conduit 416 to the outlet tube 48, only one opening need be placed through the upper motor housing 18 in order to provide both an outlet for fluid expelled by the pump and an inlet for atmospheric pressure to force water up to prime the pump.

The vacuum cleaner of the present invention has significant advantages over prior vacuum cleaners. By providing a pump to remove liquid from the tank, liquid can be emptied easily into drains at a variety of heights. Driving the pump impeller off of the same motor which drives the air impeller significantly reduces the cost of the vacuum cleaner over designs which require a separate motor for the pump. By locating the pump in the tank directly below the air impeller (s), the pump impeller can be simply and efficiently driven off a single axle connected to the air impeller. Removability of portions of the pump, including the intake tube, provides significant efficiency when the vacuum cleaner is used on dry material. Attaching the removable portions of the pump to a tank extension, which is removably mounted to the edge of the vacuum tank, permits easy removal and reinstallation of the pump components from the tank.

The electrical and mechanical shut-off and bypass systems of the present invention also provide significant advantages. Both the electrical and mechanical systems of the present invention automatically shut off the motor when the liquid level in the vacuum cleaner tank reaches a preset motor shut-off level. Both the electrical and the mechanical systems allow the user to then bypass the vacuum cleaner shut-off and continue to pump liquid out of the tank without requiring the user to lift or tilt the tank to empty it.

The baffle priming system of the present invention provides a priming system with significant advantages. The baffle, in concert with the plenum, creates a pressure differential between the upper chamber and the tank. Since the upper priming chamber of the pump is in air flow communication with the upper chamber, the resulting pressure differential primes the pump. The baffle priming system is easy for the user to use and requires fewer parts than previous designs.

The last described embodiments are simpler still and use only one moving element in the tank 12 to accomplish priming. Reliability and durability are thus enhanced.

The foregoing detailed description has been given for clearness of understanding only, and no unnecessary limitations should be understood therefrom, as modifications would be obvious to those skilled in the art.

We claim:

1. A vacuum cleaner comprising:

a tank having a first inlet for receiving liquid material;

a powered pump defining an aperture which places the interior of the pump in air flow communication with the interior of the tank;

a second inlet disposed within the tank and in fluid communication with the interior of the pump, placing the second inlet in air flow communication with the interior of the tank;

an air impeller assembly, disposed in air flow communication with the interior of the tank, including a housing defining an opening and a driven impeller disposed within the housing, such that the impeller is in air flow communication with the interior of the tank and creates a relatively low pressure area in the interior of the tank which, by way of communication, creates low relative pressure areas in the interior of the pump and the second inlet; and a priming apparatus, disposed within the tank in fluid communication with the second inlet, having a source of pressure which is high relative to the relatively low pressure in the interior of the tank, wherein when the liquid material received by the tank reaches the level of the second inlet, the source of relatively high pressure acts in concert with the relatively low pressure in the second inlet to establish a pressure differential across the second inlet, wherein the pump is primed.

2. The vacuum cleaner of claim 1, comprising:

means for selectively actuating the source of relatively high pressure to establish the pressure differential across the second inlet.

3. The vacuum cleaner of claim 2, wherein the selective actuating means comprises a valve coupled to the priming apparatus.

4. The vacuum cleaner of claim 1, wherein the priming apparatus includes a main body having a top wall wherein a hole is disposed in the top wall and further including a ball in the main body and engageable with the hole.

5. The vacuum cleaner of claim 1, wherein the prig apparatus includes a main body having a bottom wall wherein a hole is disposed in the bottom wall and further including a ball in the main body and engageable with the hole.

6. The vacuum cleaner of claim 1 comprising:

an outlet from the vacuum cleaner in communication with the pump for discharging liquid material received by the tank; and wherein the priming apparatus comprises:

a main body in which the second inlet is disposed;

a conduit in fluid communication with the outlet and the main body; and a selectively actuable valve disposed within the conduit between the outlet and the main body.

7. The vacuum cleaner of claim 6, wherein the valve includes an air inlet in fluid communication with the conduit.

8. The vacuum cleaner of claim 7, wherein the valve is movable among three positions;

a first position in which the valve blocks the outlet from communicating with the pump and the conduit and blocks the air inlet from communicating with the conduit;

a second position in which the valve allows the outlet to communicate with the pump and the conduit and allows the air inlet to communicate with the conduit; and a third position in which the valve allows the outlet to communicate with the pump and the conduit and blocks the air inlet from communicating with the conduit.

9. The vacuum cleaner of claim 1, wherein the pump is disposed adjacent to the air impeller assembly.

10. The vacuum cleaner of claim 1, wherein the pump comprises:

an upper pump assembly including a pump impeller and a pump impeller housing, wherein the pump impeller is disposed within the pump impeller housing; and a pump adapter assembly which includes the priming apparatus, wherein the pump adapter assembly is removably attached to the upper pump assembly.

* * * * *